US006426917B1

(12) United States Patent
Tabanou et al.

(10) Patent No.: US 6,426,917 B1
(45) Date of Patent: Jul. 30, 2002

(54) RESERVOIR MONITORING THROUGH MODIFIED CASING JOINT

(75) Inventors: Jacques Tabanou; Reinhart Ciglenec, both of Houston, TX (US); Clive Eckersley, Cairo (EG); Christian Chouzenoux, St. Cloud (FR)

(73) Assignee: Schlumberger Technology Corporation, Houston, TX (US)

( * ) Notice: Subject to any disclaimer, the term of this patent is extended or adjusted under 35 U.S.C. 154(b) by 0 days.

(21) Appl. No.: 09/394,831

(22) Filed: Sep. 13, 1999

Related U.S. Application Data

(63) Continuation-in-part of application No. 09/019,466, filed on Feb. 5, 1998, now Pat. No. 6,028,534, and a continuation-in-part of application No. 09/135,774, filed on Aug. 18, 1998, now Pat. No. 6,070,662.

(60) Provisional application No. 60/048,254, filed on Jun. 2, 1997.

(51) Int. Cl.[7] ..... H01N 9/00

(52) U.S. Cl. ..... 367/82; 340/854.4; 340/854.6; 324/333; 324/338

(58) Field of Search ..... 367/82; 166/55; 340/854.4, 854.6; 324/338, 333

(56) References Cited

U.S. PATENT DOCUMENTS

| | | | | |
|---|---|---|---|---|
| 4,651,100 A | | 3/1987 | Janes | 324/338 |
| 5,553,492 A | | 9/1996 | Barrett et al. | 73/152.29 |
| 5,692,565 A | | 12/1997 | MacDougall et al. | 166/264 |
| 5,730,219 A | | 3/1998 | Tubel et al. | 166/250.1 |
| 5,763,773 A | * | 6/1998 | Birchak et al. | 181/104 |
| 5,765,637 A | | 6/1998 | Dietle et al. | 166/55 |
| 5,887,657 A | | 3/1999 | Bussear et al. | 166/336 |
| 6,028,534 A | | 2/2000 | Ciglenec et al. | 340/856.02 |
| 6,084,403 A | * | 7/2000 | Sinclair et al. | 166/255.1 |
| 6,333,699 B1 | * | 12/2001 | Zierolf | 166/254.2 |
| 6,333,700 B1 | * | 12/2001 | Thomeer et al. | 166/254.2 |

FOREIGN PATENT DOCUMENTS

| | | |
|---|---|---|
| EP | 0 882 871 A2 | 12/1998 |
| EP | 0 984 135 A2 | 3/2000 |
| GB | 2 302 114 | 1/1997 |
| GB | 2 337 546 | 11/1999 |
| WO | WO 97/21117 | 6/1997 |

* cited by examiner

*Primary Examiner*—Michael Horabik
*Assistant Examiner*—Albert K. Wong
(74) *Attorney, Agent, or Firm*—John J. Ryberg; Steven L. Christian; JL (Jennie) Salazar

(57) ABSTRACT

An apparatus and a method for controlling oilfield production to improve efficiency includes a remote sensing unit that is placed within a subsurface formation, an antenna structure for communicating with the remote sensing unit, a casing joint having nonconductive "windows" for allowing a internally located antenna to communicate with the remote sensing unit, and a system for obtaining subsurface formation data and for producing the formation data to a central location for subsequent analysis. The remote sensing unit is placed sufficiently far from the wellbore to reduce or eliminate effects that the wellbore might have on formation data samples taken by the remote sensing unit. The remote sensing unit is an active device with the capability of responding to control commands by determining certain subsurface formation characteristics such as pressure or temperature, and transmitting corresponding data values to a wellbore tool. Some embodiments of the remote sensing unit include a battery within its power supply. Other embodiments include a capacitor for storing charge. In order for a communication link to be established with the remote sensing unit through a wireline tool in a cased well, a casing joint includes at least one electromagnetic window that is formed of a non-conductive material that will allow electromagnetic signals to pass through it. In the preferred embodiment, the electromagnetic windows are formed to substantially circumscribe the casing joint to render it largely rotationally invariant. The electromagnetic windows are formed of any rigid and durable non-conductive material including, by way of example, either ceramics or fiberglass.

23 Claims, 32 Drawing Sheets

RESERVOIR MONITORING THROUGH MODIFIED CASING JOINT

CROSS-REFERENCE TO RELATED APPLICATIONS

This application is a continuation-in-part of U.S. application Ser. No. 09/019,466, filed on Feb. 5, 1998 now U.S. Pat. No. 6,028,534, which claims priority to U.S. Provisional Application Serial No. 60/048,254 filed Jun. 2, 1997; and is also a continuation-in-part of U.S. application Ser. No. 09/135,774, filed on Aug. 18, 1998 now U.S. Pat. No. 6,070,662.

BACKGROUND

1. Technical Field

The present invention relates generally to the discovery and production of hydrocarbons, and more particularly, to the monitoring of downhole formation properties during drilling and production.

2. Related Art

Wells for the production of hydrocarbons such as oil and natural gas must be carefully monitored to prevent catastrophic mishaps that are not only potentially dangerous but also that have severe environmental impacts. In general, the control of the production of oil and gas wells includes many competing issues and interests including economic efficiency, recapture of investment, safety and environmental preservation.

On one hand, to drill and establish a working well at a drill site involves significant cost. Given that many "dry holes" are dug, the wells that produce must pay for the exploration and digging costs for the dry holes and the producing wells. Accordingly, there is a strong desire to produce at a maximum rate to recoup investment costs.

On the other hand, the production of a producing well must be monitored and controlled to maximize the production over time. Production levels depend on reservoir formation characteristics such as pressure, porosity, permeability, temperature and physical layout of the reservoir and also the nature of the hydrocarbon (or other material) extracted from the formation. Additional characteristics of a producing formation must also be considered, such characteristics include the oil/water interface and the oil/gas interface, among others.

Producing hydrocarbons too quickly from one well in a producing formation relative to other wells in the producing formation (of a single reservoir) may result in stranding hydrocarbons in the formation. For example, improper production may separate an oil pool into multiple portions. In such cases, additional wells must be drilled to produce the oil from the separate pools. Unfortunately, either legal restrictions or economic considerations may not allow another well to be dug thereby stranding the pool of oil and, economically wasting its potential for revenue.

Besides monitoring certain field and production parameters to prevent economic waste of an oilfield, an oilfield's production efficiencies may be maximized by monitoring the production parameters of multiple wells for a given field. For example, if field pressure is dropping for one well in an oil field more quickly than for other wells, the production rate of that one well might be reduced. Alternatively, the production rate of the other wells might be increased. The manner of controlling production rates for different wells for one field is generally known. At issue, however, is obtaining the oil field parameters while the well is being formed and also while it is producing.

In general, control of production of oil wells is a significant concern in the petroleum industry due to the enormous expense involved. As drilling techniques become more sophisticated, monitoring and controlling production even from a specified zone or depth within a zone is an important part of modern production processes.

Consequently, sophisticated computerized controllers have been positioned at the surface of production wells for control of uphole and downhole devices such as motor valves and hydro-mechanical safety valves. Typically, microprocessor (localized) control systems are used to control production from the zones of a well. For example, these controllers are used to actuate sliding sleeves or packers by the transmission of a command from the surface to downhole electronics (e.g., microprocessor controllers) or even to electro-mechanical control devices placed downhole.

While it is recognized that producing wells will have increased production efficiencies and lower operating costs if surface computer based controllers or downhole microprocessor based controllers are used, their ability to control production from wells and from the zones served by multilateral wells is limited to the ability to obtain and to assimilate the oilfield parameters. For example, there is a great need for real-time oilfield parameters while an oil well is producing. Unfortunately, current systems for reliably providing real-time oilfield parameters during production are not readily available.

Moreover, many prior art systems generally require a surface platform at each well for monitoring and controlling the production at a well. The associated equipment, however, is expensive. The combined costs of the equipment and the surface platform often discourage oil field producers from installing a system to monitor and control production properly. Additionally, current technologies for reliably producing real time data do not exist. Often, production of a well must be interrupted so that a tool may be deployed into the well to take the desired measurements. Accordingly, the data obtained is expensive in that it has high opportunity costs because of the cessation of production. It also suffers from the fact that the data is not true real-time data.

Some prior art systems measure the electrical resistivity of the ground in a known manner to estimate the characteristics of the reservoir. Because the resistivity of hydrocarbons is higher than water, the measured resistivity in various locations can be of assistance in mapping out the reservoir. For example, the resistivity of hydrocarbons to water is about 100 to 1 because the formation water contains salt and, generally, is much more conductive.

Systems that map out reservoir parameters by measuring resistivity of the reservoir for a given location are not always reliable, however, because they depend upon the assumption that any present water has a salinity level that renders it more conductive that the hydrocarbons. In those situations where the salinity of the water is low, systems that measure resistivity are not as reliable.

Some prior art systems for measuring resistivity include placing an antenna within the ground for generating relatively high power signals that are transmitted through the formation to antennas at the earth surface. The amount of the received current serves to provide an indication of ground resistivity and therefore a suggestion of the formation characteristics in the path formed from the transmitting to the receiving antennas.

Other prior art systems include placing a sensor at the bottom of the well in which the sensor is electrically connected through cabling to equipment on the surface. For example, a pressure sensor is placed within the well at the bottom to attempt to measure reservoir pressure. One shortfall of this approach, however, is that the sensor does not read reservoir pressure that is unaffected by drilling equipment and formations since the sensor is placed within the well itself.

Other prior art systems include hardwired sensors placed next to or within the well casing in an attempt to reduce the effect that the well equipment has on the reservoir pressure. While such systems perhaps provide better pressure information than those in which the sensor is placed within the well itself, they still do not provide accurate pressure information that is unaffected by the well or its equipment.

Alternatives to the above systems include sensors deployed temporarily in a wireline tool system. In some prior art systems, a wireline tool is lowered to a specified location (depth), secured, and deploys a probe into engagement with the formation to obtain samples from which formation parameters may be estimated. One problem with using such wireline tools, however, is that drilling and/or production must be stopped while the wireline tool is deployed and while samples are being taken or while tests are being performed. While such wireline tools provide valuable information, significant expense results from "tripping" the well, if during drilling, or stopping production.

Thus, there exists a need in the art for a reservoir management system that efficiently senses reservoir formation parameters so that the reservoir may be drilled and produced in a controlled manner that avoids waste of the hydrocarbon resources or other resources produced from it.

SUMMARY OF THE INVENTION

To overcome the shortcomings of the prior systems and their operations, the present invention contemplates a reservoir management system including a centralized control center that communicates with a plurality of remote sensing units that are deployed in the subsurface formations of interest by way of communication circuitry located on the earth surface at the well site. According to specific implementations, the deployed remote sensing units provide formation information either to a measurement while drilling tool (MWD) or to a wireline tool. The well control unit is coupled either to a least one antenna or to a downhole data acquisition system that includes an antenna for communicating with the remote sensing units.

Because the remote sensing units are already deployed, the downtime associated with gathering remote sensing unit information via a wireline tool is minimized. Because the invention may be implemented through MWD tool, there is no downtime associated with gathering remote sensing unit information during drilling. Accordingly, formation information may be obtained more efficiently, and more frequently thereby assisting in the efficient depletion of the reservoir.

In one embodiment of the described embodiment, a central control center communicates with a plurality of well control units deployed at each well for which remote sensing units have been deployed. Some wells include a drilling tool that is in communication with at least one remote sensing unit while other wells include a wireline tool that is communication with at least one remote sensing unit. Other wells include permanently installed downhole electronics and antennas for communicating with the remote sensing units.

Each of the wells that have remote sensing units deployed therein include circuitry for receiving formation data received from the remote sensing units. In some embodiments, a well control unit serves to transpond the formation data to the central control unit. In other embodiments, an oilfield service vehicle includes transceiver circuitry for transmitting the formation data to the central control system. In an alternate embodiment, a surface unit, by way of example, a well control unit merely stores the formation data until the data is collected through a conventional method.

Some of the methods for producing the formation data to the central control center for analysis include conventional wireline links such as public switched telephone networks, computer data networks, cellular communication networks, satellite based cellular communication networks, and other radio based communication systems. Other methods include physical transportation of the formation data in a stored medium.

The central control center receives the formation data and analyzes the formation data for a plurality of wells to determine depletion rates for each of the wells so that the field may be depleted in an economic and efficient manner. In the preferred embodiment, the central control center generates control commands to the well control units. Responsive thereto, the well control units modify production according to the received control commands. Additionally, the well control units, wherever installed, continue to periodically produce formation data to the central control center so that local depletion rates may be modified if necessary.

More specifically, some of the disclosed embodiments include a downhole communication system that includes a wireline tool located within a cased well section for communicating with the remote sensing unit located outside of the casing. Accordingly, one aspect of the invention includes a casing joint that includes non-conductive electromagnetic windows that allow electromagnetic signals to be transmitted from the tool within the casing to the remote sensing unit and vice versa. In the described embodiment, the electromagnetic windows are formed to substantially circumscribe a portion of the casing to render the casing rotationally invariant to the location of the remote sensing unit. In an alternate embodiment, at least one electromagnetic window is placed on only one side of the casing thereby requiring careful placement of the casing in relation to the remote sensing unit. As a result of including a casing section that is non conductive and that passes electromagnetic signals, conventional wireline tools for cased hole applications may be made to include communication circuitry for establishing communication links with the remote sensing units so that formation data may be quickly and conveniently obtained to assist in the controlled depletion of a well within a field.

Other aspects of the present invention will become apparent with further reference to the drawings and specification that follow.

BRIEF DESCRIPTION OF THE DRAWINGS

A better understanding of the present invention can be obtained when the following detailed description of the preferred embodiment is considered with the following drawings, in which.

DETAILED DESCRIPTION OF THE DRAWINGS

Figure 1:
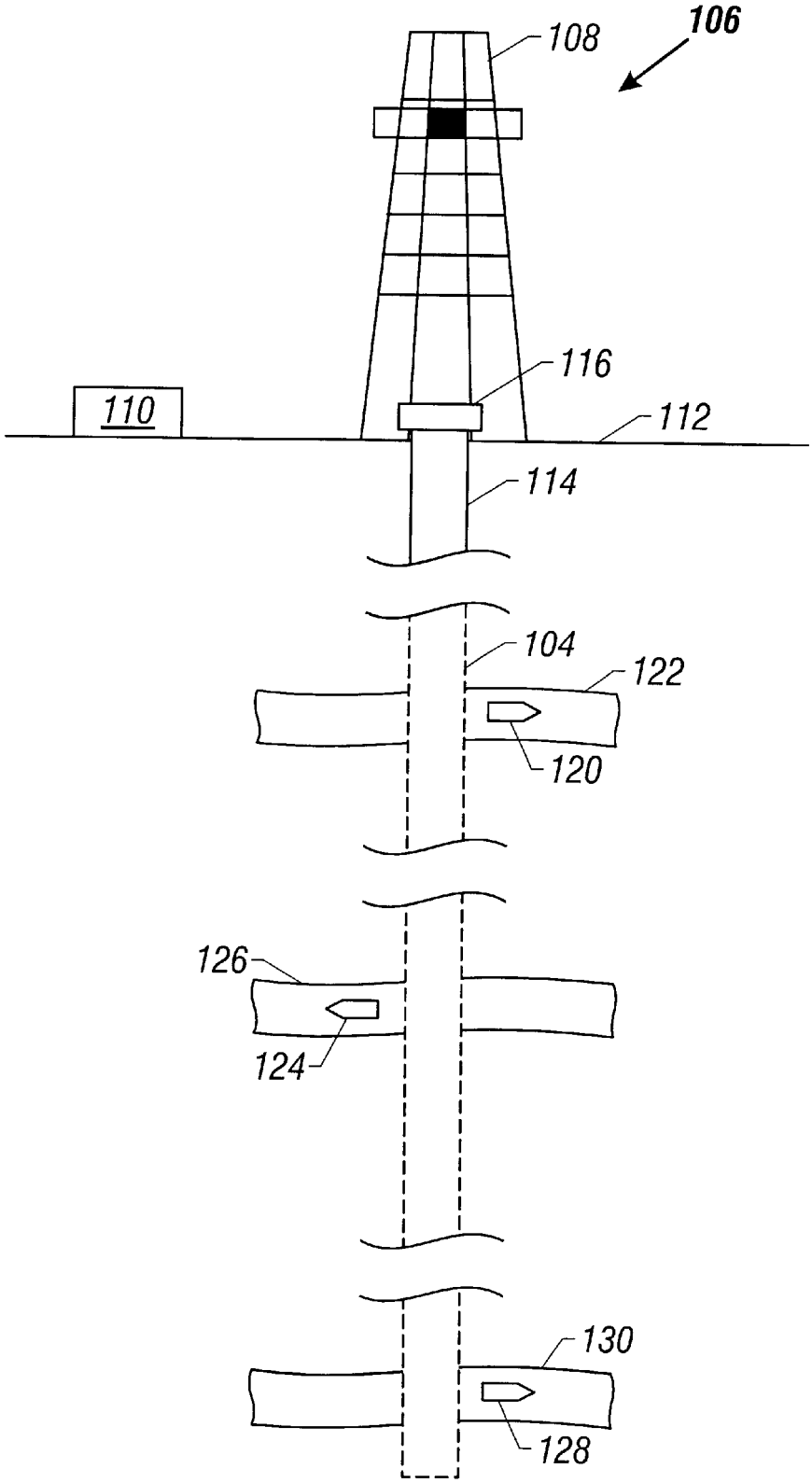
FIG. 1 is a diagrammatic sectional side view of a drilling rig, a well-bore made in the earth by the drilling rig, and a plurality of remote sensing units that have been deployed from the wellbore into various formations of interest.

FIG. 1 is a diagrammatic sectional side view of a drilling rig 106, a well-bore 104 made in the earth by the drilling rig 106, and a plurality of remote sensing units 120, 124 and 128 that have been deployed from a tool in the wellbore 104 into various formations of interest, 122, 126 and 130, respectively. The well-bore 104 was drilled by the drilling rig 106 which includes a drilling rig superstructure 108 and additional components.

It is generally known in the art of drilling wells to use a drilling rig 106 that employs rotary drilling techniques to form a well-bore 104 in the earth 112. The drilling rig superstructure 108 supports elevators used to lift the drill string, temporarily stores drilling pipe when it is removed from the hole, and is otherwise employed to service the well-bore 104 during drilling operations. Other structures also service the drilling rig 106 and include covered storage 110 (e.g., a dog house), mud tanks, drill pipe storage, and various other facilities.

Drilling for the discovery and production of oil and gas may be onshore (as illustrated) or may be off-shore or otherwise upon water. When offshore drilling is performed, a platform or floating structure is used to service the drilling rig. The present invention applies equally as well to both onshore and off-shore operations. For simplicity in description, onshore installations will be described.

When drilling operations commence, a casing 114 is set and attached to the earth 112 in cementing operations. A blow-out-preventer stack 116 is mounted onto the casing 114 and serves as a safety device to prevent formation pressure from overcoming the pressure exerted upon the formation by a drilling mud column. Within the well-bore 104 below the casing 114 is an uncased portion of well-bore 104 that has been drilled in the earth 112 in the drilling operations. This uncased portion of the well-bore or borehole is often referred to as the "open-hole."

In typical drilling operations, drilling commences from the earth's surface to a surface casing depth. Thereafter, the surface casing is set and drilling continues to a next depth where a second casing is set. The process is repeated until casing has been set to a desired depth. FIG. 1 illustrates the structure of a well after one or more casing strings have been set and an open-hole segment of a well has been drilled and remains uncased.

According to the present invention, remote sensing units are deployed into formations of interest from the well-bore 104. For example, remote sensing unit 120 is deployed into subsurface formation 122, remote sensing unit 124 is deployed into subsurface formation 126 and remote sensing unit 128 is deployed into subsurface formation 130. The remote sensing units 120, 124 and 128 measure properties of their respective subsurface formations. These properties include, for example, formation pressure, formation temperature, formation porosity, formation permeability and formation bulk resistivity, among other properties. This information enables reservoir engineers and geologists to characterize and quantify the characteristics and properties of the subsurface formations 122, 126 and 130. Upon receipt, the formation data regarding the subsurface formation may be employed in computer models and other calculations to adjust production levels and to determine where additional wells should be drilled.

As contrasted to other measurements that may be made upon the formation using measurement while drilling (MWD) tools, mud logging, seismic measurements, well logging, formation samples, surface pressure and temperature measurements and other prior techniques, the remote sensing units 120, 124 and 128 remain in the subsurface formations. The remote sensing units 120, 124 and 128 therefore may be used to continually collect formation information not only during drilling but also after completion of the well and during production. Because the information collected is current and accurately reflects formation conditions, it may be used to better develop and deplete the reservoir in which the remote sensing units are deployed.

As is discussed in detail in co-pending U.S. application Ser. No. 09/019,466, filed on Feb. 5, 1998 and claiming priority to U.S. Provisional Application Serial No. 60/048,254 filed Jun. 2, 1997, and U.S. application Ser. No. 09/135,774, filed on Aug. 18, 1998 (priority is claimed to both and both are incorporated by reference), the remote sensing units 120, 124 and 128 are preferably set during open-hole operations. In one embodiment, the remote sensing units are deployed from a drill string tool that forms part of the collars of the drill string. In another embodiment, the remote sensing units are deployed from an open-hole logging tool. For particular details to the manner in which the remote sensing units are deployed, refer to the incorporated description.

Figure 2A:
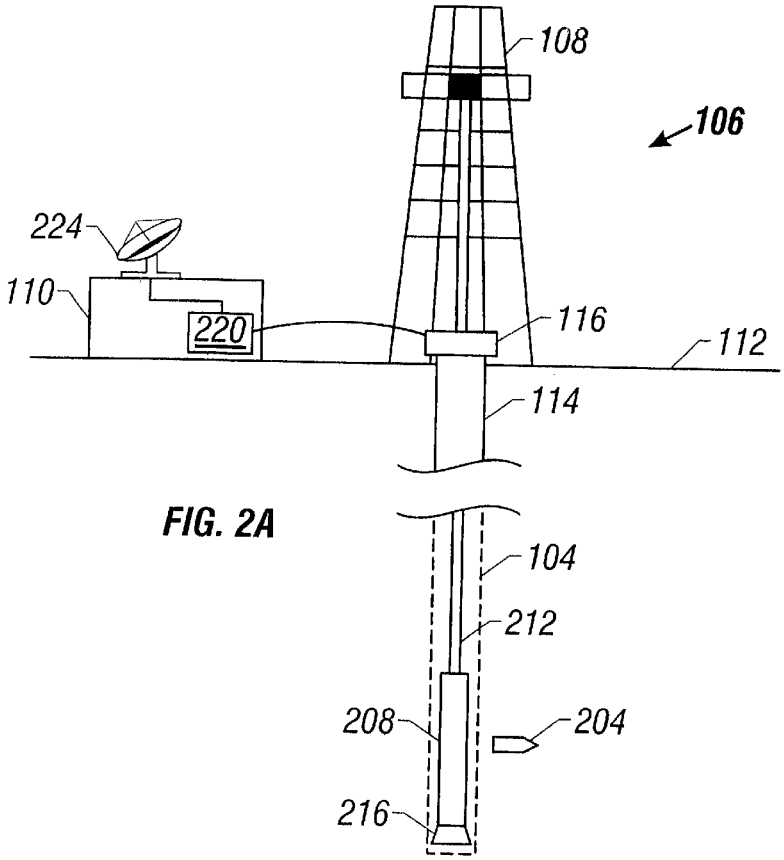
FIG. 2A is a diagrammatic sectional side view of a drilling rig, a well-bore made in the earth by the drilling rig, a remote sensing unit that has been deployed from a tool in the wellbore into a subsurface formation, and a drill string that includes a measurement while drilling tool having a downhole communication unit that retrieves subsurface formation data collected by the remote sensing unit.

FIG. 2A is a diagrammatic sectional side view of a drilling rig 106, a well-bore 104 made in the earth 112 by the drilling rig 106, a remote sensing unit 204 that has been deployed from a tool in the well-bore 104 into a subsurface formation, and a drill string that includes a measurement while drilling (MWD) tool 208 that operates in conjunction with the remote sensing unit 204 to retrieve data collected by the remote sensing unit 204. Those elements illustrated in FIG. 2A that have numbering consistent with FIG. 1 are the same elements and will not be described further with reference to FIG. 2A (or subsequent Figures).

The MWD tool 208 forms a portion of the drill string that also includes drill pipe 212. MWD tools 208 are generally known in the art to collect data during drilling operations. The MWD tool 208 shown forms a portion of a drill collar that resides adjacent the drill bit 216. As is known, the drill bit erodes the formation to form the well-bore 104. Drilling mud circulates down through the center of the drill string, exits the drill string through nozzles or openings in the bit, and returns up through the annulus along the sides of the drill string to remove the eroded formation pieces.

In one embodiment, the MWD tool 208 is used to deploy the remote sensing unit 204 into the subsurface formation. For this embodiment, the MWD tool 208 includes both a deployment structure and a downhole communication unit. The down-hole communication unit communicates with the remote sensing unit 204 and provides power to the remote sensing unit 204 during such communications, in a manner discussed further below. The MWD tool 208 also includes an uphole interface 220 that communicates with the downhole communication unit. The uphole interface 220, in the described embodiment, is coupled to a satellite dish 224 that enables communication between the MWD tool 208 and a remote site. In other embodiments, the MWD tool 208 communicates with a remote site via a radio interface, a telephone interface, a cellular telephone interface or a combination of these so that data captured by the MWD tool 208 will be available at a remote location.

As will be further described herein, the remote sensing units may be constructed to be solely battery powered, or may be constructed to be remotely powered from a downhole communication unit in the well-bore, or to have a combination of both (as in the described embodiments). Because no physical connection exists between the remote sensing unit 204 and the MWD tool 208, however, an electromagnetic (e.g., Radio Frequency "RF") link is established between the MWD tool 208 and the remote sensing unit 204 for the purpose of communicating with the remote sensing unit. In some embodiments, an electromagnetic link also is established to provide power to the remote sensing unit. In a typical operation, the coupling of an electromagnetic signal having a frequency of between 1 and 10 Megahertz will most efficiently allow the MWD tool 208 (or another downhole communication unit) to communicate with, and to provide power to the remote sensing unit 204.

With the remote sensing unit 204 located in a subsurface formation adjacent the well-bore 104, the MWD tool 208 is located in close proximity to the remote sensing unit 204. Then, power-up and/or communication operations are begun. When the remote sensing unit 204 is not battery powered or the battery is at least partially depleted, power from the MWD tool 208 that is electromagnetically coupled to the remote sensing unit 204 is used to power up the remote sensing unit 204. More specifically, the remote sensing unit 204 receives the power, charges a capacitor that will serve as its power source and commences power-up operations. Once the remote sensing unit 204 has received a specified or sufficient amount of power, it performs self-calibration operations and then makes formation measurements. These formation measurements are recorded and then communicated back to the MWD tool 208 via the electromagnetic coupling.

Figure 2B:
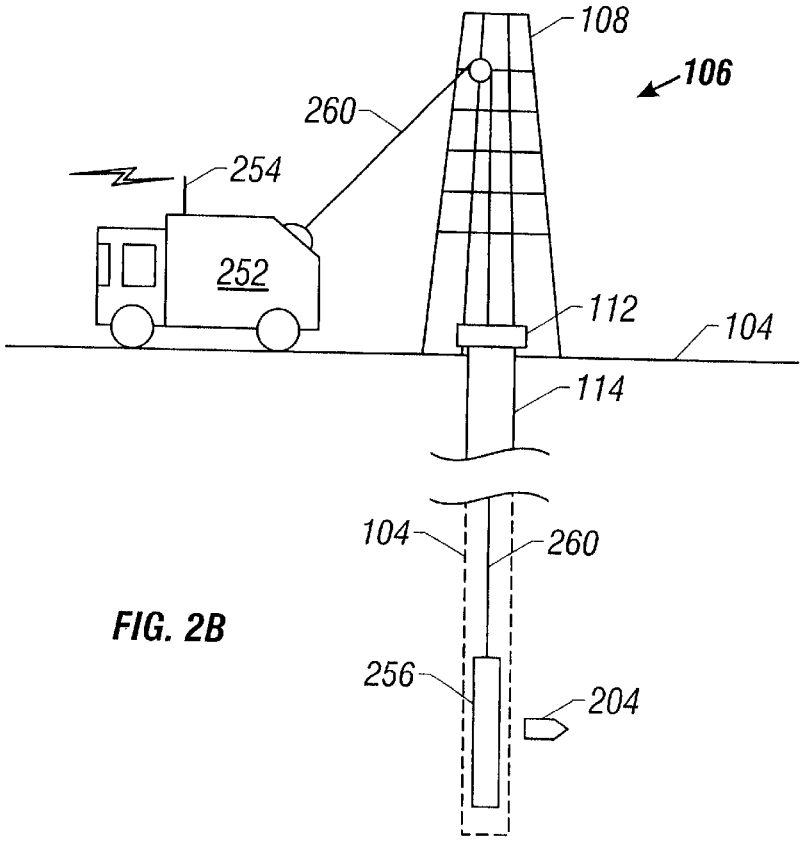
FIG. 2B is a diagrammatic sectional side view of a drilling rig, a well-bore made in the earth by the drilling rig, a remote sensing unit that has been deployed from a tool in the wellbore into a subsurface formation, and a wireline truck and open-hole wireline tool that includes a downhole communication unit that retrieves subsurface formation data collected by the remote sensing unit.

FIG. 2B is a diagrammatic sectional side view of a drilling rig 106 including a drilling rig superstructure 108, a well-bore 104 made in the earth 112 by the drilling rig 106, a remote sensing unit 204 that has been deployed from a tool in the well-bore 104 into a subsurface formation, and a wireline truck 252 and open-hole wireline tool 256 that operate in conjunction with the remote sensing unit 204 to retrieve data collected by the remote sensing unit 204.

As is generally known, open-hole wireline operations are performed during the drilling of wells to collect information regarding formations penetrated by well-bore 104. In such wireline operations, a wireline truck 252 couples to a wireline tool 256 via an armored cable 260 that includes a conduit for conducting communication signals and power signals. Armored cable 260 serves both to physically couple the wireline tool 256 to the wireline truck 252 and to allow electronics contained within the wireline truck 252 to communicate with the wireline tool 256.

Measurements taken during wireline operations include formation resistivity (or conductivity) logs, natural radiation logs, electrical potential logs, density logs (gamma ray and neutron), micro-resistivity logs, electromagnetic propagation logs, diameter logs, formation tests, formation sampling and other measurements. The data collected in these wireline operations may be coupled to a remote location via an antenna 254 that employs RF communications (e.g., two-way radio, cellular communications, etc.).

According to the present invention, the remote sensing unit 204 may be deployed from the wireline tool 256. Further, after deployment, data may be retrieved from the remote sensing unit 204 via the wireline tool 256. In such embodiments, the wireline tool 256 is constructed so that it couples electromagnetically with the remote sensing unit 204. In such case, the wireline tool 256 is lowered into the well-bore 104 until it is proximate to the remote sensing unit 204. The remote sensing unit 204 will typically have a radioactive signature that allows the wireline tool 256 to sense its location in the well-bore 104.

With remote sensing unit 204 located within well-bore 104, wireline tool 256 is placed adjacent remote sensing unit 204. Then, power-up and/or communication operations proceed. When remote sensing unit 204 is not battery powered or the battery is at least partially depleted, power from wireline tool 256 is electromagnetically transmitted to remote sensing unit 204. Remote sensing unit 204 receives the power, charges a capacitor that will serve as its power source and commences power-up operations. When remote sensing unit 204 has been powered, it performs self-calibration operations and then makes subsurface formation measurements.

The subsurface formation measurements are stored and then transmitted to wireline tool 256. Wireline tool 256 transmits this data back to wireline truck 252 via armored cable 260. The data may be stored for future use or it may be immediately transmitted to a remote location for use.

Figure 3A:
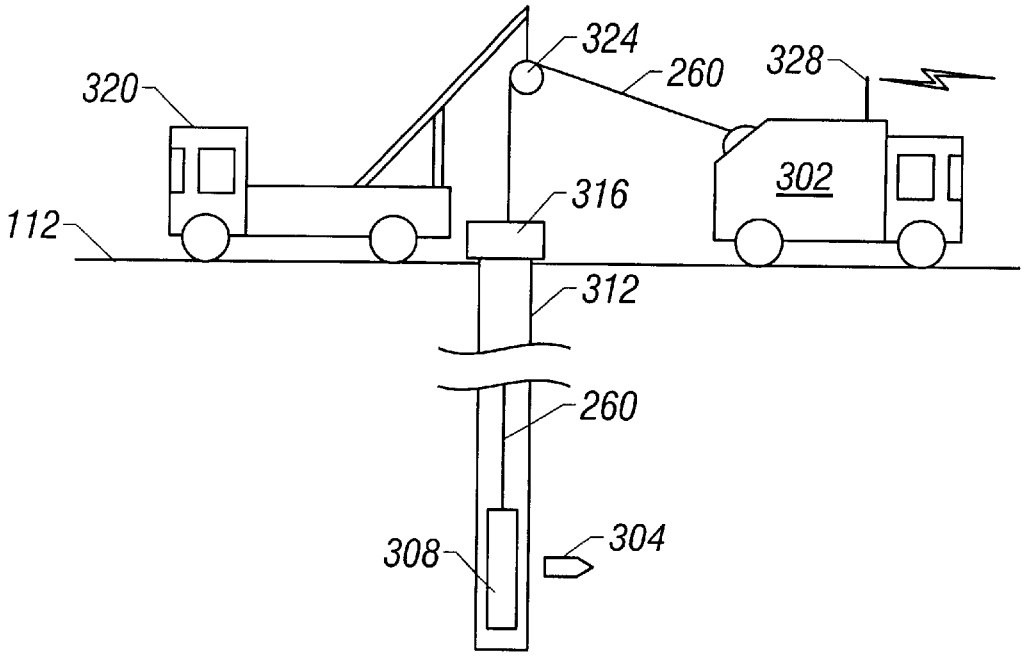
FIG. 3A is a diagrammatic sectional side view of a well-bore made in the earth that has been cased, a remote sensing unit that has been deployed from a tool in the wellbore into a subsurface formation and a wireline truck and cased hole wireline tool that includes a downhole communication unit that retrieves subsurface formation data collected by the remote sensing unit.
Figure 3B:
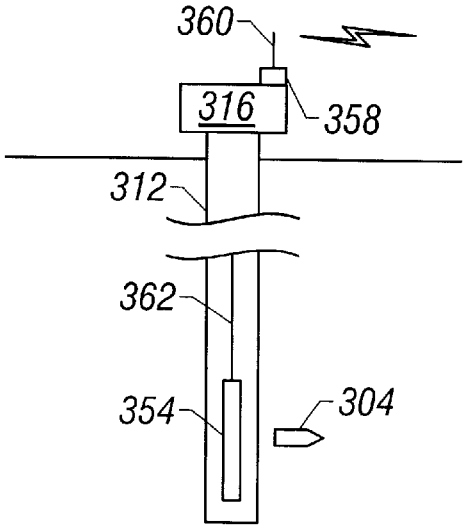
FIG. 3B is a diagrammatic sectional side view of a well-bore made in the earth that has been cased, a remote sensing unit that has been deployed from a tool in the wellbore into a subsurface formation and a retractable downhole communication unit and well control unit that operate in conjunction with the remote sensing unit to retrieve data collected by the remote sensing unit.
Figure 3C:
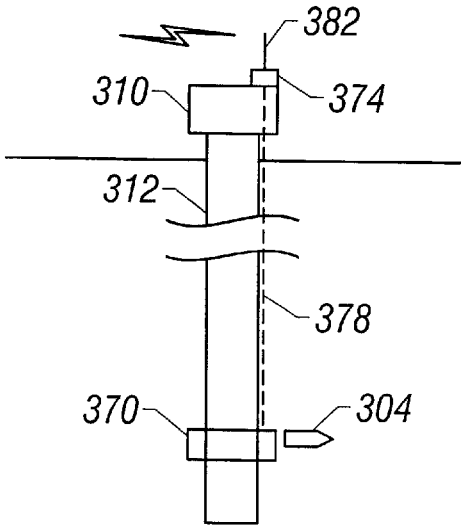
FIG. 3C is a diagrammatic sectional side view of a well-bore made in the earth that has been cased, a remote sensing unit that has been deployed from a tool in the wellbore into a subsurface formation and a permanently affixed downhole communication unit and well control unit that operate in conjunction with the remote sensing unit to retrieve data collected by the remote sensing unit.

FIGS. 3A, 3B and 3C illustrate three different techniques for retrieving data from remote sensing units after the well-bore has been cased. The casing is formed of conductive metal, which effectively blocks electromagnetic radiation. Because communications with the remote sensing unit are accomplished using electromagnetic radiation, modifications to casing must be made so that the electromagnetic radiation may be transmitted from within the casing to the region approximate the remote sensing unit outside of the casing. Alternately, an external communication device may be placed between the casing and the well-bore that communicates with the remote sensing unit. In such case, the device must be placed into its location when the casing is set.

FIG. 3A is a diagrammatic sectional side view of a well-bore made in the earth that has been cased, a wireline truck 302 for operating wireline tools, a remote sensing unit 304 that has been deployed from a tool in the well-bore into a subsurface formation and a cased hole wireline tool 308. Wireline truck 302 and wireline tool 308 operate in conjunction with remote sensing unit 304 to retrieve data collected by remote sensing unit 304.

Once the well has been fully drilled, casing 312 is set in place and cemented to the formation. A production stack 316 is attached to the top of casing 312, the well is perforated in at least one producing zone and production commences. The production of the well is monitored (as are other wells in the reservoir) to manage depletion of the reservoir.

During drilling of the well, or during subsequent open-hole wireline operations, the remote sensing unit 304 is deployed into a subsurface formation that becomes a producing zone. Thus, the properties of this formation are of interest throughout the life of the well and also throughout the life of the reservoir. By monitoring the properties of the producing zone at the location of the well and the properties of the producing zone in other wells within the field, production may be managed so that the reservoir is more efficiently depleted.

As illustrated in FIG. 3A, wireline operations are employed to retrieve data from the remote sensing unit 304 during the production of the well. In such case, the wireline truck 302 couples to the wireline tool 308 via an armored cable 260. A crane truck 320 is required to support a sheave wheel 324 for the armored cable 260. The wireline tool 308 is lowered into the casing 312 through a production stack that seals in the pressure of the well. The wireline tool 308 is then lowered into the casing 312 until it resides proximate to the remote sensing unit 304.

According to one aspect of the present invention, when the casing 312 is set, special casing sections are set adjacent the remote sensing unit 304. As will be described further with reference to FIGS. 29, 30 and 31, one embodiment of this special casing includes windows formed of a material that passes electromagnetic radiation. In another embodiment of this special casing, the casing is fully formed of a material that passes electromagnetic radiation. In either case, the material may be a fiberglass, a ceramic, an epoxy, or another type of material that has sufficient strength and durability to form a portion of the casing 312 but that will permit the passage of electromagnetic radiation.

Referring back to FIG. 3A, with the wireline tool 308 in place near remote sensing unit 304, powering and/or communication operations commence to allow formation properties to be measured and recorded. This information is collected by equipment within wireline truck 302 and may be relayed to a remote location via the antenna 328.

FIG. 3B is a diagrammatic sectional side view of a well-bore made in the earth that has been cased, a remote sensing unit 304 that has been deployed from a tool in the well-bore into a subsurface formation and a downhole communication unit 354 and well control unit 358 that operate in conjunction with remote sensing unit 304 to retrieve data collected by remote sensing unit 304. The well control unit 358 may also control the production levels from the subsurface formation. In this operation, a special casing is employed that allows downhole communication unit 354 to communicate with remote sensing unit 304.

As compared to the wireline operations, however, downhole communication unit 354 remains downhole within the casing 312 for a long period of time (e.g., time between maintenance operations or while the data being collected is of value in reservoir management). Communication coupling and physical coupling to downhole communication unit 354 is performed via an armored cable 362. The well control unit 358 communicatively couples to the downhole communication unit 354 to collect and store data. This data may then be relayed to a remote location via antenna 360 over a supported wireless link.

FIG. 3C is a diagrammatic sectional side view of a well-bore made in the earth that has been cased, a remote sensing unit 304 that has been deployed from a tool in the well-bore into a subsurface formation and a permanently affixed downhole communication unit 370 and well control unit 374 that operate in conjunction with the remote sensing unit 304 to retrieve data collected by the remote sensing unit 304. As compared to the installations of FIGS. 3A and 3B, however, the downhole communication unit 370 is mounted external to the casing 312. Thus, the casing may be of standard construction, e.g., metal, since it is not required to pass electromagnetic radiation. The downhole communication unit 370 couples to a well control unit 374 via a wellbore communication link 378, described further below. The well control unit 374 collects the data and may relay the data to a remote location via antenna 382 and a supported wireless link. Additionally, communication link 378 is, in the described embodiment, formed to be able to conduct high power signals for transmitting high power electromagnetic signals to the remote sensing unit 304.

Figure 4:
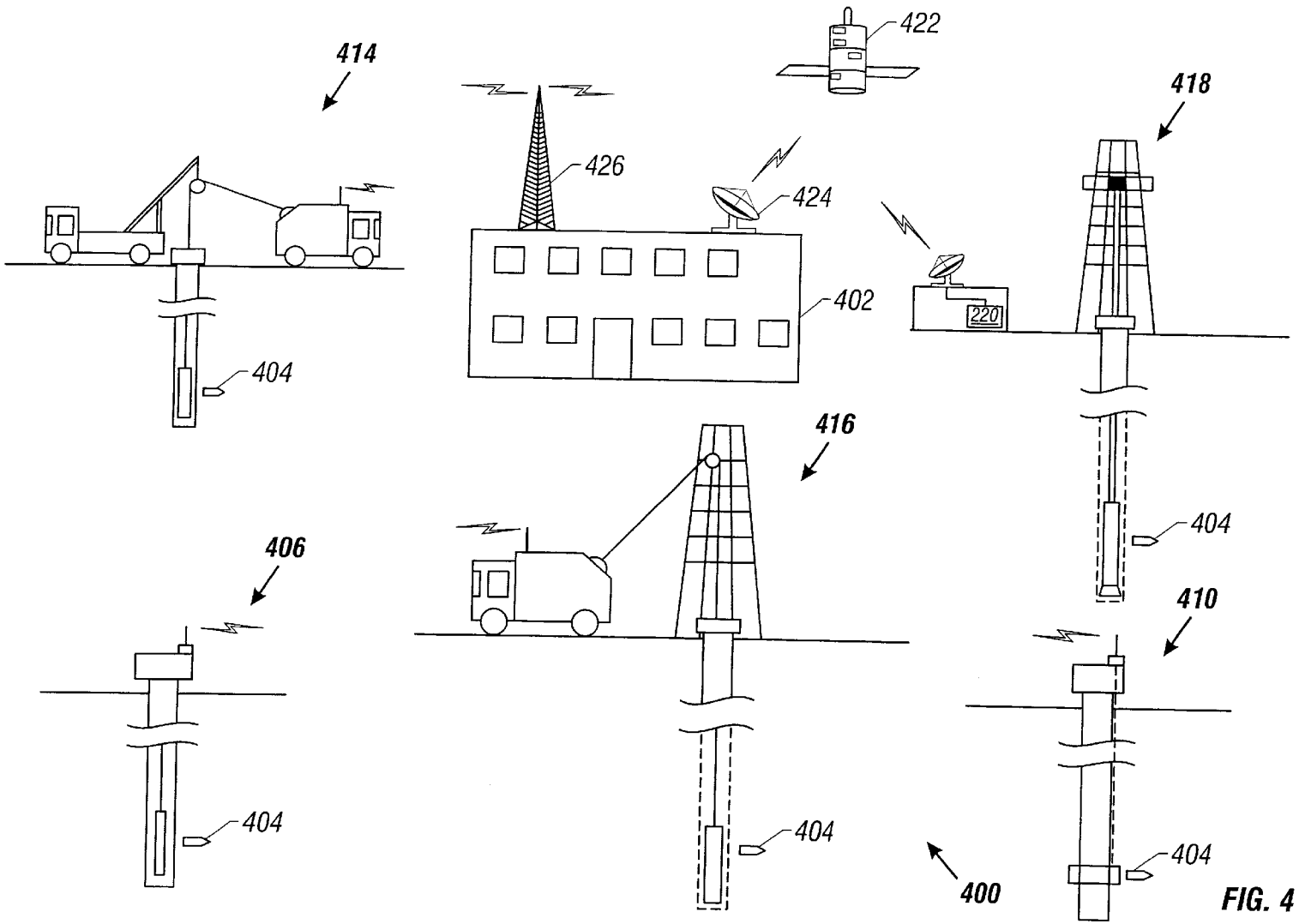
FIG. 4 is a system diagram illustrating a plurality of installations according to the present invention and a data center used to receive and process data collected by remote sensing units deployed at the plurality of installations, the system used to manage the development and depletion of downhole formations that form a reservoir.

FIG. 4 is a system diagram illustrating a plurality of installations deployed according to the present invention and a data (central control) center 402 used to receive and process data collected by remote sensing units 304 deployed at the plurality of installations, the system used to manage the development and depletion of downhole formations (reservoirs). The installations may be installed and monitored using the various techniques previously described, or others in which a remote sensing unit is placed in a subsurface formation and at least periodically interrogated to receive formation measurements.

For example, installations 406, 410 and 414 are shown to reside in producing wells. In such installations 406, 410 and 414, data is at least periodically measured and collected for use at the central control center 402. In contrast, installations 416 and 418 are shown to be at newly drilled wells that have not yet been cased.

In the management of a large reservoir, literally hundreds of installations may be used to is monitor formation properties across the reservoir. Thus, while some wells are within a range that allows the use of ordinary RF equipment for uploading remote sensing unit 404 data, other wells are a great distance away. Satellite based installation 418 illustrates such a well where a satellite dish is required to upload data from remote sensing unit 404 to satellite 422. Additionally, central control center 402 also includes a satellite dish 424 for downloading remote sensing unit 402 data from satellite 422.

Data that is collected from the installations 406-418 may be relayed to the central control center 402 via wireless links, via wired links and via physical delivery of the data. To support wireless links, the central control center 402 includes an RF tower 426, as well as the satellite dish 424, for communicating with the installations. RF tower 426 may employ antennas for any known communication network for transceiving data and control commands including any of the cellular communication systems (AMPS, TDMA, CDMA, etc.) or RF communications.

Central control center 402 includes circuitry for transceiving data and control commands to and from the installations 406–418. Additionally, central control center 402 also includes processing equipment for storing and analyzing the subsurface formation property measurements collected at the installations by the remote sensing units 404. This data may be used as input to computer programs that model the reservoir. Other inputs to the computer programs may include seismic data, well logs (from wireline operations), and production data, among other inputs. With the additional data input, the computer programs may more accurately model the reservoir.

Accurate computer modeling of the reservoir, that is made possible by accurate and real time remote sensing unit 404 data in conjunction with a reservoir management system as described herein, allow field operators to manage the reservoir more effectively so that it may be depleted efficiently thereby providing a better return on investment. For example, by using the more accurate computer models to manage production levels of existing wells, to determine the placement of new wells, to control water flooding and other production events, the reservoir may be more fully depleted of its valuable oil and gas.

Figure 5:
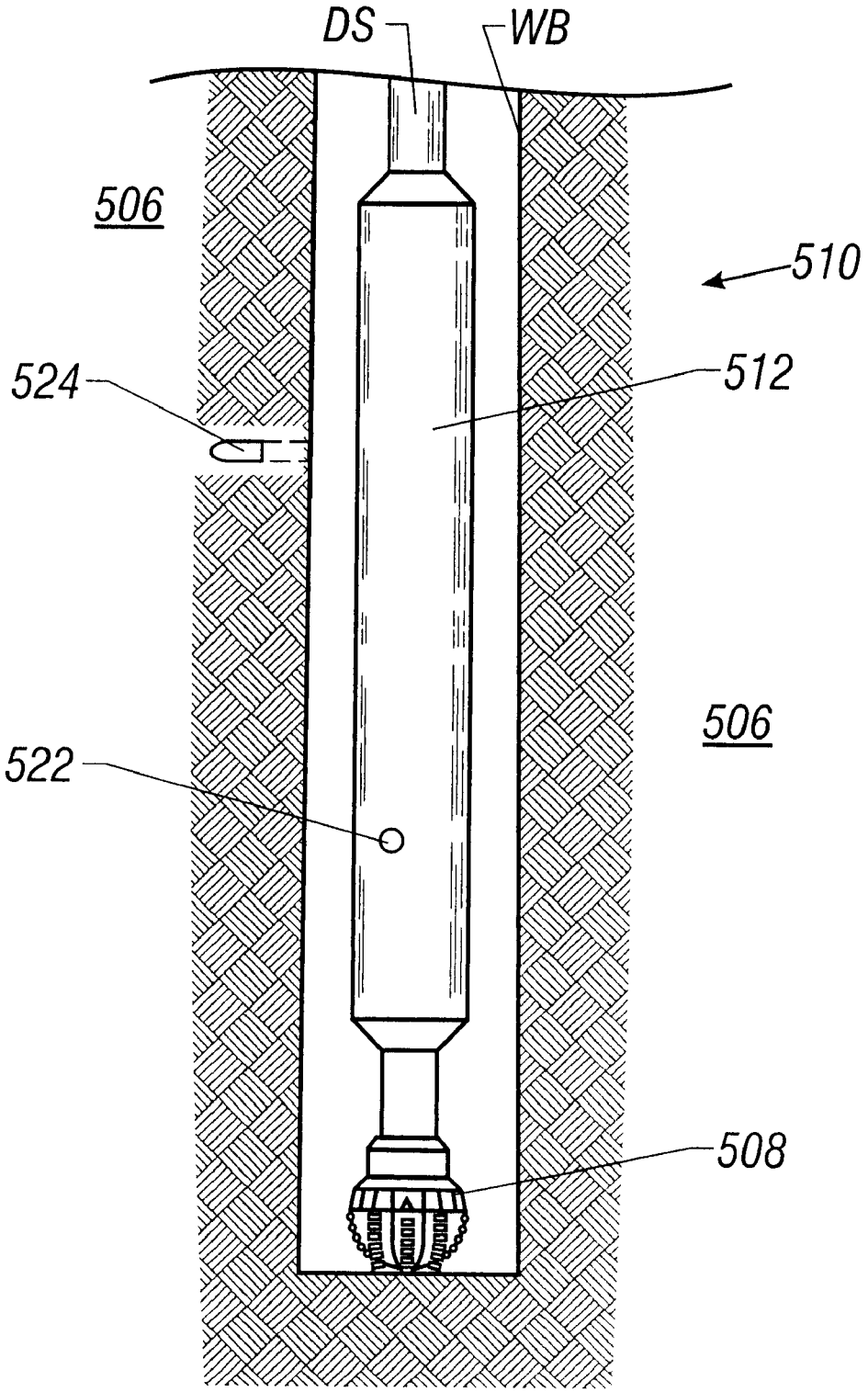
FIG. 5 is a diagram of a drill collar positioned in a borehole and equipped with a downhole communication unit in accordance with the present invention.
Figure 6:
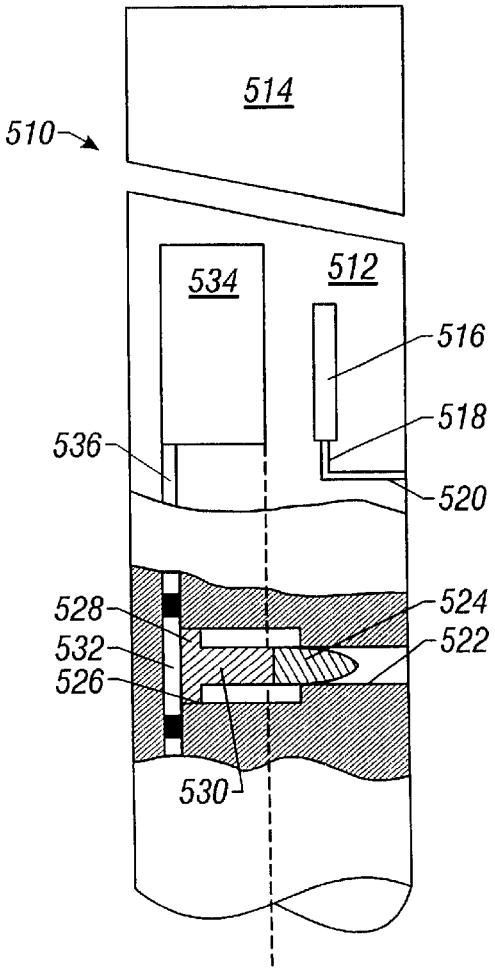
FIG. 6 is schematic illustration of the downhole communication unit of a drill collar that also has a hydraulically energized system for forcibly inserting a remote sensing unit from the borehole into a selected subsurface formation.
Figure 7:
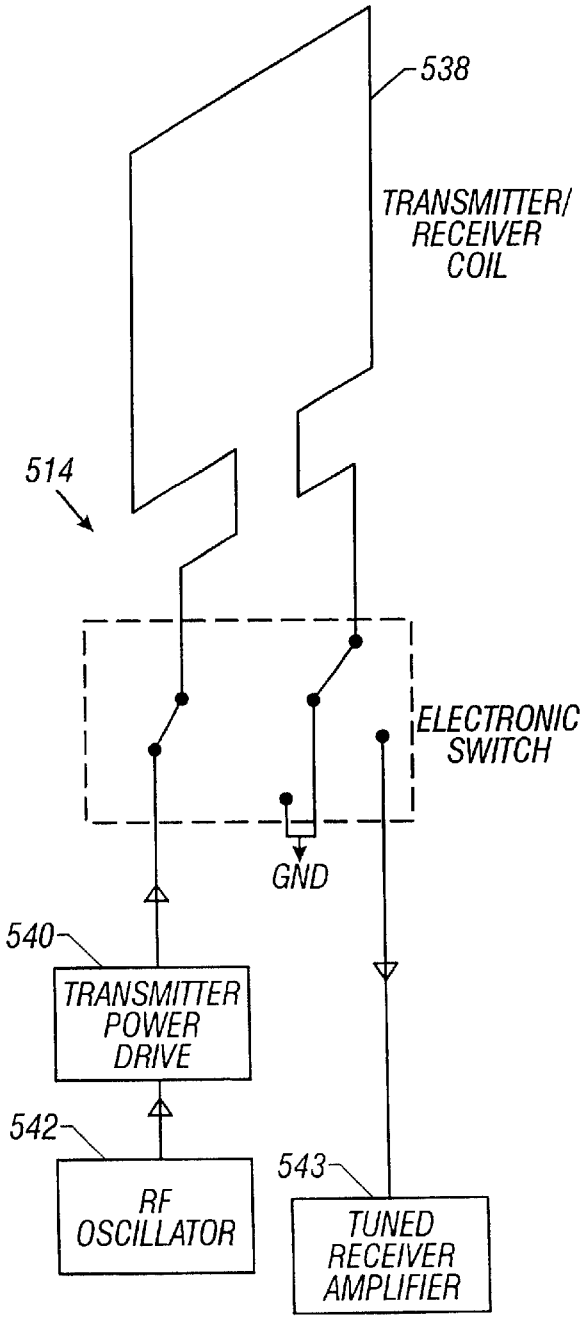
FIG. 7 is a diagram schematically representing a drill collar having a downhole communication unit therein for receiving formation data signals from a remote sensing unit.

Referring now to FIGS. 5–7, a drill collar being a component of a drill string for drilling a well bore is shown generally at 510 and represents one aspect of the invention. The drill collar is provided with an instrumentation section 512 having a power cartridge 514 incorporating the transmitter/receiver circuitry of FIG. 7. The drill collar 510 is also provided with a pressure gauge 516 having its pressure remote sensing unit 518 exposed to borehole pressure via a drill collar passage 520. The pressure gauge 516 senses ambient pressure at a depth of a selected subsurface formation and is used to verify pressure calibration of remote sensing units. Electronic signals representing ambient well bore pressure are transmitted via the pressure gauge 516 to the circuitry of the power cartridge 514 which, in turn, accomplishes pressure calibration of the remote sensing unit being deployed at that particular well bore depth. The drill collar 510 is also provided with one or more remote sensing unit receptacles 522 each containing a remote sensing unit 524 for positioning within a selected subsurface formation which is intercepted by the well bore being drilled.

The remote sensing units 524 are encapsulated "intelligent" remote sensing units which are moved from the drill collar to a position in the formation surrounding the borehole for sensing formation parameters such as pressure, temperature, rock permeability, porosity, conductivity and dielectric constant, among others. The remote sensing units 524 are appropriately encapsulated in a remote sensing unit housing of sufficient structural integrity to withstand damage during movement from the drill collar into laterally embedded relation with the subsurface formation surrounding the well bore. By way of example, the remote sensing units are partially formed of a tungsten-nickel-iron alloy with a zirconium end plate. The zirconium end plate specifically is formed of a non-metallic material so that electromagnetic signals may be transmitted through it. Patent application Ser. No. 09/293,859 filed on Apr. 16, 1999 fully describes the mechanical aspects of the remote sensing units 524 and is included by reference herein for all purposes.

Those skilled in the art will appreciate that such lateral imbedding movement need not be perpendicular to the borehole, but may be accomplished through numerous angles of attack into the desired formation position. Remote sensing unit deployment can be achieved by utilizing one or a combination of the following: (1) drilling into the borehole wall and placing the remote sensing unit into the formation; (2) punching/pressing the encapsulated remote sensing unit into the formation with a hydraulic press or mechanical penetration assembly; or (3) shooting the encapsulated remote sensing units into the formation by utilizing propellant charges.

As shown in FIG. 6, a hydraulically energized ram 530 is employed to deploy the remote sensing unit 524 and to cause its penetration into the subsurface formation to a sufficient position outwardly from the borehole that it senses selected parameters of the formation. For remote sensing unit 524 deployment, the drill collar is provided with an internal cylindrical bore 526 within which is positioned a piston element 528 having a ram 530 that is disposed in driving relation with the encapsulated remote intelligent remote sensing unit 524. The piston 528 is exposed to hydraulic pressure that is communicated to piston chamber 532 from a hydraulic system 534 via a hydraulic supply passage 536. The hydraulic system is selectively activated by the power cartridge 514 so that the remote sensing unit can be calibrated with respect to ambient borehole pressure at formation depth, as described above, and can then be moved from the receptacle 522 into the formation beyond the borehole wall so that the formation pressure parameters will be free from borehole effects.

Referring now to FIG. 7, the power cartridge 514 of the drill collar 510 incorporates at least one transmitter/receiver coil 538 having a transmitter power drive 540 in a form of a power amplifier having its frequency F determined by oscillator 542. The drill collar instrumentation section is also provided with a tuned receiver amplifier 543 that is set to receive signals at a frequency 2F which will be transmitted to the instrumentation section of the drill collar by the remote sensing unit 524 as will be explained herein below.

Figure 8:
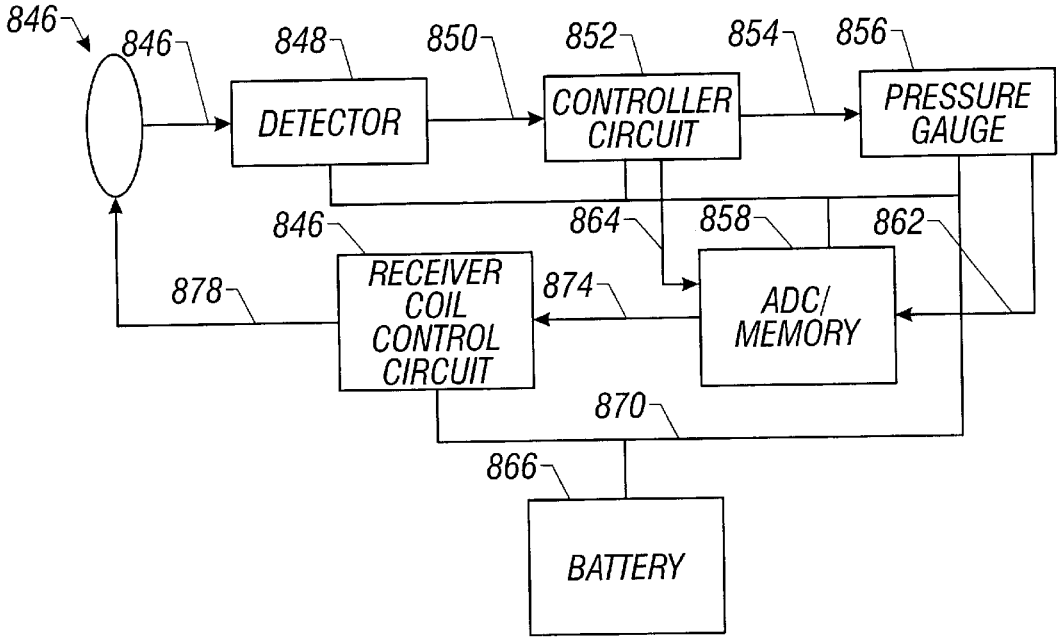
FIG. 8 is an electronic block diagram schematically showing a remote sensing unit which is positioned within a selected subsurface formation from the well bore being drilled and which senses one or more formation data parameters such as pressure, temperature and rock permeability, places the data in memory, and, as instructed, transmits the stored data to a downhole communication unit.

With reference to FIG. 8, the electronic circuitry of the remote sensing unit 524 is shown by block diagram generally at 844 and includes at least one transmitter/receiver coil 846, or RF antenna, with the receiver thereof providing an output 850 from a detector 848 to a controller circuit 852. The controller circuit is provided with one of its controlling outputs 854 being fed to a pressure gauge 856 so that gauge output signals will be conducted to an analog-to-digital converter ("ADC")/memory 858, which receives signals from the pressure gauge via a conductor 862 and also receives controls signals from the controller circuit 852 via a conductor 864.

A battery 866 also is provided within the remote sensing unit circuitry 844 and is coupled with the various circuitry components of the remote sensing unit by power conductors 868, 870 and 872. While the described embodiment of FIG. 8 illustrates only a battery as a power supply, other embodiments of the invention include circuitry for receiving and converting RF power to DC power to charge a charge storage device such as a capacitor. A memory output 874 of the ADC/memory circuit 858 is fed to a receiver coil control circuit 876. The receiver coil control circuit 876 functions as a driver circuit via conductor 878 for the transmitter/receiver coil 846 to transmit data to instrumentation section 512 of drill collar 510.

Figure 9:
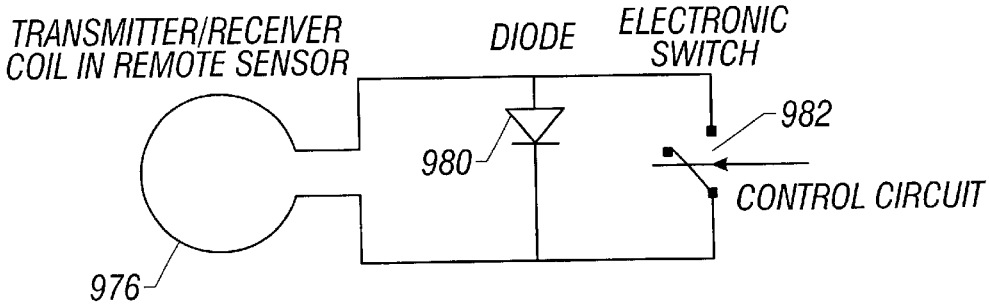
FIG. 9 is an electronic block diagram schematically illustrating the receiver coil circuit of a remote sensing unit.

Referring now to FIG. 9, a low threshold diode 980 is connected across the Rx coil control circuit 976. Under normal conditions, and especially in the dormant or "sleep" mode, the electronic switch 982 is open, minimizing power consumption. When the receiver coil control circuit 976 is activated by the drill collar's transmitted electromagnetic field, a voltage and a current is induced in the receiver coil control circuit. At this point, however, the diode 980 will allow the current the flow only in one direction. This non-linearity changes the fundamental frequency F of the induced current shown at 1084 in FIG. 10 into a current having the fundamental frequency 2F, i.e., twice the frequency of the electromagnetic wave 1084 as shown at 1086.

Throughout the complete transmission sequence, the transmitter/receiver coil 538, shown in FIG. 7, is also used as a receiver and is connected to a receiver amplifier 543 which is tuned at the 2F frequency. When the amplitude of the received signal is at a maximum, the remote sensing unit 524 is located in close proximity for optimum transmission between drill collar and remote sensing unit.

Figure 10:
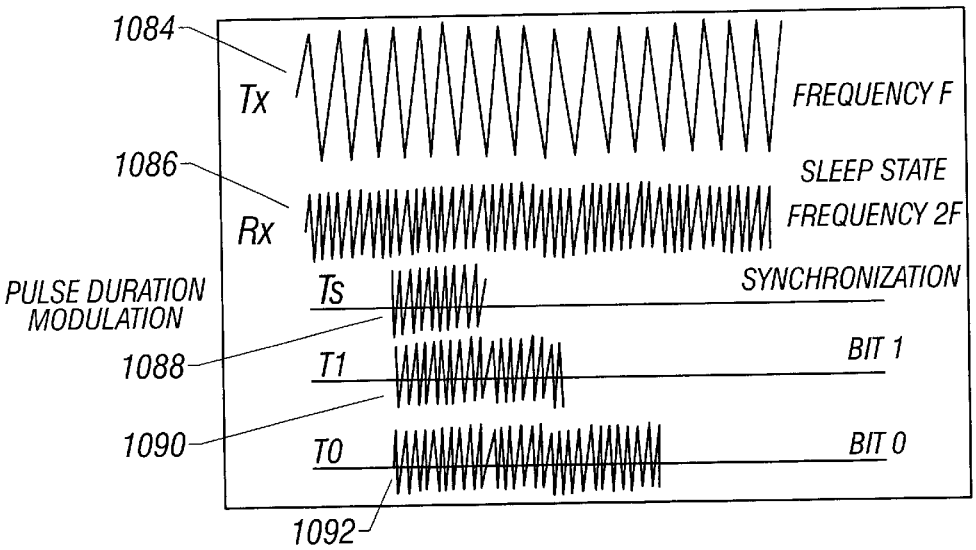
FIG. 10 is a transmission timing diagram showing pulse duration modulation used in communications between a downhole communication unit and a remote sensing unit.

Assuming that the remote sensing unit 524 is in place inside the formation to be monitored, the sequence in which the transmission and the acquisition electronics function in conjunction with drilling operations is as follows:

The drill collar with its acquisition sensors is positioned in close proximity of the remote sensing unit 524. An electromagnetic wave having a frequency F, as shown at 1084 in FIG. 10, is transmitted from the drill collar transmitter/receiver coil 538 to "switch on" the remote sensing unit, also referred to as the target, and to induce the remote sensing unit to send back an identifying coded signal. The electromagnetic wave initiates the remote sensing unit's electronics to go into the acquisition and transmission mode, and pressure data and other data representing selected formation parameters, as well as the remote sensing unit's identification codes, are obtained at the remote sensing unit's level. The presence of the target, i.e., the remote sensing unit, is detected by the reflected wave scattered back from the target at a frequency of 2F as shown at 1086 in the transmission timing diagram of FIG. 10. At the same time, pressure gauge data (pressure and temperature) and other selected formation parameters are acquired and the electronics of the remote sensing unit converts the data into one or more serial digital signals. This digital signal or signals, as the case may be, is transmitted from the remote sensing unit back to the drill collar via the transmitter/receiver coil 846. This is achieved by synchronizing and coding each individual bid of data into a specific time sequence during which the scattered frequency will be switched between F and 2F. Data acquisition and transmission is terminated after stable pressure and temperature readings have been obtained and successfully transmitted to the on-board circuitry of the drill collar 510.

Whenever the sequence above is initiated, the transmitter/receiver coil 538 located within the instrumentation section of the drill collar is powered by the transmitter power drive or amplifier 540. And electromagnetic wave is transmitted from the drill collar at a frequency F determined by the oscillator 542, as indicated in the timing diagram of FIG. 10 at 1084. The frequency F can be selected within the range 100 kHz up to 500 MHz. As soon as the target comes within the zone of influence of the collar transmitter, the receiver coil 846 located within the remote sensing unit will radiate back an electromagnetic wave at twice the original frequency by means of the receiver coil control circuit 876 and the transmitter/receiver coil 846.

In contrast to present-day operations, the present invention makes pressure data and other formation parameters available while drilling, and, as such, allows well drilling personnel to make decisions concerning drilling mud weight and composition as well as other parameters at a much earlier time in the drilling process without necessitating the tripping of the drill string for the purpose of running a formation tester instrument. The present invention requires very little time to gather the formation data measurements. Once a remote sensing unit 524 is deployed, data can be obtained while drilling, a feature that is not possible according to known well drilling techniques.

Time dependent pressure monitoring of penetrated well bore formations can also be achieved as long as pressured data from the pressure sensor 518 is available. This feature is dependent of course on the communication link between the transmitter/receiver circuitry within the power cartridge of the drill collar and any deployed intelligent remote sensing units 524.

The remote sensing unit output can also be read with wireline logging tools during standard logging operations. This feature of the invention permits varying data conditions of the subsurface formation to be acquired by the electronics of logging tools in addition to the real time formation data that is now obtainable while drilling.

By positioning be intelligent remote sensing units 524 beyond the immediate borehole environment, at least in the initial data acquisition period there will be very little borehole effects on the noticeable pressure measurements that are taken. As extremely small liquid movement is necessary to obtain formation pressures with in-situ sensors, it will be possible to measure formation pressure in fluid bearing non-permeable formations. Those skilled in the art will appreciate that the present invention is equally adaptable for measurements of several formation parameters, such as permeability, conductivity, dielectric constant, rocks strength, and others, and is not limited to formation pressured measurement.

As indicated previously, deployment of a desired number of such remote sensing units 524 occurs at various well-bore depths as determined by the desired level of formation data. As long as the well-bore remains open, or uncased, the deployed remote sensing units may communicate directly with the drill collar, sonde, or wireline tool containing a data receiver, also described in the '466 application, to transmit data indicative of formation parameters to a memory module on the data receiver for temporary storage or directly to the surface via the data receiver.

At some point during the completion of the well, the well-bore is completely cased and, typically, the casing is cemented in place. From this point, normal communication with deployed remote sensing units 524 that lie in formation 506 beyond the well-bore is no longer possible. Thus, communication must be reestablished with the deployed remote sensing units through the casing wall and cement layer, if the latter is present, that line the well-bore.

Figure 11:
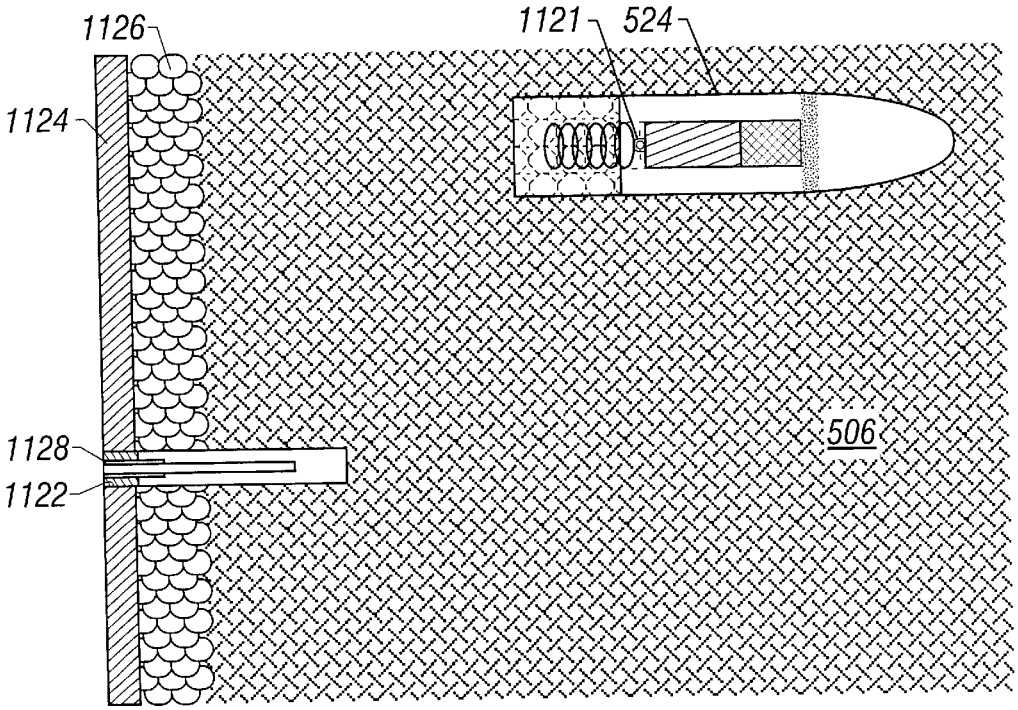
FIG. 11 is a sectional view of the subsurface formation after casing has been installed in the wellbore, with an antenna installed in an opening through the wall of the casing and cement layer in close proximity to the remote sensing unit.

With reference now to FIG. 11, communication is reestablished, in one embodiment of the described invention, by creating an opening 1122 in casing wall 1124 and cement layer 1126, and then installing and sealing antenna 1128 in opening 1122 in the casing wall. However, for optimum communication in this described embodiment, antenna 1128 should be positioned in a location near or proximate the deployed remote sensing unit 524. To enable effective electromagnetic communication, it is preferred that the antenna be positioned within 10–15 cm of the respective remote sensing unit 524 or sensors in the formation. Thus, the location of the remote sensing units 524 relative to the cased well-bore must be identified.

Identification of Remote Sensing Unit Location

To permit the location of the remote sensing units 524 to be identified, the remote sensing units 524 are equipped with a radiation source for transmitting respective identifying signature signals. More specifically, the remote sensing units 524 are equipped with a gamma-ray pip-tag 1121 for transmitting a pip-tag signature signal. The pip-tag is a small strip of paper-like material that is saturated with a radioactive solution and positioned within remote sensing unit 524, so as to radiate gamma rays.

The location of each remote sensing unit is then identified through a two-step process. First, the depth of the remote sensing unit is determined using a gamma-ray open hole log, which is created for the well-bore after the deployment of remote sensing units 524, and the known pip-tag signature signal of the remote sensing unit. The remote sensing unit will be identifiable on the open-hole log because the radioactive emission of pip-tag 1121 will cause the local ambient gamma-ray background to be increased in the region of the remote sensing unit. Thus, background gamma-rays will be distinctive on the log at the remote sensing unit location, compared to the formation zones above and below the remote sensing unit. This will help to identify the vertical depth and position of the remote sensing unit.

The azimuth of the remote sensing unit relative to the well-bore is determined using a gamma-ray detector and the remote sensing unit's pip-tag signature signal. The azimuth is determined using a collimated gamma-ray detector, as described further below in the context of a multi-functional wireline tool.

Figure 12:
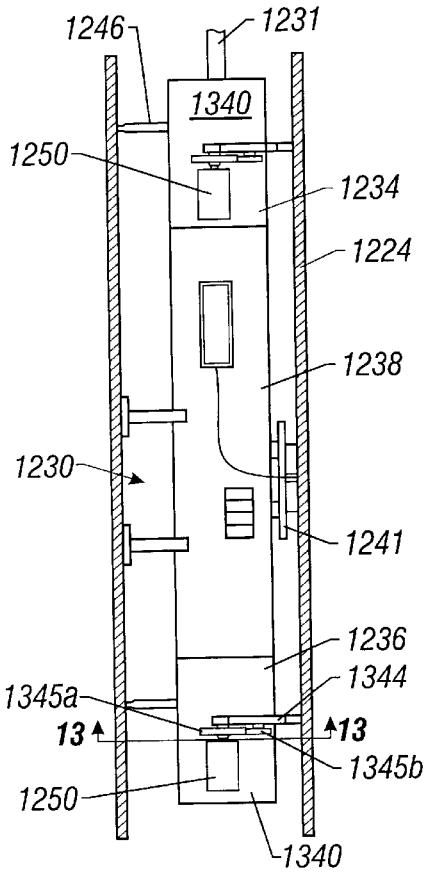
FIG. 12 is a schematic of a wireline tool positioned within the casing and having upper and lower rotation tools and an intermediate antenna installation tool.
Figure 13:
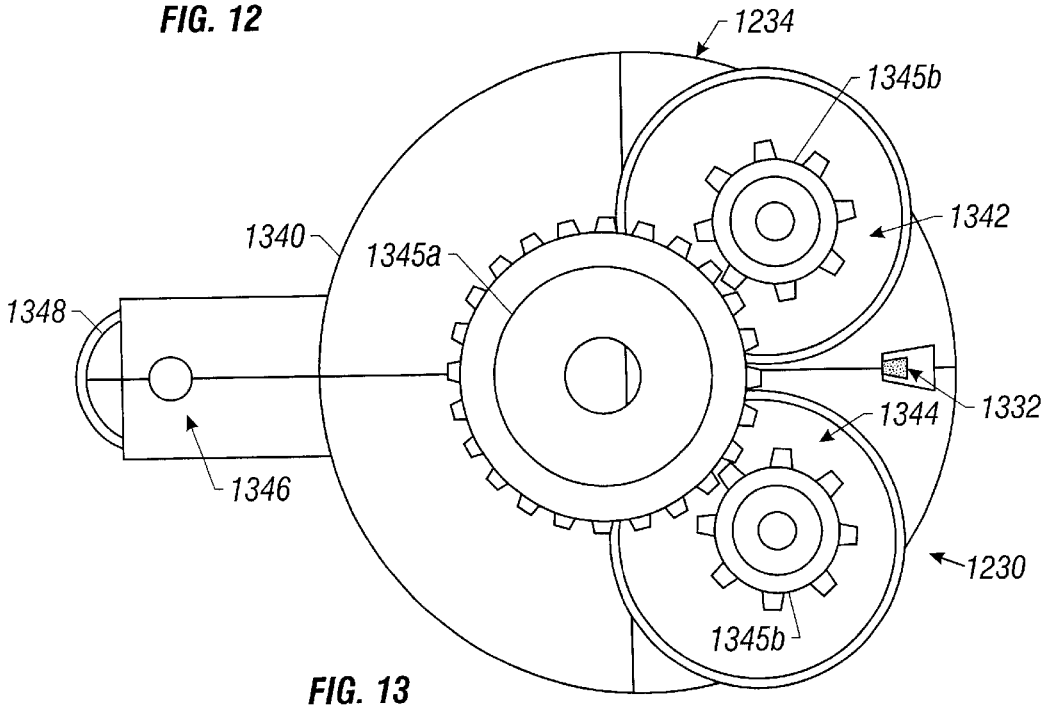
FIG. 13 is a schematic of the lower rotation tool taken along section line 1240 in FIG. 12.

Antenna 1128 is preferably installed and sealed in opening 1122 in the casing using a wireline tool. The wireline tool, generally referred to as 1230 in FIGS. 12 and 13, is a complex apparatus which performs a number of functions, and includes upper and lower rotation tools 1234 and 1236 and an intermediate antenna installation tool 1238. Those skilled in the art will appreciate that tool 1230 could equally be effective for at least some of its intended purposes as a drill string sub or tool, even though its description herein is limited to a wireline tool embodiment.

Wireline tool 1230 is lowered on a wireline or cable 1231, the length of which determines the depth of tool 1230 in the well-bore. Depth gauges may be used to measure displacement of the cable over a support mechanism, such as a sheave wheel, and thus indicate the depth of the wireline tool in a manner that is well known in the art. In this manner, wireline tool 1230 is positioned at the depth of remote sensing unit 524. The depth of wireline tool 1230 may also be measured by electrical, nuclear, or other sensors that correlate depth to previous measurements made in the well-bore or to the well casing length.

Cable 1231 also provides cable strands for communicating with control and processing equipment positioned at the surface via circuitry carried in the cable. In the described embodiment, the cable strands of cable 1231 comprise metallic wiring. Any known medium for conducting communication signals to underground equipment is specifically included herein.

The wireline tool further includes the upper and lower rotation tools 1234 and 1236 for rotating wireline tool 1230 to the identified azimuth, after having been lowered to the proper remote sensing unit depth as determined from the first step of the remote sensing unit location identification process. One embodiment of a simple rotation tool, as illustrated by lower rotation tool 1236 in FIGS. 12 and 13, includes cylindrical body 1340 with a set of two coplanar drive wheels 1342 and 1344 extending through one side of the body. The drive wheels are pressed against the casing by actuating hydraulic back-up piston 1346 in a conventional manner. Thus, extension of hydraulic piston 1346 causes pressing wheel 1348 to contact the inner casing wall. Because casing 1124 is cemented in well-bore WB, and thus fixed to formation 506, continued extension of piston 1346 after pressing wheel 1348 has contacted the inner casing wall forces drive wheels 1342 and 1344 against the inner casing wall opposite the pressing wheel.

The two drive wheels of each rotation tool are driven, respectively, via a gear train, such as gears 1345*a* and 1345*b*, by electric servo motor 1250. Primary gear 1345*a* is connected to the motor output shaft for rotation therewith. The rotating force is transmitted to drive wheels 1342, 1344 via secondary gears 1345*b*, and friction between the drive wheels and the inner casing wall induces wireline tool 1230 to rotate as drive wheels 1342 and 1344 "crawl" about the inner wall of casing 1224. This driving action is performed by both the upper and lower rotation tools 1234 and 1236 to enable rotation of the entire wireline tool assembly 1230 within casing 1124 about the longitudinal axis of the casing.

Antenna installation tool 1238 includes circuitry for identifying the azimuth of remote sensing unit 524 relative to well-bore WB in the form of collimated gamma-ray detector 1332, thereby providing for the second step of the remote sensing unit location identification process. As indicated previously, collimated gamma-ray detector 1332 is useful for detecting the radiation signature of anything placed in its zone of detection. The collimated gamma-ray detector, which is well known in the drilling industry, is equipped with shielding material positioned about a thallium-activated sodium iodide crystal except for a small open area at the detector window. The open area is accurate, and is narrowly defined for precise identification of the remote sensing unit azimuth.

Figure 14:
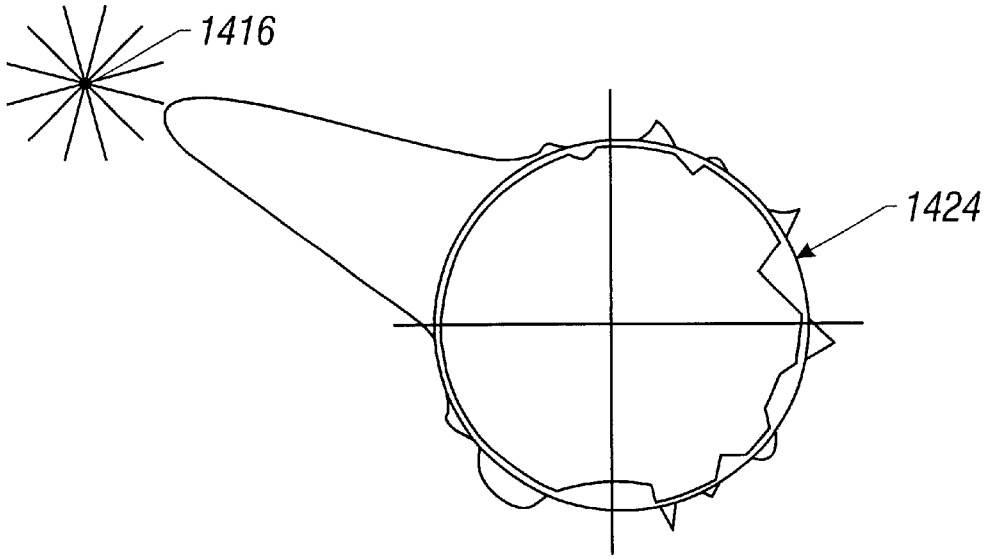
FIG. 14 is a lateral radiation profile taken at a selected wellbore depth to contrast the gamma-ray signature of a data sensor pip-tag with the subsurface formation background gamma-ray signature.

Thus, a rotation of 360 degrees by wireline tool 1230, under the output torque of motor 1250, within casing 1124 reveals a lateral radiation pattern at any particular depth where the wireline tool, or more particularly the collimated gamma-ray detector, is positioned. By positioning the gamma-ray detector at the depth of remote sensing unit 524, the lateral radiation pattern will include the remote sensing unit's gamma-ray signature against a measured baseline. The measured baseline is related to the amount of detected gamma-rays corresponding to the respective local formation background. The pip-tag of each remote sensing unit 524 will give a strong signal on top of this baseline and identify the azimuth at which the remote sensing unit is located, as represented in FIG. 14. In this manner, antenna installation tool 1238 can be "pointed" very closely to the remote sensing unit of interest.

Further operation of tool 1230 is highlighted by the flow chart sequence of FIG. 16, as will now be described. At this point, wireline tool 1230 is positioned at the proper depth and oriented to the proper azimuth and is properly placed for drilling or otherwise creating lateral opening 1122 through casing 1124 and cement layer 1126 proximate the identified remote sensing unit 524 (step 1600). For this purpose, the present invention utilizes a modified version of the formation sampling tool described in U.S. Pat. No. 5,692,565, also assigned to the assignee of the present invention and incorporated herein by reference in its entirety.

Casing Perforation and Antenna Installation

Figure 15:
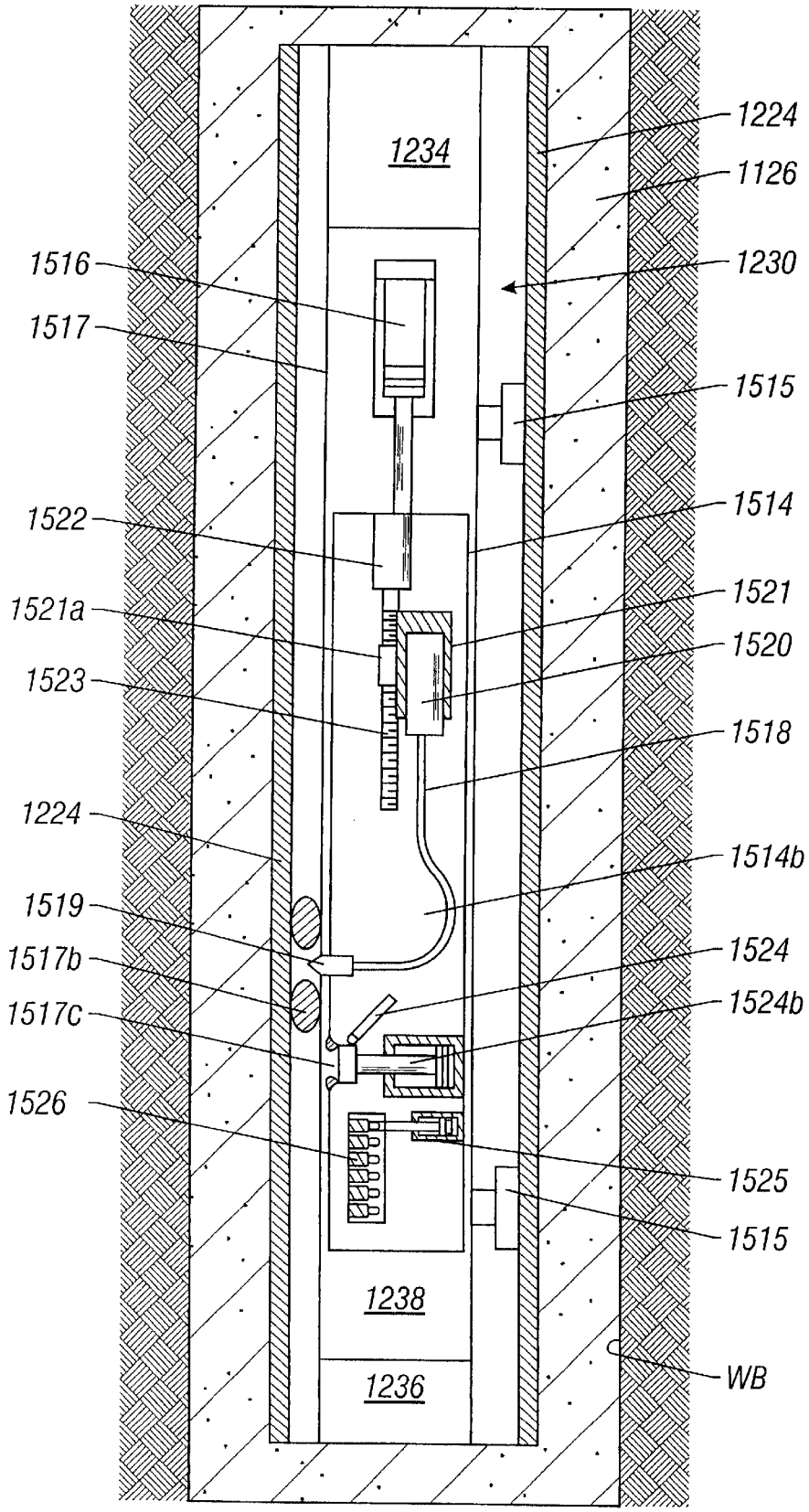
FIG. 15 is a sectional schematic of a tool for creating a perforation in the casing and installing an antenna in the perforation for communication with the remote sensing unit.

FIG. 15 shows one embodiment of perforating tool 1238 for creating the lateral opening in casing 1124 and installing an antenna therein. Tool 1238 is positioned within wireline tool 1230 between upper and lower rotation tools 1234 and 1236 and has a cylindrical body 1517 enclosing inner housing 1514 and associated components. Anchor pistons 1515 are hydraulically actuated in a conventional manner to force inflatable tool packer 1517*b* against the inner wall of casing 1124, forming a pressure-tight seal between antenna installation tool 1238 and casing 1124 and stabilizing tool 1230 (step 1601 of FIG. 16).

FIG. 12 illustrates, schematically, an alternative to packer 1517*b,* in the form of hydraulic packer assembly 1241, which includes a sealing pad on a support plate movable by hydraulic pistons into sealed engagement with casing 1124. Those skilled in the art will appreciate that other equivalent means are equally suited for creating a seal between antenna installation tool 1238 and the casing about the area to be perforated.

Referring back to FIG. 15, inner housing 1514 is supported for movement within body 1517 along the axis of the body by housing translation piston 1516, as will be described further below. Housing 1514 contains three subsystems for perforating the casing, for testing the pressure seal at the casing and for installing an antenna in the perforation as will be explained in greater detail below. The movement of inner housing 1514 via translation piston 1516 positions the components of each of inner housing's the three subsystems over the sealed casing perforation.

Figure 15A:
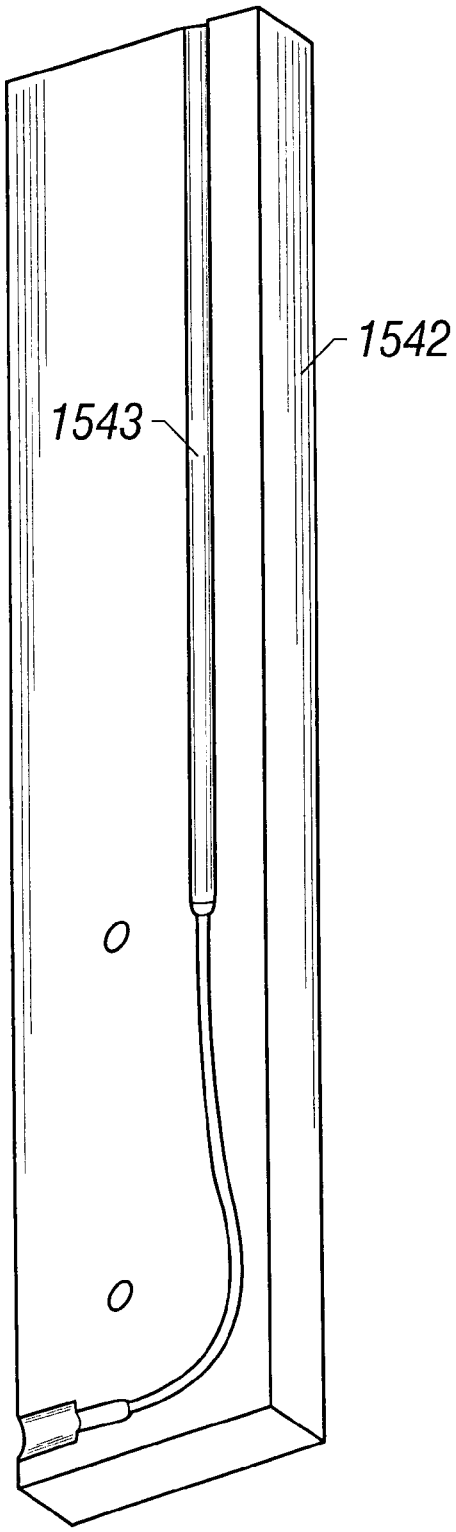
FIG. 15A is one of a pair of guide plates utilized in the antenna installation tool for conveying a flexible shaft that is used to perforate the casing.

The first subsystem of inner housing 1514 includes flexible shaft 1518 conveyed through mating guide plates 1542, one of which is shown in FIG. 15A. Drill bit 1519 is rotated via flexible shaft 1518 by drive motor 1520, which is held by motor bracket 1521. Motor bracket 1521 is attached to translation motor 1522 by way of threaded shaft 1523 which engages nut 1521*a* connected to motor bracket 1521. Thus, translation motor 1522 rotates threaded shaft 1523 to move drive motor 1520 up and down relative to inner housing 1514 and casing 1224. Downward movement of drive motor 1520 applies a downward force on flexible shaft 1518, increasing the penetration rate of bit 1519 through casing 1124. J-shaped conduit 1543 formed in guide plates 1542 translates the downward force applied to shaft 1518 into a lateral force at bit 1519, and also prevents shaft 1518 from buckling under the thrust load it applies to the bit.

As the bit penetrates the casing, it makes a clean, uniform perforation that is much preferred to that obtainable with shaped charges. The drilling operation is represented by step 1603 in FIG. 16. After the casing perforation has been drilled, drill bit 1519 is withdrawn by reversing the direction of translation motor 1522. It is understood, of course, that prior to the drilling step that packer setting piston 1524*b* is actuated to force packer 1517*c* against the inner wall of housing 1517, forming a sealed passageway between the casing perforation and flowline 1524 (step 1602).

Figure 17:
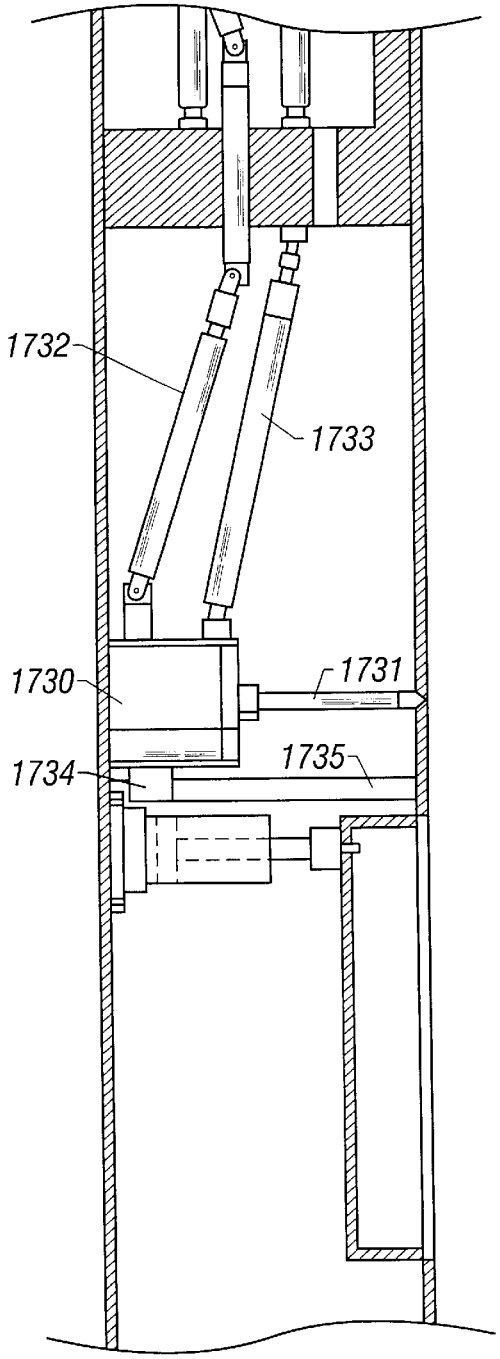
FIG. 17 is a sectional view of an alternative tool for perforating casing.

FIG. 17 shows an alternative device for drilling a perforation in the casing, including a right angle gearbox 1730 which translates torque provided by jointed drive shaft 1732 into torque at drill bit 1731. Thrust is applied to bit 1731 by a hydraulic piston (not shown) energized by fluid delivered through flowline 1733. The hydraulic piston is actuated in a conventional manner to move gearbox 1730 in the direction of bit 1731 via support member 1734 which is adapted for sliding movement along channel 1735. Once the casing perforation is completed, gearbox 1730 and bit 1731 are withdrawn from the perforation using the hydraulic piston.

The second subsystem of inner housing 1514 relates to the testing of the pressure seal at the casing. For this purpose, housing translation piston 1516 is energized from surface control equipment via circuitry passing through cable 1231 to shift inner housing 1514 upwardly so as to move packer 1517*c* about the opening in housing 1517. The formation pressure can then be measured in a conventional manner, and a fluid sample can be obtained if so desired (step 1604). Once the proper measurements and samples have been taken, piston 224*b* is withdrawn to retract packer 217*c* (step 1605).

Housing translation piston 1516 is then actuated to,shift inner housing 1514 upwardly even further to align antenna magazine 1526 in position over the casing perforation (step 1606). Antenna setting piston 1525 is then actuated to force one antenna 1128 from magazine 1526 into the casing perforation. The sequence of setting the antenna is shown more particularly in FIGS. 18A–18C, and 19.

Figure 18A:
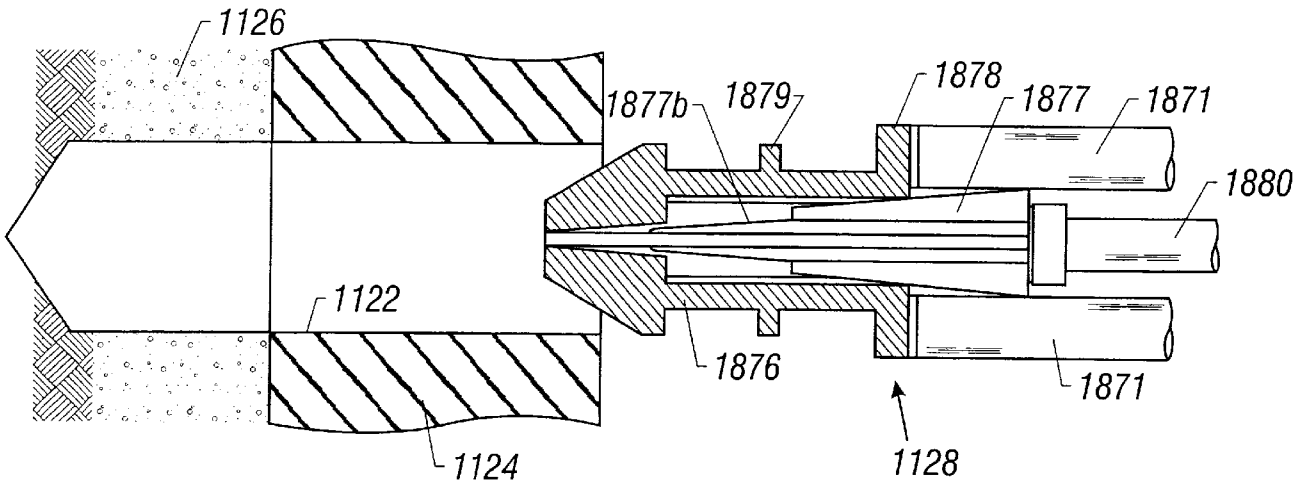
FIGS. 18A–18C are sequential sectional views showing the installation of one embodiment of the antenna in the casing perforation.
Figure 18B:
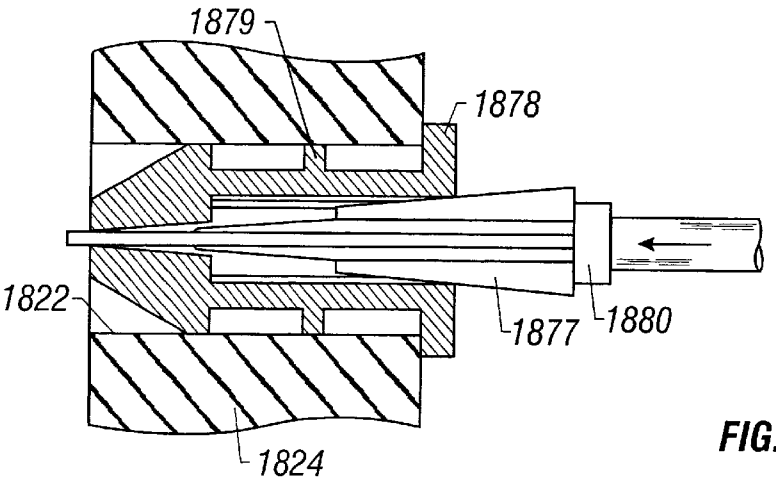
Figure 18C:
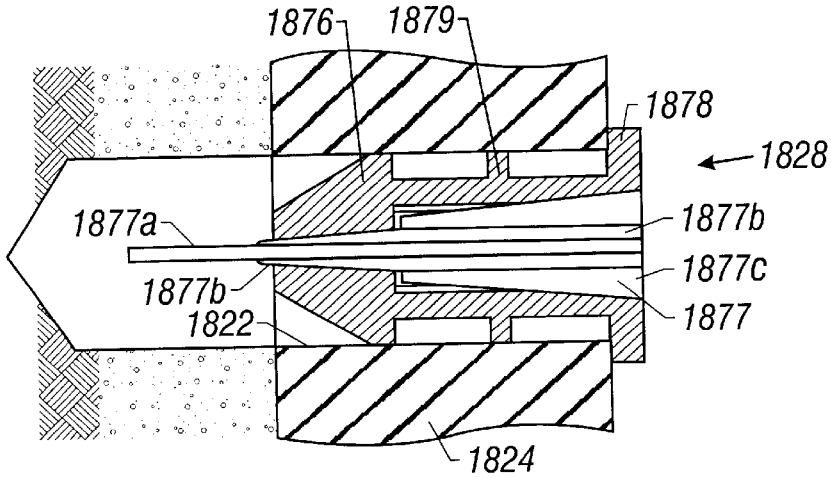

With reference first to FIGS. 18A–18C, antenna 1128 includes two secondary components designed for full assembly within the casing perforation: tubular socket 1876 and tapered body 1877. Tubular socket 1876 is formed of an elastomeric material designed to withstand the harsh environment of the well-bore, and contains a cylindrical opening through the trailing end thereof and a small-diameter tapered opening through the leading end thereof. The tubular socket is also provided with a trailing lip 1878 for limiting the extent of travel by the antenna into the casing perforation, and an intermediate rib 1879 between grooved regions for assisting in creating a pressure tight seal at the perforation.

Figure 19:
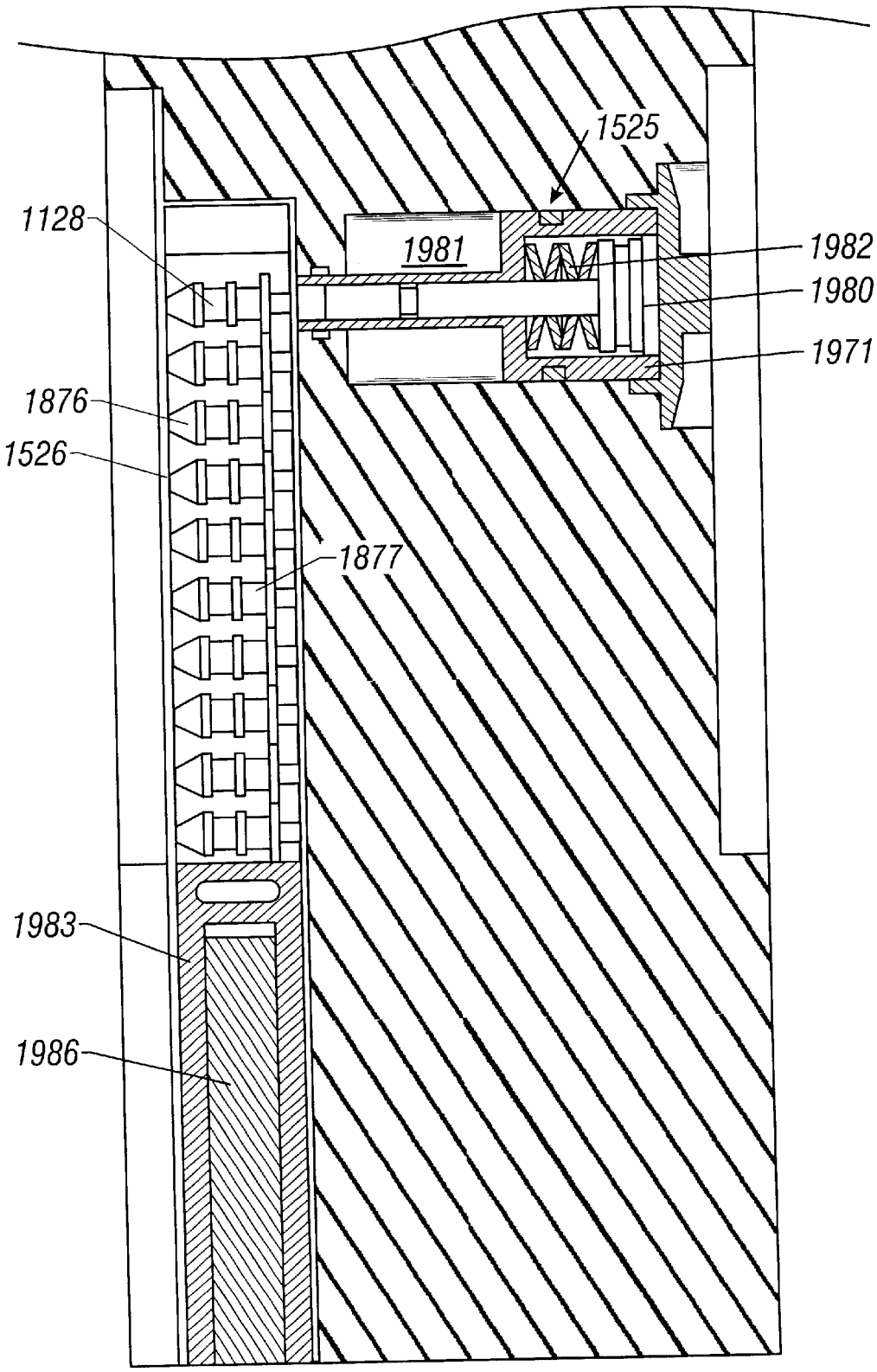
FIG. 19 is a detailed sectional view of the lower portion of the antenna installation tool, particularly the antenna magazine and installation mechanism for the antenna embodiment shown in FIGS. 18A–18C.

FIG. 19 shows a detailed section of the antenna setting assembly adjacent to antenna magazine 1526. Setting piston 1525 includes outer piston 1971 and inner piston 1980. Setting the antenna in the casing perforation is a two-stage process. Initially during the setting process, both pistons 1971 and 1980 are actuated to move across cavity 1981 and press one antenna 1128 into the casing perforation. This action causes both tapered antenna body 1877, which is already partially inserted into the opening at the trailing end of tubular socket 1876 within magazine 1526, and tubular socket 1876 to move towards casing perforation 1822 as indicated in FIG. 18A. When trailing lip 1878 engages the inner wall of casing 1824, as shown in FIG. 18B, outer piston 1971 stops, but the continued application of hydraulic pressure upon the piston assembly causes inner piston 1980 to overcome the force of spring assembly 1982 and advance through the cylindrical opening at the trailing end of tubular socket 1876. In this manner, tapered body 1877 is fully inserted into tubular socket 1876, as shown in FIG. 18C.

Tapered antenna body 1877 is equipped with elongated antenna pin 1877*a,* tapered insulating sleeve 1877*b,* and outer insulating layer 1877*c,* as shown in FIG. 18C. Antenna pin 1877*a* extends beyond the width of casing perforation 1822 on each end of the pin to receive data signals from remote sensing unit 524 and communicate the signals to a data receiver positioned in the well-bore, as described in detail below. Insulating sleeve 1877*b* is tapered near the leading end of the antenna pin to form an interference wedge-like fit within the tapered opening at the leading end of tubular socket 1876, thereby providing a pressure-tight seal at the antenna/perforation interface.

Magazine 1526, as shown in FIGS. 15 and 19, stores multiple antennas 1128 and feeds the antennas during the installation process. After one antenna 1128 is installed in a casing perforation, piston assembly 1525 is fully retracted and another antenna is forced upwardly by spring 1986 of pusher assembly 1983. In this manner, a plurality of antennas can be installed in casing 1824.

Figure 18D:
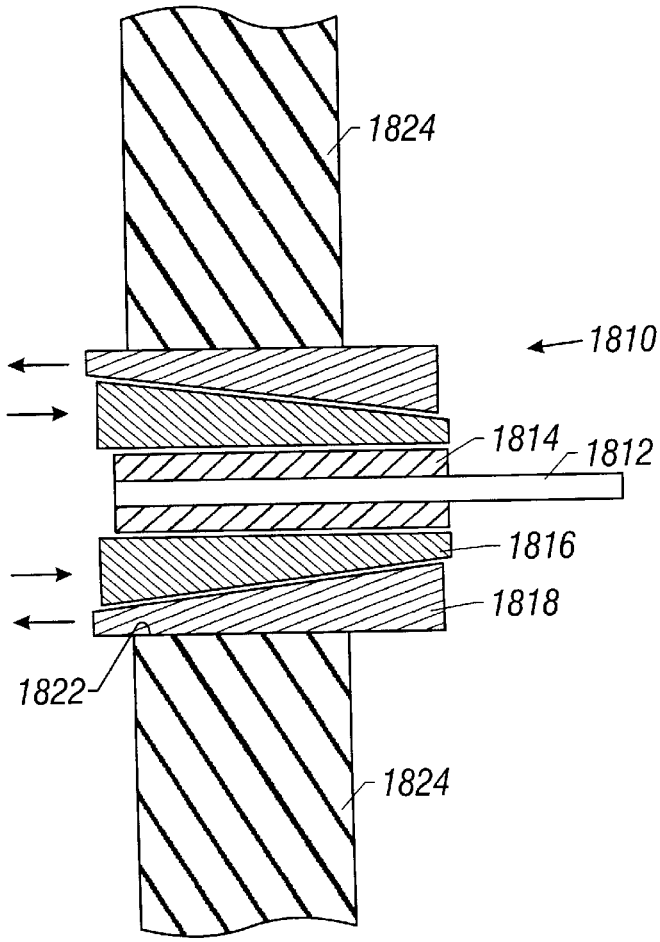
FIG. 18D is a sectional view of a second embodiment of the antenna installed in the casing perforation.

An alternative antenna structure is shown in FIG. 18D. In this embodiment, antenna pin 1812 is permanently set in insulating sleeve 1814, which in turn is permanently set in setting cone 1816. Insulating sleeve 1814 is cylindrical in shape, and setting cone 1816 has a conical outer surface and a cylindrical bore therein sized for receiving the outer diameter of sleeve 1814. Setting sleeve 1818 has a conical inner bore therein that is sized to receive the outer conical surface of setting cone 1816, and the outer surface of sleeve 1818 is slightly tapered so as to facilitate its insertion into casing perforation 1822. By the application of opposing forces to cone 1816 and sleeve 1818, a metal-to-metal interference fit is achieved to seal antenna assembly 1810 in perforation 1822. The application of force via opposing hydraulically actuated pistons in the direction of the arrows shown in FIG. 18D will force the outer surface of sleeve 1818 to expand and the inner surface of cone 1816 to contract, resulting in a metal-to-metal seal at perforation or opening 1122 for the antenna assembly.

Figure 16:
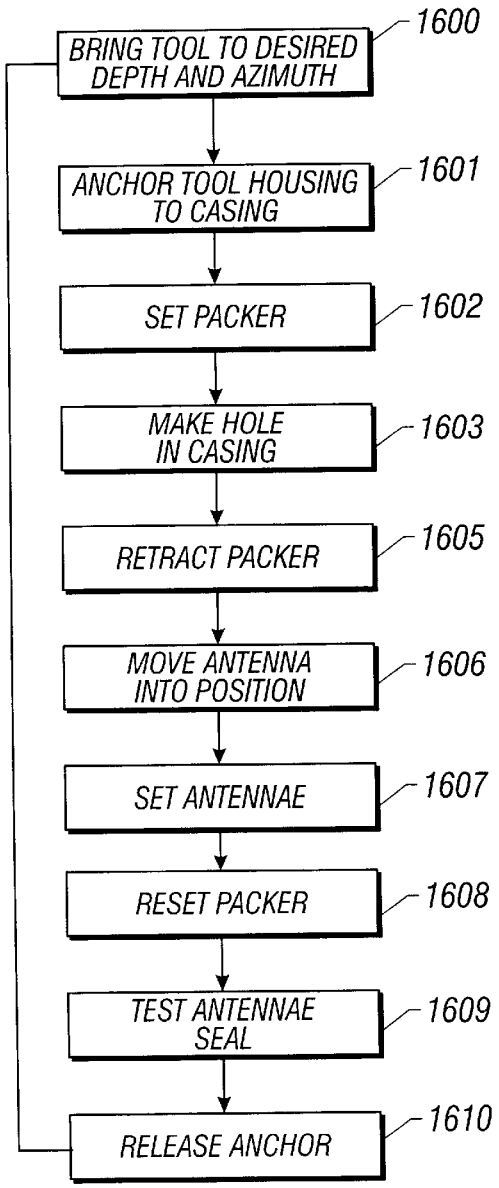
FIG. 16 is a flow chart of the operational sequence for the tool shown in FIG. 15.

The integrity of the installed antenna, whether it be the configuration of FIGS. 18A–18C, the configuration of FIG. 18D, or some other configuration to which the present invention is equally adaptable, can be tested by again shifting inner housing 1514 with translation piston 1516 so as to move measurement packer 1517*c* over the lateral opening in housing 1517 and resetting the packer with piston 1524*b*, as indicated at step 1608 in FIG. 16. Pressure through flowline 1524 can then be monitored for leaks, as indicated at step 1609, using a drawdown piston or the like to reduce the flowline pressure. Where a drawdown piston is used, a leak will be indicated by the rise of flowline pressure above the drawdown pressure after the drawdown piston is deactivated. Once pressure testing is complete, anchor pistons 1515 are retracted to release tool 1238 and wireline tool 1230 from the casing wall, as indicated at step 1610. At this point, tool 1230 can be repositioned in the casing for the installation of other antennas, or removed from the well-bore.

Data Receiver

Figure 20:
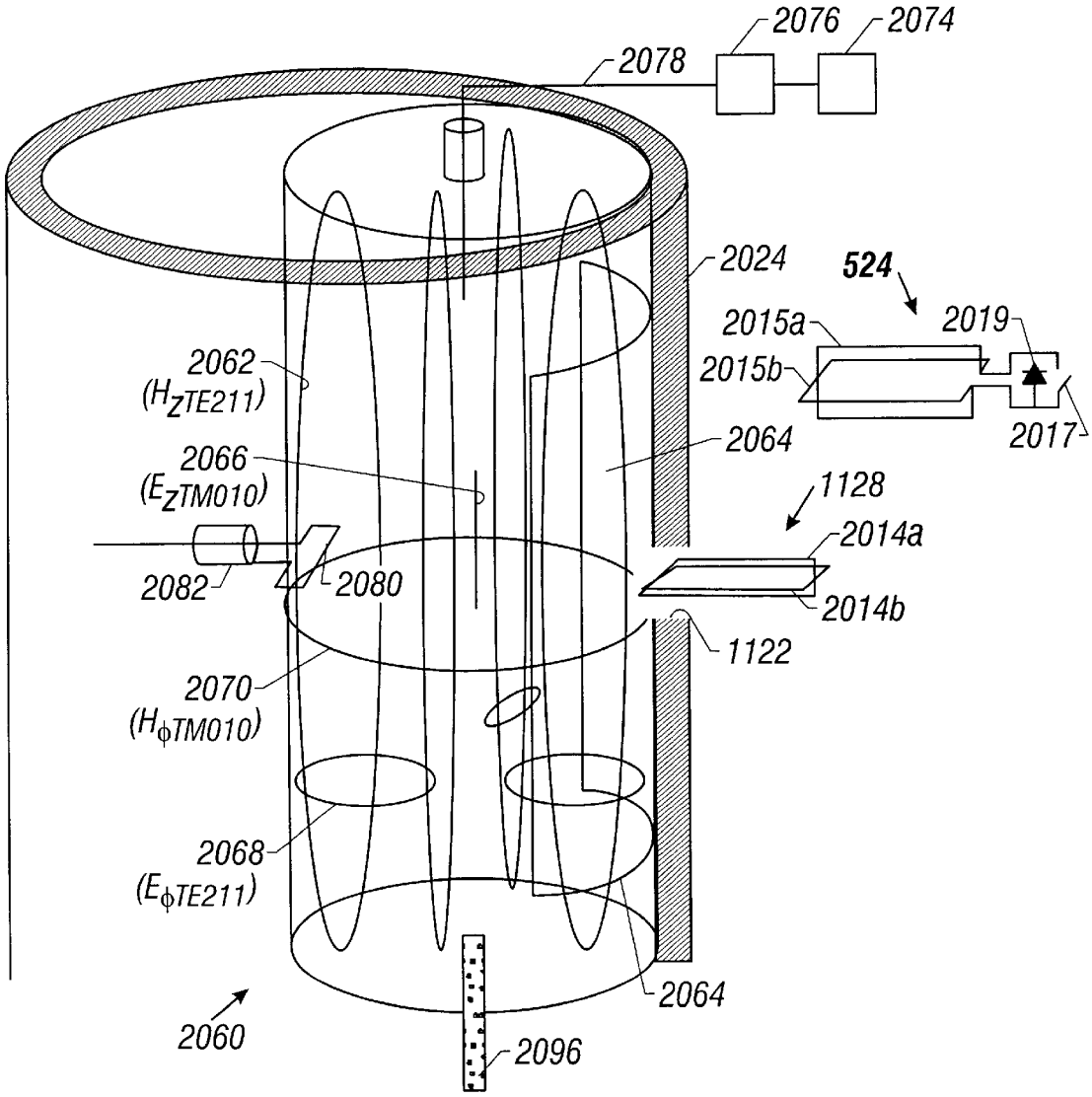
FIG. 20 is a schematic of the data receiver positioned within the casing for communication with the remote sensing unit via an antenna installed through the perforation in the casing wall, and illustrates the electrical and magnetic fields within a microwave cavity of the data receiver.

Referring now to FIG. 20, after antenna 1128 is installed and properly sealed in place, a wireline tool containing data receiver 2060 is inserted into the cased well-bore for communicating with remote sensing unit 524 via antenna 1128. Data receiver 2060 includes transmitting and receiving circuitry for transmitting command signals via antenna 1128 to remote sensing unit 524 and receiving formation data signals via the antenna from the remote sensing unit 524.

More particularly, communication between data receiver 2060 inside casing 1124 and remote sensing unit 524 located outside the casing is achieved in a preferred embodiment via two small loop antennas 2014*a* and 2014*b*. The antennas are imbedded in antenna assembly 1128 that has been placed inside opening 1122 by antenna installation tool 1238. A plane formed by first antenna loop 2014*a* is positioned parallel to a longitudinal axis of the casing and produces a magnetic dipole that is perpendicular to the longitudinal axis of the casing. The second antenna loop 2014*b* is positioned to produce a magnetic dipole that is perpendicular to the longitudinal axis of the casing as well as the magnetic dipole produced by the first antenna loop 2014*a*. Consequently, first antenna 2014*a* is sensitive to electromagnetic fields perpendicular to the casing axis and second antenna 2014*b* is sensitive to magnetic fields parallel to the axis of the casing.

Remote sensing unit 524, contains in a preferred embodiment, two similar loop antennas 2015*a* and 2015*b* therein. The loop antennas have the same relative orientation to one another as loop antennas 2014*a* and 2014*b*. However, loop antennas 2015*a* and 2015*b* are connected in series, as indicated in FIG. 20, so that the combination of these two antennas is sensitive to both directions of the electromagnetic field radiated by loop antennas 2014*a* and 2014*b*.

The data receiver in the tool inside the casing utilizes a microwave cavity 2062 having a window 2064 adapted for close positioning against the inner face of casing wall 2024. The radius of curvature of the cavity is identical or very close to the casing inner radius so that a large portion of the window surface area is in contact with the inner casing wall. The casing effectively closes microwave cavity 2062, except for drilled opening 1122 against which the front of window 2064 is positioned. Such positioning can be achieved through the use of components similar to those described above in regard to wireline tool 1230, such as the rotation tools, gamma-ray detector, and anchor pistons. (No further description of such data receiver positioning will be provided herein.) Through the alignment of window 2064 with perforation 1122, energy such as microwave energy can be radiated in and out via the antenna through the opening in the casing, providing a means for two-way communication between sensing microwave cavity 2062 and the remote sensing unit antennas 2015*a* and 2015*b*.

Communication from the microwave cavity is provided at one frequency F corresponding to one specific resonant mode, while communication from the remote sensing unit is achieved at twice the frequency, or 2F. Dimensions of the cavity are chosen to have resonant frequencies close to 1F and 2F. Those skilled in the art can appreciate to formation of cavities to have such specified resonant frequency characteristics. Relevant electrical fields 2066, 2068 and magnetic fields 2070, 2062 are illustrated in FIG. 20 to help visualize the cavity field patterns. In a preferred embodiment, cylindrical cavity 2062 has a radius of 5 cm and a vertical extension of approximately 30 cm. A cylindrical coordinate system is used to represent any physical location inside the cavity. The electromagnetic (EM) field excited inside the cavity has an electric field with components $E_z$, $E_\rho$, and $E_\phi$ and a magnetic field with components $H_z$, $H_\rho$ and $H_\phi$.

In transmitting mode, cavity 2062 is excited by microwave energy fed from the transmitter oscillator 2074 and power amplifier 2076 through connection 2078, a coaxial line connected to a small electrical dipole located at the top of cavity 2062 of data receiver 2060.

In a receiving mode, microwave energy excited in cavity 2062 at a frequency 2F is sensed by the vertical magnetic dipole 2080 connected to a receiver amplifier 2082 tuned at 2F.

It is a well known fact that microwave cavities have two fundamental modes of resonance. The first one is called transverse magnetic or "TM" (Hz=0), and the second mode is called transverse electric or "TE" in short (Ez=0). These two modes are therefore orthogonal and can be distinguished not only by frequency discrimination but also by the physical orientation of an electric or magnetic dipole located inside the cavity to either excite or detect them, a feature that the present invention uses to separate signals excited at frequency F from signals excited at 2F.

At resonance, the cavity displays a high Q, or dampening loss effect, when the frequency of the EM field inside the cavity is close to the resonant frequency, and a very low Q when the frequency of the EM field inside the cavity is different from the resonant frequency of the cavity, providing additional amplification of each mode and isolation between different modes.

Mathematical expressions for the electrical (E) and magnetic (H) field components of the TM and TE modes are given by the following terms:

For TM Modes $$E_z=\lambda_{ni}^2/R^2J_n(\lambda_{ni}/R\rho)\cos(n\phi)\cos(m\pi z/L)$$

$$E_\rho=-m\pi\lambda_{ni}/LRJ_n'(\lambda_{ni}/R\rho)\cos(n\phi)\sin(m\pi z/L)$$

$$E_\phi=nm\pi/L\rho J_n(\lambda_{ni}/R\rho)\sin(n\phi)\sin(m\pi z/L)$$

$$H_z=0$$

$$H_\rho=jnk/\rho(\epsilon/\mu)^{1/2}J_n(\lambda_{ni}/R\rho)sin(n\phi)\cos(m\pi z/L)$$

$$H_\phi=-jnk\lambda_{ni}/R(\epsilon/\mu)^{1/2}J_n'(\lambda_{ni}/R\rho)\cos(n\phi)cos(m\pi z/L)$$

with resonant frequency $f_{TMnim}=c/2((\lambda_{ni}/\pi R)^2+(m/L)^2)^{1/2}$ and TE Modes $$E_z=0$$

$$E_\rho=-jnk/\rho(\mu/\epsilon)^{1/2}J_n(\sigma_{ni}/R\rho)\sin(n\phi)\sin(m\pi z/L)$$

$$E_\phi=jk\sigma_{ni}/R(\mu/\epsilon)^{1/2}J_n'(\sigma_{ni}/R\rho)\cos(n\phi)\sin(m\pi z/L)$$

$$H_z=\sigma_{ni}^2/R^2J_n(\sigma_{ni}/R\rho)\cos(n\phi)\sin(m\pi z/L)$$

$$H_\rho=m\pi\sigma_{ni}/LRJ_n'(\sigma_{ni}/R\rho)\cos(n\phi)\cos(m\pi z/L)$$

$$H_\phi=-nm\pi/L\rho J_n(\sigma_{ni}/R\rho)\sin(n\phi)\cos(m\pi z/L)$$

with resonant frequency $$f_{TEnim}=c/2((\sigma_{ni}/\pi R)^2+(m/L)^2)^{1/2}$$

where:

Q coefficient of dampening;

n, m integers that characterize the infinite series of resonant frequencies for azimuthal ($\phi$) and vertical (z) components;

I root order of the equation;

c speed of light in vacuum $\mu$, $\epsilon$ magnetic and dielectric property of the medium inside the cavity f frequency $\omega$ $2\pi f$ k wave number$=(\omega^2\mu\epsilon+i\omega\mu\sigma)^{1/2}$ R, L radius and length of cavity $J_n$ Bessel function of order n $J_n'$ $\delta J_n/\delta\rho$ $\lambda_{ni}$ root of $J_n(\lambda_{ni})=0$ $\sigma_{ni}$ root of $J_n'(\sigma_{ni})=0$ Dimensions of the cavity (R and L) have been chosen such that $$f_{TEnim}=c/2((\sigma_{ni}/\pi R)^2+(m/L)^2)^{1/2}=2f_{TMnim}=c((\lambda_{ni}/\pi R)^2+(m/L)^2)^{1/2}$$

One of the solution for $f_{TMnim}$ is to select the TM mode corresponding to n=0, i=1, m=0 and $\lambda_{01}$=2.40483 which corresponds to the lowest TM frequency mode. This selection produces the following results:

$$E_z=\lambda_{01}^2/R^2J_0(\lambda_{01}/R\rho)$$

$$E_\rho=0$$

$$E_\phi=0$$

$$H_z=0$$

$$H_\rho=0$$

$$H_\phi=-jk\lambda_{01}/R(\epsilon/\mu)^{1/2}J_0'(\lambda_{01}/R\rho)$$

with $f_{TM010}=c/2\lambda_{01}/\pi R$

One solution for $F_{TEnim}$ is to select the TE mode corresponding to n=2, i=1, m=1 and $G_{21}$=3.0542. This selection is orthogonal to the TM010 mode selection above, and produces a frequency for the TE mode that is twice the TM010 frequency. The following results are produced by this TE mode selection:

$$E_z=0$$

$$E_\rho=-j2k/\rho(\mu/\epsilon)^{1/2}J_2(\sigma_{21}/R\rho)\sin(2\phi)\sin(\pi z/L)$$

$$E_\phi=jk\sigma_{21}/R(\mu/\epsilon)^{1/2}J_2'(\sigma_{21}/R\rho)\cos(2\phi)\sin(\pi z/L) \quad (12)$$

$$H_z=\sigma_{21}^2/R^2J_2(\sigma_{21}/R\rho)\cos(2\phi)\sin(\pi z/L) \quad (13)$$

$$H_\rho=\pi\sigma_{21}/LRJ_2'(\sigma_{21}/R\rho)\cos(2\phi)\cos(\pi z/L)$$

$$H_\phi=-2\pi/L\rho J_2(\sigma_{21}/R\rho)\sin(2\phi)\cos(\pi z/L)$$

with $$f_{TE211}=c/2((\sigma_{21}/\pi R)^2+(1/L)^2)^{1/2}$$

The TM mode can be excited either by a vertical electric dipole (Ez) or a horizontal magnetic dipole (vertical loop H$\phi$), while the TE mode can be excited by a vertical magnetic dipole (horizontal loop Hz).

Figure 21:
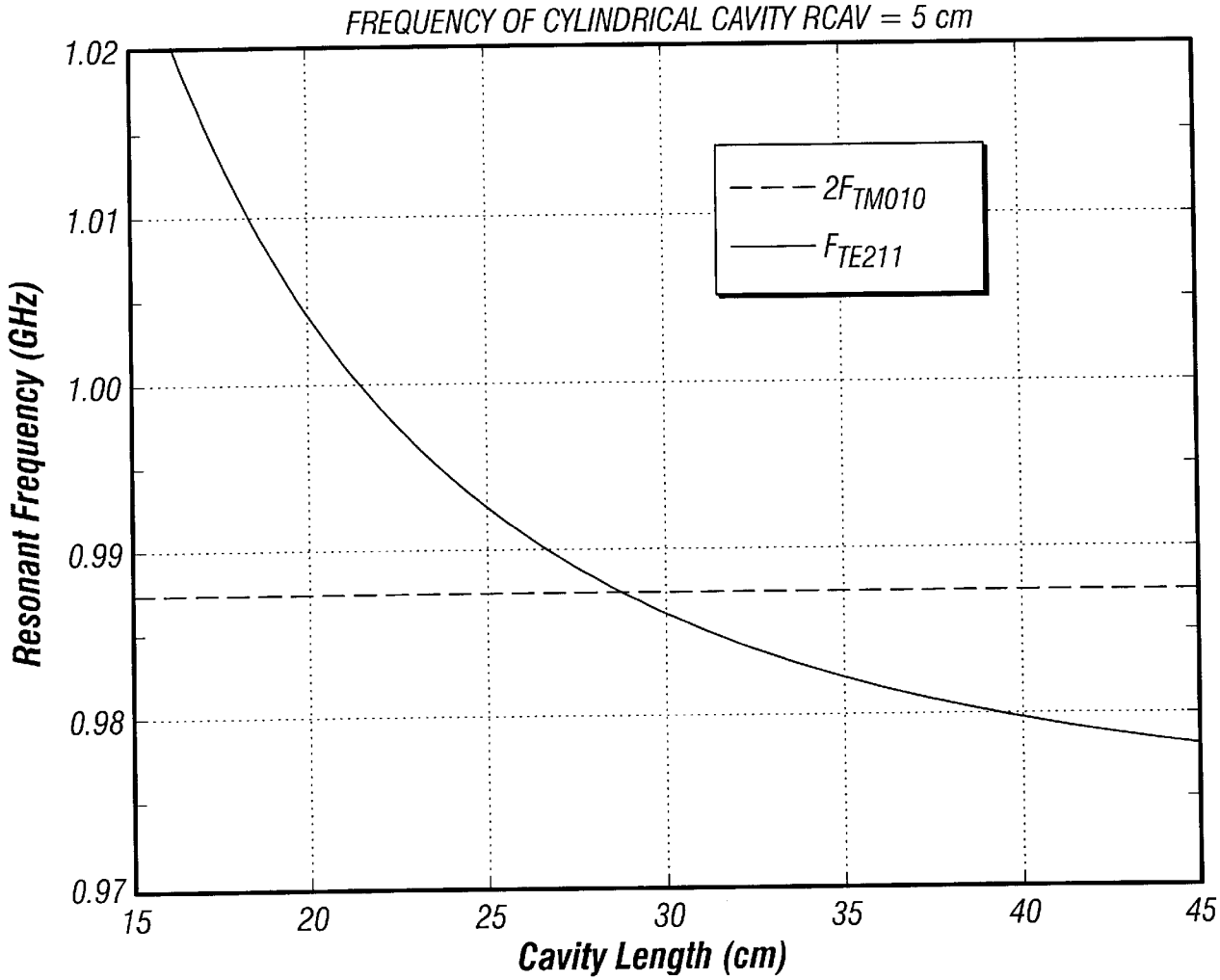
FIG. 21 is a plot of the data receiver resonant frequency versus microwave cavity length.

In FIG. 21, $2F_{TM010}$ and $F_{TE211}$ are plotted as a function of cavity length L for a cavity radius R=5 cm. For L=28 cm, the TE mode resonates at twice the TM mode, and given the cavity dimensions, the following resonant frequencies are determined:

$$F_{TM010}=494 \text{ MHz and } F_{TEn211}=988 \text{ MHz.}$$

Those of ordinary skill in the related art given the benefit of this disclosure will appreciate that with change in cavity shape, dimensions and filling material, the exact values of the resonant frequencies may differ from those stated above. It should also be understood that the two modes described earlier are just one possible set of resonant modes and that there is, in principle, an infinite set one might choose from. In any case, the preferable frequency range for this invention falls in the 100 MHz to 10 GHz range. It should also be understood that the frequency range could be extended outside this preferred range without departing from the spirit of the present invention.

It is also well known that a cavity can be excited by proper placement of an electrical dipole, magnetic dipole, an aperture (i.e., an insulated slot on a conductive surface) or a combination of these inside the cavity or on the outer surface of the cavity. For instance, coupling loop antennas 2014*a* and 2014*b* could be replaced by electrical dipoles or by a simple aperture. The remote sensing unit loop antennas could also be replaced by a single or combination of electrical and/or magnetic dipole(s) and/or aperture(s).

Figure 22:
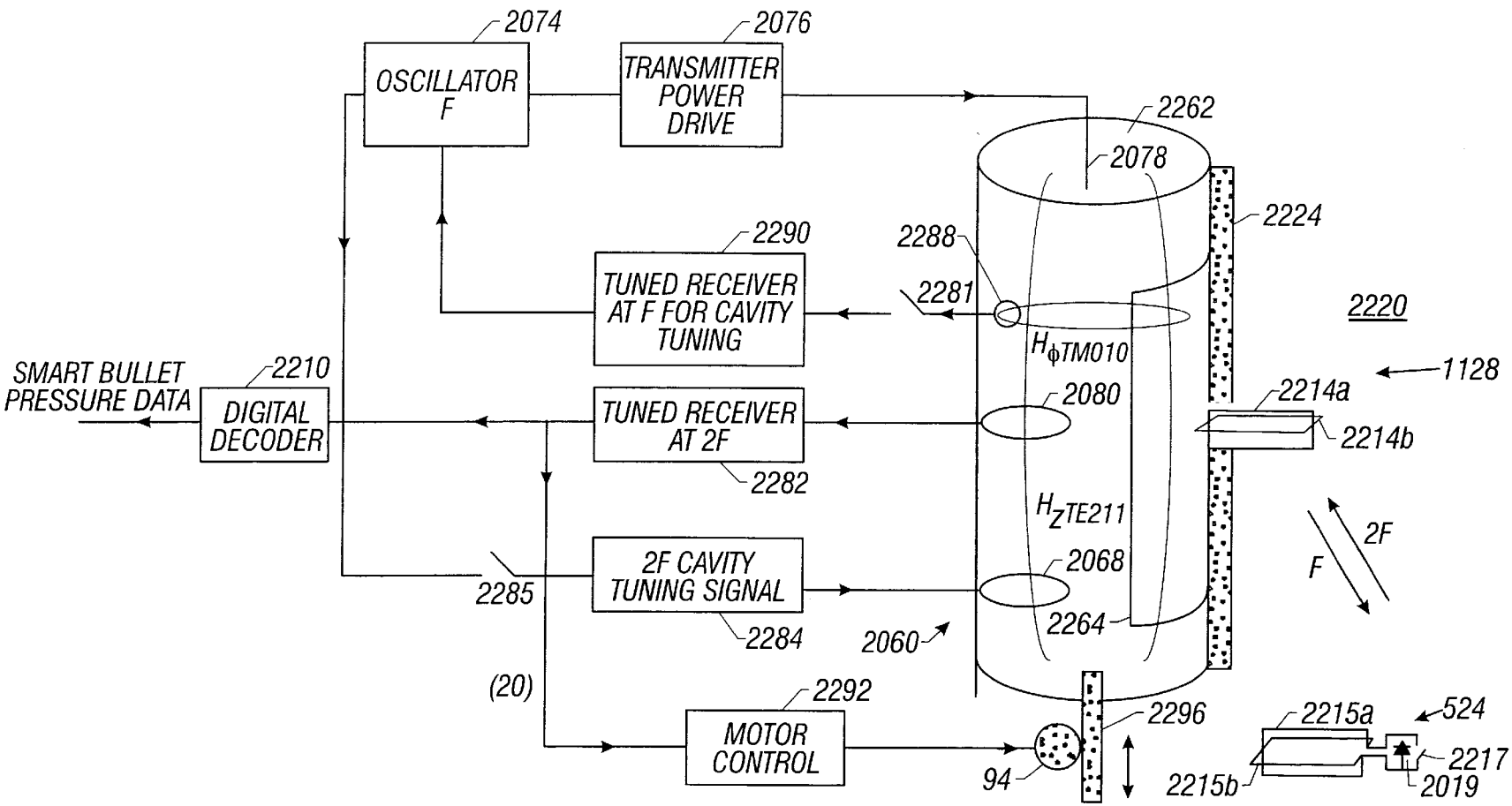
FIG. 22 is a schematic of the data receiver communicating with the remote sensing unit, and includes a block diagram of the data receiver electronics.

FIG. 22 shows a schematic of the present invention, including a block diagram of the data receiver electronics. As stated above, tunable microwave oscillator 2074 operates at frequency F to drive microwave power amplifier 2076 connected to electrical dipole 2078 located near the center of one side of data receiver 2060. The dipole is aligned with the z axis to provide maximum coupling to the $E_z$ component of mode TM010 (equation (1) below ($E_z$ is a maximum for $\rho$=0.)).

In order to determine if oscillator frequency F is tuned to the TM101 resonant frequency of cavity 2062, horizontal magnetic dipole 2288, a small vertical loop sensitive to $H_{\phi TM101}$ (equation (2) below), is connected through a coaxial cable to switch 2281 and, via switch 2281, to a microwave receiver amplifier 2290 tuned at F. The frequency F is adjusted until a maximum signal is received in tuned receiver 2290 by means of feedback.

$$E_{zTM101}=\lambda^2_{01}/R^2J(\lambda_{01}\rho/R) \quad (1)$$

$$H_{TM010}=-jk\lambda_{01}/R(\epsilon/\mu)^{1/2}J_0'(\lambda_{01}\rho/R) \quad (2)$$

$$F=c\lambda_{01}/2\pi R \quad (2)$$

$$H_{ZTE211}=\sigma^2_{21}/R^2J_2(\sigma_{21}\rho/R)\sin(2\phi)\cos(\pi z/L) \quad (4)$$

$$2F=c/2((\sigma_{21}\rho/R)^2+(1/L)^2)^{1/2} \quad (5)$$

It should be clear from the previous description that with change in cavity shape, dimensions and filling material, the exact values of the resonant frequencies may differ from those stated above. It should be also understood that the two modes described earlier are just one possible set of resonant modes and that there is in principle an infinite set one might choose from. In any case the preferable frequency range for this invention would fall in the 100 MHz to 10 GHz. It should also be understood that the frequency range could be extended outside this preferred range without departing from the spirit of the present invention.

Finally it is well known that a cavity can be excited by proper placement of electrical, magnetic dipole and aperture or a combination of these inside the cavity or on its outer surface. For instance coupling antennas (1*a*) and (1*b*) could be replaced by electrical dipoles or by a simple aperture. The remote sensing unit antenna could also be replaced by a single or combination of electrical and/or magnetic dipole(s) and/or aperture(s).

Those of ordinary skill in the related art given the benefit of this disclosure will appreciate that with change in cavity shape, dimensions and filling material, the exact values of the resonant frequencies may differ from those stated above. It should also be understood that the two modes described earlier are just one possible set of resonant modes and that there is, in principle, an infinite set one might choose from. In any case, the preferable frequency range for this invention falls in the 100 MHz to 10 GHz range. It should also be understood that the frequency range could be extended outside this preferred range without departing from the spirit of the present invention.

It is also well known that a cavity can be excited by proper placement of an electrical dipole, magnetic dipole, an aperture (i.e., an insulated slot on a conductive surface) or a combination of these inside the cavity or on the outer surface of the cavity. For instance, coupling floop antennas 2014*a* and 2014*b* could be replaced by electrical dipoles or by a simple aperture. The remote sensing unit loop antennas could also be replaced by a single or combination of electrical and/or magnetic dipole(s) and/or aperture(s).

In order to tune the cavity to TE211 mode frequency 2F, a 2F tuning signal is generated in tuner circuit 2284 by rectifying a signal at frequency F coming from oscillator 2274 through switch 2285 by means of a diode similar to diode 2019 used with remote sensing unit 524. The output of tuner 2284 is coupled through a coaxial cable to a vertical magnetic dipole, a small horizontal loop sensitive to Hz of TE211 (equation (4) above), to excite the TE211 mode at frequency 2F. A similar horizontal magnetic dipole is created by a small horizontal loop also sensitive to Hz of TE211 (equation (4)), that is connected to a microwave receiver circuit 2282 tuned at 2F. The output of receiver 2282 is connected to motor control 2292 which drives an electrical motor 2294 moving a piston 2296 in order to change the length L of the cavity, in a manner that is known for tunable microwave cavities, until a maximum signal is received. It will be apparent to those of ordinary skill in the art that a single loop antenna could replace the pair of loop antennas connected to both circuits 2282 and 2284.

Once both TM frequency F and TE frequency 2F are tuned, the measurement cycle can begin, assuming that the window 2264 of cavity 2262 has been positioned in the direction of remote sensing unit 524 and that antenna 1128 containing loop antennas 2014*a* and 2014*b*, or other equivalent means of communication, has been properly installed in casing opening 1122. Maximum coupling can be achieved for the TE211 mode if remote sensing unit 524 is positioned such that antenna 1128 is approximately level with the vertical center of microwave cavity 2262. In this regard, it should be noted that $H_{\phi TM010}$ is independent of z, but $Hz_{TE211}$ is at a maximum for z=L/2.

Formation Data Measurement and Acquisition

With continuing reference to FIG. 22, the formation data measurement and acquisition sequence is initiated by exciting microwave energy into cavity 2262 using oscillator 2074, power amplifier 2076 and the electric dipole located near the center of the cavity. The microwave energy is coupled to the remote sensing unit loop antennas 2215*a* and 2215*b* through coupling loop antennas 2214*a* and 2214*b* in the antenna assembly of remote sensing unit 524. In this fashion, microwave energy is beamed outside the casing at the frequency F determined by the oscillator frequency and shown on the timing diagram of FIG. 34 at 3410. The frequency F can be selected within the range of 100 MHz up to 10 GHz, as described above.

As soon as remote sensing unit 524 is energized by the transmitted microwave energy, the receiver loop antennas 2215*a* and 2215*b* located inside the remote sensing unit radiate back an electromagnetic wave at 2F or twice the original frequency, as indicated at 1086 in FIG. 10. A low threshold diode 2219 is connected across the loop antennas 2215*a* and 2215*b*. Under normal conditions, and especially in "sleep" mode, electronic switch 2217 is open to minimize power consumption. When loop antennas 2215*a* and 2215*b* become activated by the transmitted electromagnetic microwave field, a voltage is induced into loop antennas 2215*a* and 2215*b* and as a result a current flows through the antennas. However, diode 2219 only allows current to flow in one direction. This non-linearity eliminates induced current at fundamental frequency F and generates a current with the fundamental frequency of 2F. During this time, the microwave cavity 2262 is also used as a receiver and is connected to receiver amplifier 2282 that is tuned at 2F.

Figure 23:
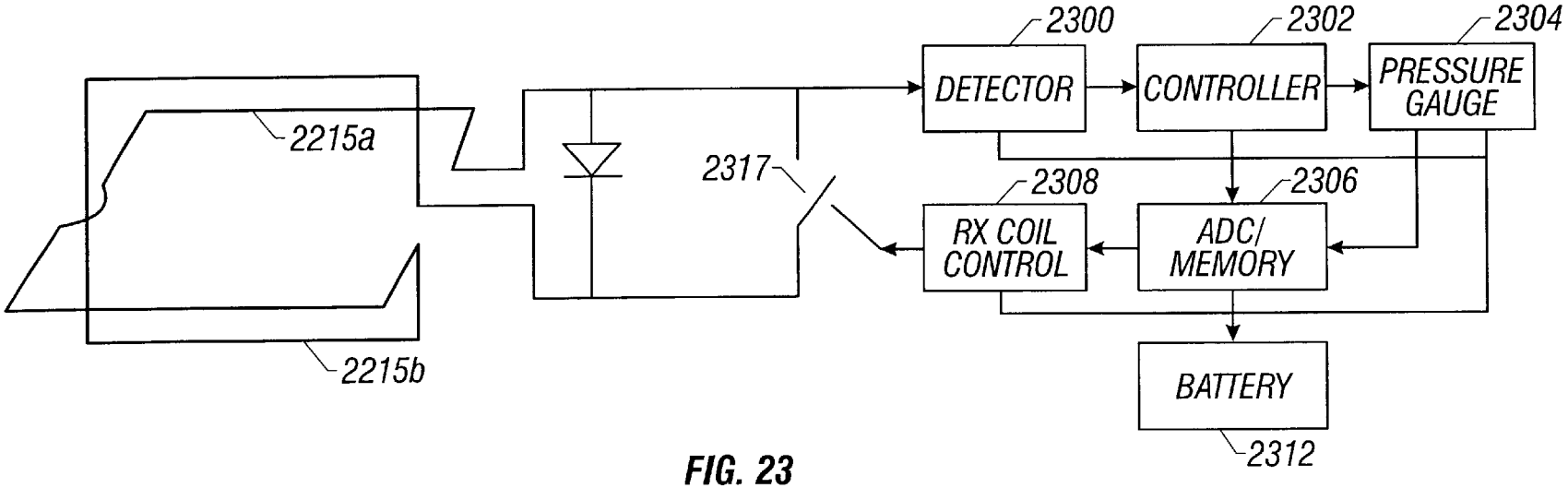
FIG. 23 is a block diagram of the remote sensing unit electronics.

More specifically, and with reference now to FIG. 23, when a signal is detected by the remote sensing unit detector circuit 2300 tuned at 2F which exceeds a fixed threshold, remote sensing unit 524 goes from a sleep state to an active state. Its electronics are switched into acquisition and transmission mode and controller 2302 is triggered. Following the command of controller 2302, pressure information detected by pressure gage 2304, or other information detected by suitable detectors, is converted into a digital form and is stored by the analog-to-digital converter (ADC) memory circuit 2306. Controller 2302 then triggers the transmission sequence by converting the pressure gage digital information into a serial digital signal inducing the switching on and off of switch 2317 by means of a receiver coil control circuit 2308.

Referring again to FIG. 10, various schemes for data transmission are possible. For illustration purposes, a Pulse Width Modulation Transmission scheme is shown in FIG. 10. A transmission sequence starts by sending a synchronization pattern through the switching off and on of switch 2317 during a predetermined time, Ts. Bit 1 and 0 correspond to a similar pattern, but with a different "on/off" time sequence (T1 and T0). The signal scattered back by the remote sensing unit at 2F is only emitted when switch 2317 is off. As a result, some unique time patterns are received and decoded by the digital decoder 2210 in the tool electronics shown on FIG. 22. These patterns are shown under reference numerals 1088, 1090, and 1092 in FIG. 10. Pattern 1088 is interpreted as a synchronization command; 1090 as Bit 1; and 1092 as Bit 0.

After the pressure gage or other digital information has been detected and stored in the data receiver electronics, the tool power transmitter is shut off. The target remote sensing unit is no longer energized and is switched back to its "sleep" mode until the next acquisition is initiated by the data receiver tool. A small battery 2312 located inside the remote sensing unit powers the associated electronics during acquisition and transmission.

Figure 24:
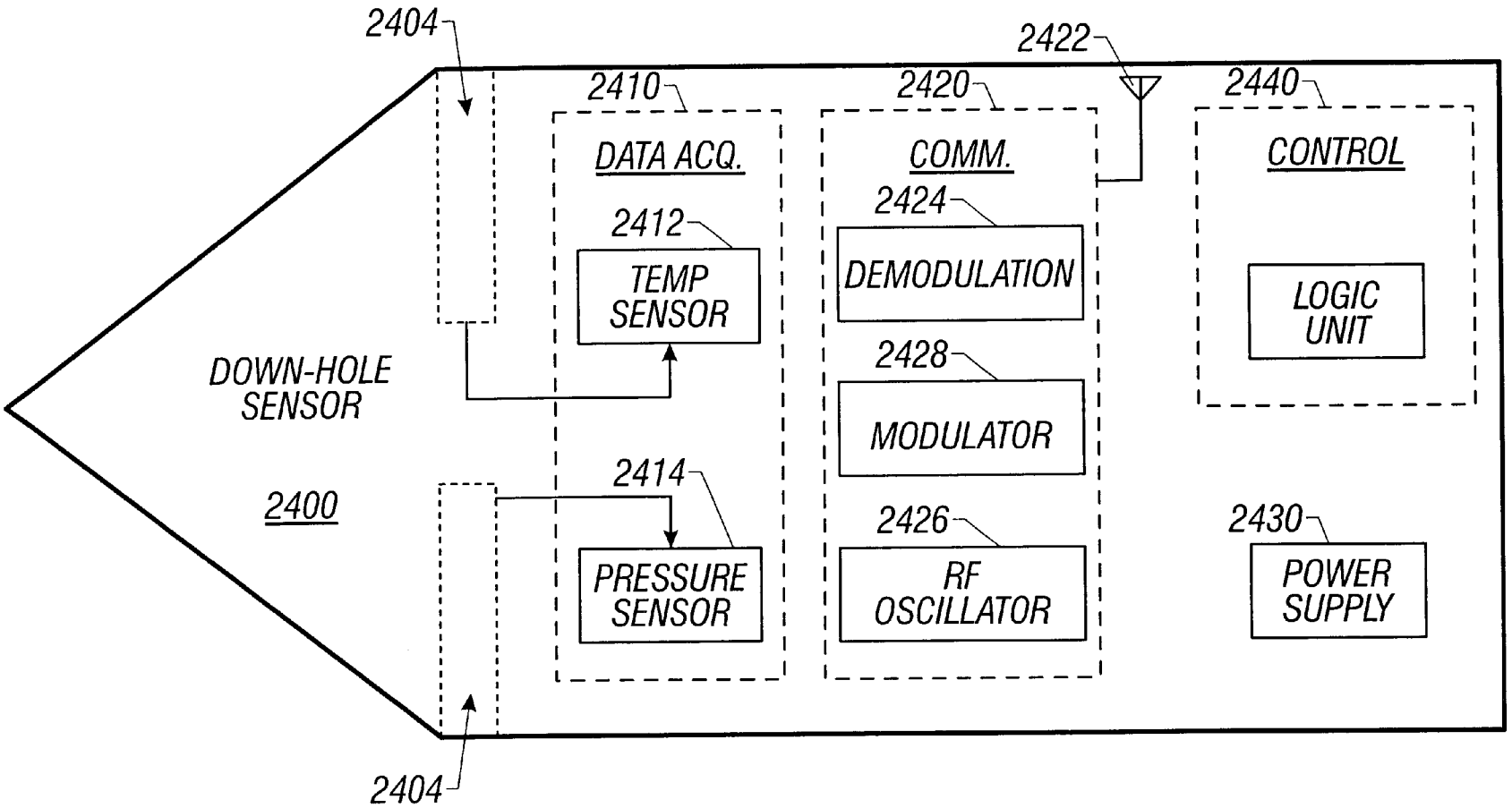
FIG. 24 is a functional block diagram of a downhole subsurface formation remote sensing unit according to a preferred embodiment of the invention.

FIG. 24 is a functional block diagram of a remote sensing unit for obtaining subsurface formation data according to a preferred embodiment of the invention. Referring now to FIG. 24, a remote sensing unit 2400 includes at least one fluid port shown generally at 2404 for fluidly communicating with a subsurface formation in which the remote sensing unit 2400 has been inserted. The remote sensing unit 2400 further includes data acquisition circuitry 2410 for taking samples of formation characteristics.

In the described embodiment, the data acquisition circuitry 2410 includes temperature sampling circuitry 2412 for determining the temperature of the subsurface formation and pressure sampling circuitry 2414 for determining the fluid pressure of the subsurface formation. Such temperature and pressure sampling circuitry 2412 and 2414 are well known. In alternate embodiments of the invention, the downhole subsurface formation remote sensing unit 2400 data acquisition circuitry 2410 may include only one of the temperature or pressure sampling circuitry 2412 or 2414, respectively, or may include an alternate type of data sampling circuitry. What data sampling circuitry is included is dependant upon design choices and all variations are specifically included herein.

Remote sensing unit 2400 also includes communication circuitry 2420. In the described embodiment of the invention, the communication circuitry 2420 transceives electromagnetic signals via an antenna 2422 Communication circuitry 2420 includes a demodulator 2424 coupled to receive and demodulate communication signals received on antenna 2422, an RF oscillator 2426 for defining the frequency transmission characteristics of a transmitted signal, and a modulator 2428 coupled to the RF oscillator 2426 and to the antenna 2422 for transmitting modulated data signals having a frequency characteristic determined by the RF oscillator 2426.

While the described embodiment of remote sensing unit 2400 includes demodulation circuitry for receiving and interpreting control commands from an external transceiver, an alternate embodiment of remote sensing unit 2400 does not include such a demodulator. The alternate embodiment merely includes logic to transmit all types of remote sensing unit data acquisition data whenever the remote sensing unit is in a data sampling and transmitting mode of operation. More specifically, when a power supply 2430 of the remote sensing unit 2400 has sufficient charge and there is data to be transmitted and RF power is not being received from an external source, the communication circuitry merely transmits acquired subsurface formation data.

As may be seen from examining FIG. 24, the downhole subsurface formation remote sensing unit 2400 further includes a controller 2440 for containing operating logic of the remote sensing unit 2400 and for controlling the circuitry within the remote sensing unit 2400 responsive to operational mode in relation to the stored program logic within controller 2440.

Those skilled in the art will appreciate that, once remote sensing units have been deployed into the well-bore formation and have provided data acquisition capabilities through measurements such as pressure measurements while drilling in an open well-bore, it will be desirable to continue using the remote sensing units after casing has been installed into the wellbore. The invention disclosed herein describes a method and apparatus for communicating with the remote sensing units behind the casing, permitting such remote sensing units to be used for continued monitoring of formation parameters such as pressure, temperature, and permeability during production of the well.

It will be further appreciated by those skilled in the art that the most common use of the present invention will likely be within 8½ inch well-bores in association with 6¾ inch drill collars. For optimization and ensured success in the deployment of remote sensing units 2400, several interrelating parameters must be modeled and evaluated. These include: formation penetration resistance versus required formation penetration depth; deployment "gun" system parameters and requirements versus available space in the drill collar; remote sensing unit ("bullet") velocity versus impact deceleration; and others.

Many well-bores are smaller than or equal to 8½ inches in diameter. For well-bores larger than 8½ inches, larger remote sensing units can be utilized in the deployment system, particularly at shallower depths where the penetration resistance of the formation is reduced. Thus, it is conceivable that for well-bore sizes above 8½ inches, that remote sensing units will: be larger in size; accommodate more electrical features; be capable of communication at a greater distance from the well-bore; be capable of performing multiple measurements, such as resistivity, nuclear magnetic resonance probe, accelerometer functions; and be capable of acting as data relay stations for remote sensing units located even further from the well-bore.

However, it is contemplated that future development of miniaturized components will likely reduce or eliminate such limitations related to well-bore size.

Figure 25:
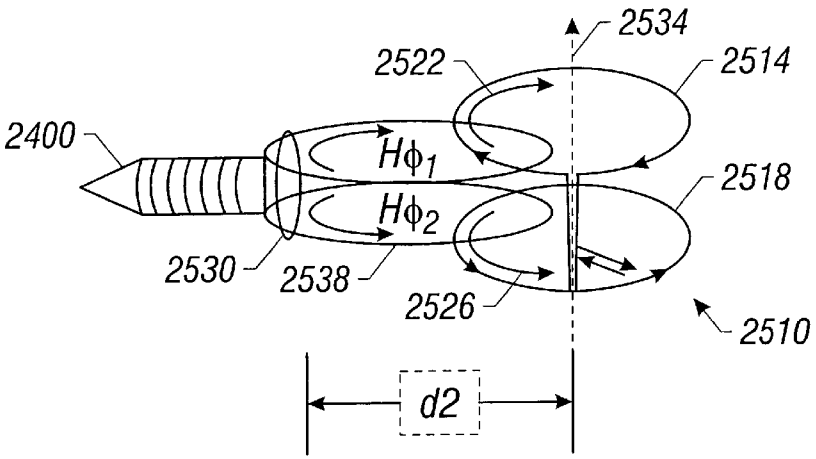
FIG. 25 is a functional diagram illustrating an antenna arrangement to according to a preferred embodiment of the invention.

FIG. 25 is a functional diagram illustrating an antenna arrangement according to one embodiment of the invention. In general, it is preferred that an antenna for communicating with a remote sensing unit 2400 be able to communicate regardless of the roll angle of the remote sensing unit 2400 or of the rotation of the tool carrying the antenna for communicating with the remote sensing unit 2400. Stated differently, a tool antenna will preferably be rotationally invariant about the vertical axis of the tool as its rotational positioning can vary as the tool is lowered into a well bore. Similarly, the remote sensing unit 2400 will preferably be rotationally invariant since its roll angle is difficult to control during its placement into a subsurface formation.

Referring now to FIG. 25, a tool antenna system 2510 that is rotationally invariant with respect to the tool roll angle includes a first antenna portion 2514 that is separated from a second antenna portion 2518 by a distance characterized as d1. First antenna portion 2514 is connected to transceiver circuitry (not shown) that conducts current in the direction represented by curved line 2522. The current in the second antenna portion 2518 is conducted in the opposite direction represented by curved line 2526. The described combination and operation produces magnetic field components that propagate radially from antenna coils 2514 and 2518 to antenna 2530.

Antenna 2530 is arranged in a plane that is substantially perpendicular compared with the planes defined by antennas 2514 and 2518. Antenna 2530 represents a coil antenna of a remote sensing unit 2400. While antenna 2530 is illustrated as a single coil, it is understood that the diagram is merely illustrative of a plurality of coils about a core and that the location of antenna 2530 is a representative location of the coils of the antenna of the remote sensing unit 2400. As may also be seen, antenna 2530 is separated from a vertical axis 2534 passing through the radial center of antennas 2514 and 2518 by a distance d2. Generally speaking, it is desirable for distance d2 to be less than twice the distance d1. Accordingly, antennas 2514 and 2518 are formed to be separated by a distance d1 that is roughly greater than or equal to the expected distance d2.

Moreover, for optimal communication signal and power transfer from antennas 2514 and 2518, antenna 2530 of the remote sensing unit should be placed equidistant from antennas 2514 and 2518. The reason for this is that the electromagnetically transmitted signals are strongest in the plane that is coplanar and equidistant from antennas 2514 and 2518. The principle that the highest transmission power occurs an equidistant coplanar plane is illustrated by the loops shown generally at 2538. $H_{\phi 1}$ is the magnetic field generated by antenna 2514; $H_{\phi 2}$ is the magnetic field generated by antenna 2518. In this configuration an optimal zone for coupling the antenna coils 2514 and 2518 to antenna coil 2530 exists when d2 is less than or equal to d1. Once d2 exceeds d1, the coupling between the antenna coils 2514 and 2518 and antenna coil 2530 drops of rapidly.

The antennas 2514, 2518 and 2530 of the preferred embodiment are constructed to include windings about a ferrite core. The ferrite core enhances the electromagnetic radiation from the antennas. More specifically, the ferrite improves the sensitivity of the antennas by a factor of 2 to 3 by reducing the magnetic reluctance of the flux path through the coil.

The described antenna arrangement is similar to a Helmholtz coil in that it includes a pair of antenna elements arranged in a planarly parallel fashion. Contrary to Helmholtz coil arrangements, however, the current in each antenna portion is conducted in opposite directions. While only two antennas are described herein, alternate embodiments include having multiple antenna turns. In these alternate embodiments, however, the multiple antenna turns are formed in even pairs that are axially separated.

Figure 26:
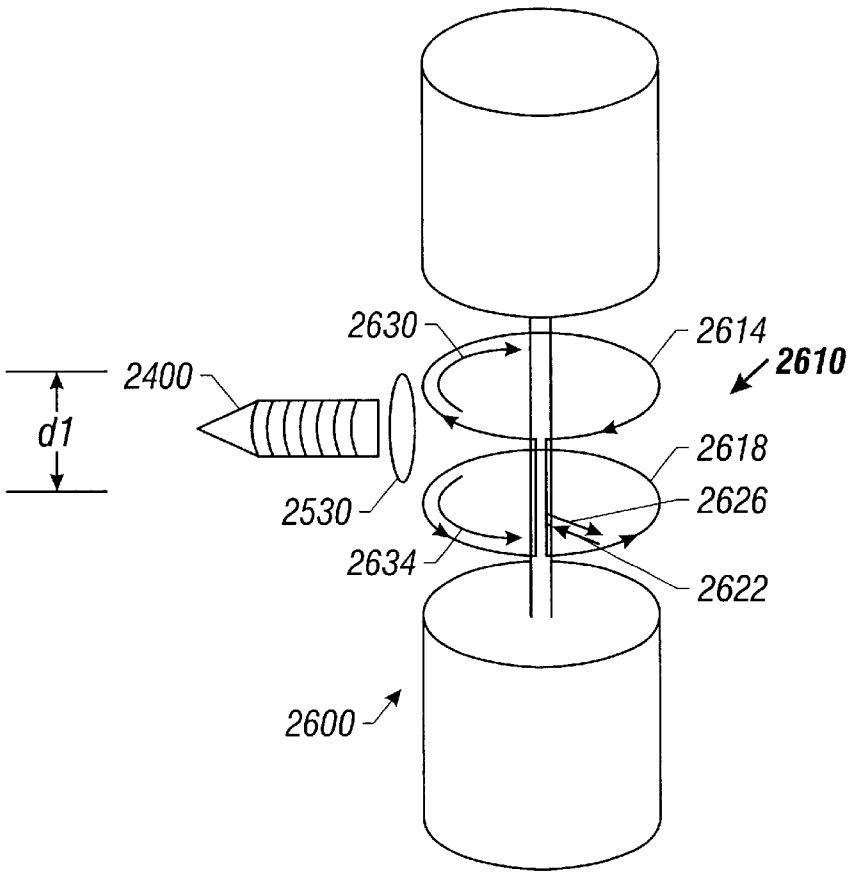
FIG. 26 is a functional diagram of a wireline tool including an antenna arrangement according to a preferred embodiment of the invention.

FIG. 26 is a schematic of a wireline tool including an antenna arrangement according to another embodiment of the invention. It may be seen that a wireline tool 2600 includes an antenna for communicating with remote sensing unit 254 or 2400 (hereinafter, "2400"). The antenna includes one conductive element shown generally at 2610 shaped to form two planarly parallel coils 2614 and 2618. Current is input into the antenna at 2622 and is output at 2626. The current is conducted around coil 2614 in direction 2630 and around coil 2618 in direction 2634. As may be seen, directions 2630 and 2634 are opposite thereby creating the previously described desirable electromagnetic propagation effects.

Continuing to examine FIG. 26, an antenna coil 2530 of remote sensing unit 2400 is placed in an approximately optimal position relative to the wireline tool 2600, and, more specifically, relative to antenna 2610. It is understood, of course, that wireline tool 2600 is lowered into the well-bore to a specified depth wherein the specified depth is one that places the remote sensing unit in an approximately optimal position relative to the antenna 2610 of the wireline tool 2600.

Figure 27:
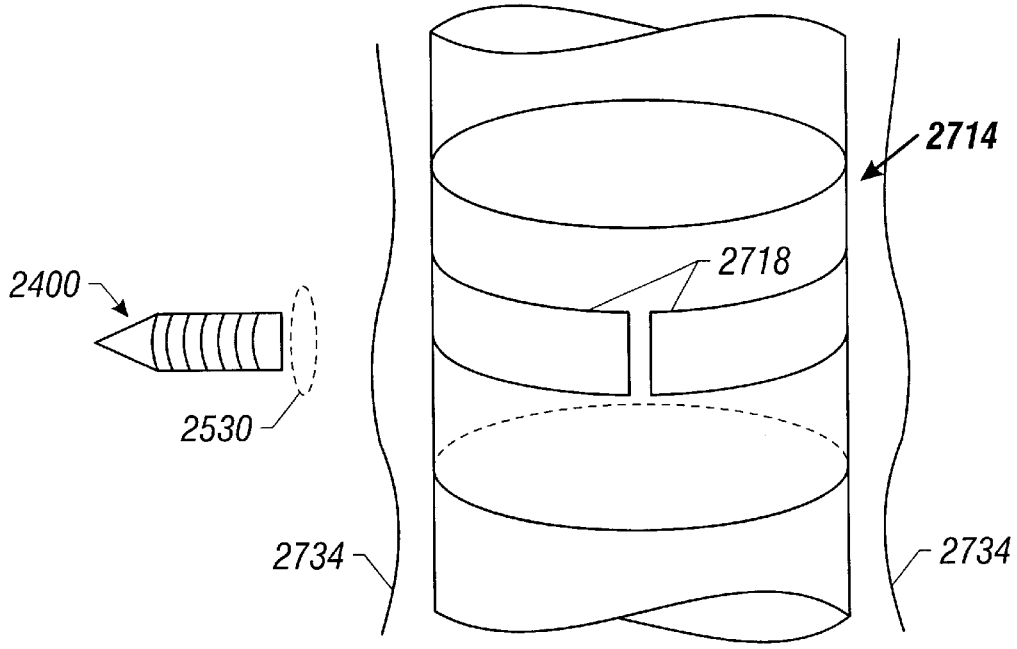
FIG. 27 is a functional diagram of a logging tool and an integrally formed antenna within a well-bore according to one aspect of the described invention.
Figure 27A:
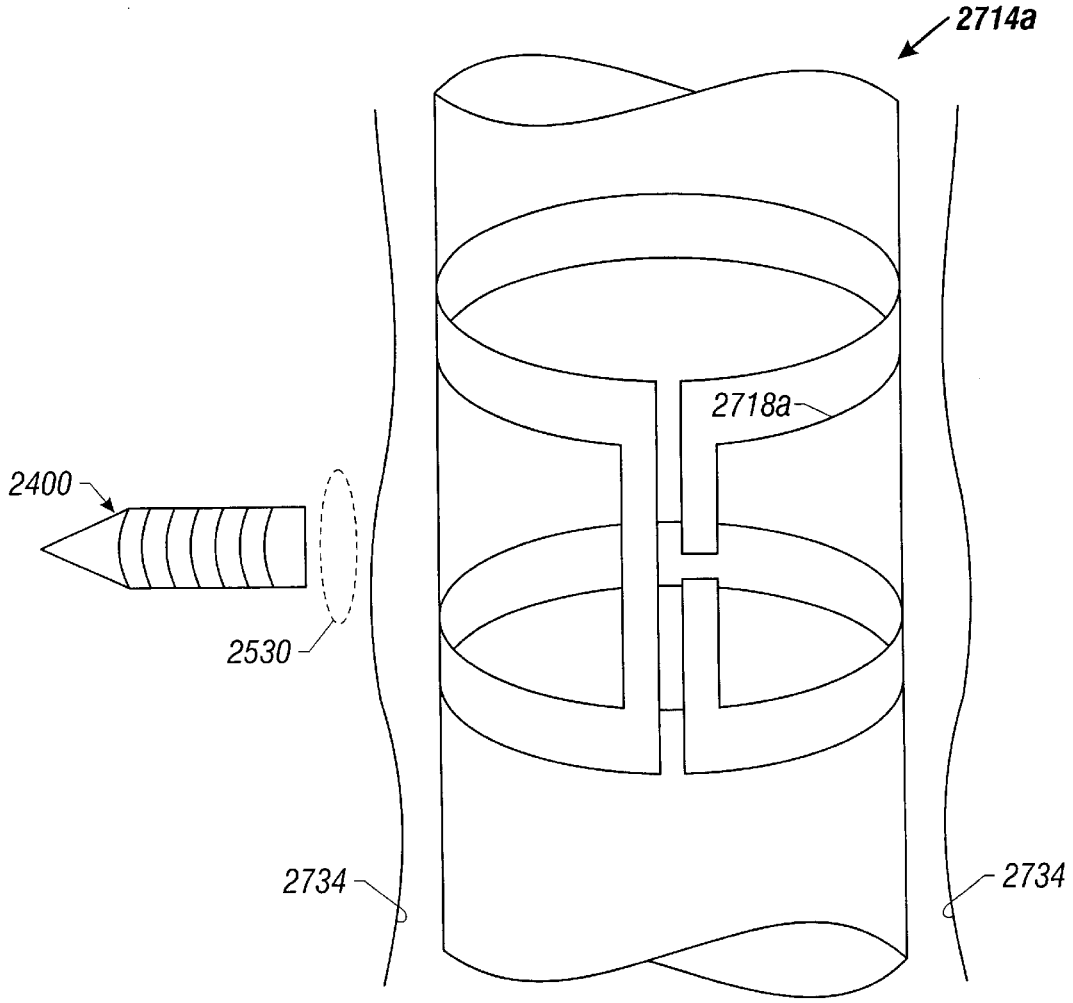
FIG. 27A is a functional diagram of an alternative logging tool and an integrally formed antenna within a well-bore according to one aspect of the described invention.

FIG. 27 is a perspective view of a logging tool and an integrally formed antenna within a well-bore according to another aspect of the described invention. Referring now to FIG. 27, a tool with an integrally formed antenna is shown generally at 2714 and includes an integrally formed antenna 2718 for communication with a remote sensing unit 2400. The tool may be, by way of example, a logging tool, a wireline tool or a drilling tool. As may be seen, remote sensing unit 2400 includes a plurality of antenna windings formed about a core. In the preferred embodiment, the core is a ferrite core. An alternative embodiment to antenna 2718 is shown in FIG. 27A as antenna 2718*a* of tool 2714*a*.

The antenna formed by the ferrite core and the windings is functionally illustrated by a dashed line 2530 that represents the antenna. Antenna 2530 functionally illustrates that it is to be oriented perpendicularly to antenna 2718 to efficiently receive electromagnetic radiation therefrom. As may also be seen, antenna 2530 is approximately equidistant from the plurality of coils of antenna 2718 of the tool 2714. As is described in further detail elsewhere in this application, tool 2714 is lowered to a depth within well-bore 2734 to optimize communications with and power transfer to remote sensing unit 2400. This optimum depth is one that results in antenna 2530 being approximately equidistant from the coils of antenna 2718.

Figure 28:
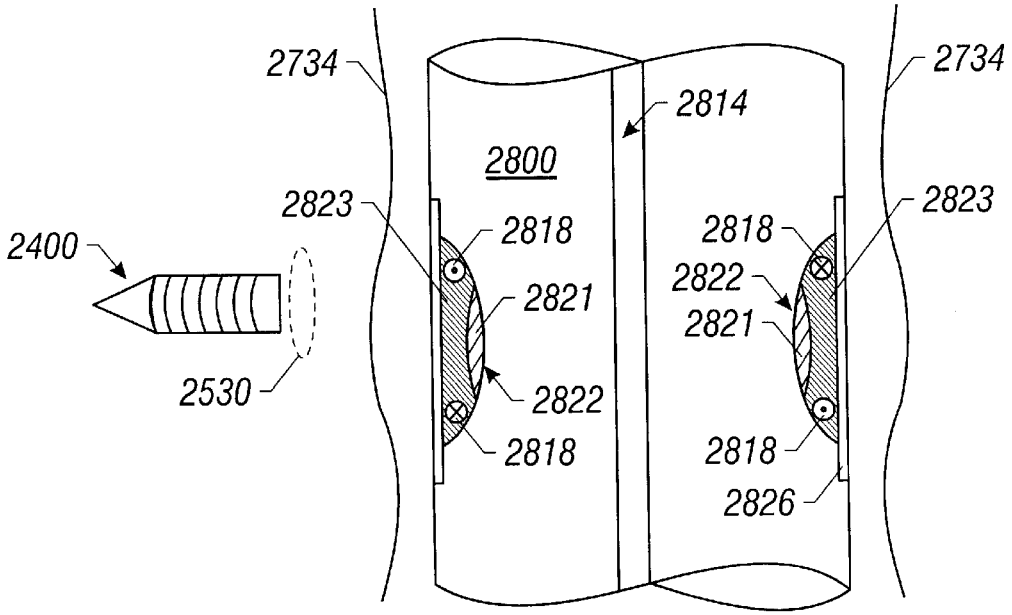
FIG. 28 is a functional diagram of a drill collar including an integrally formed antenna for communicating with a remote sensing unit.

FIG. 28 is a schematic of another embodiment of the invention in the form of a drill collar including an integrally formed antenna for communicating with a remote sensing unit 2400. Referring now to FIG. 28, a drill collar 2800 includes a mud channel shown generally at 2814 for conducting "mud" during drilling operations as is known by those skilled in the art. Such mud channels are commonly found in drill collars. Additionally, drill collar 2800 includes an antenna 2818 that is similar to the previously described tool antennas including antennas 2510, 2610 and 2718.

In the embodiment of the invention shown here in FIG. 28, the coil windings of antenna 2818 are wound or formed over a ferrite core. Additionally, as may be seen, antenna 2818 is located within a recess 2822 partially filled with ferrite 2821 and partially filled with insulative potting 2823. As with the ferrite core, having a partially-filled ferrite recess 2822 improves the transmission and reception of communication signals and also the transmission of power signals to power the remote sensing unit.

Continuing to refer to FIG. 28, an insulating and nonmagnetic cover or shield 2826 is formed over the recess 2822. In general, cover 2826 is provided for containing and protecting the antenna windings 2818 and the ferrite and potting materials in recess 2822. Cover 2826 must be made of a material that allows it to pass electromagnetic signals transmitted by antenna 2818 and by the remote sensing unit antenna 2730. In summary, cover 2826 should be nonconductive, nonmagnetic and abrasion and impact resistant. In the described embodiment, cover 2826 is formed of high strength ceramic tiles.

While the described embodiment of FIG. 28 is that of a drill collar with an integrally formed antenna 2818, the structure of the tool and the manner in which it houses antenna 2818 may be duplicated in other types of downhole tools. By way of example, the structure of FIG. 28 may readily be duplicated in a logging while drilling tool. Elements of a tool and an integrally formed antenna in the preferred embodiment of the invention include the antenna being integrally formed within the tool so that the exterior surface of the tool remains flush. Additionally, the antenna 2818 of the tool is protected by a cover that allows electromagnetic radiation to pass through it. Finally, the antenna configuration is one that generally includes the configuration described in relation to FIG. 25. Specifically, the antenna configuration includes at least two planar antenna portions formed to conduct current in opposite directions.

Figure 29:
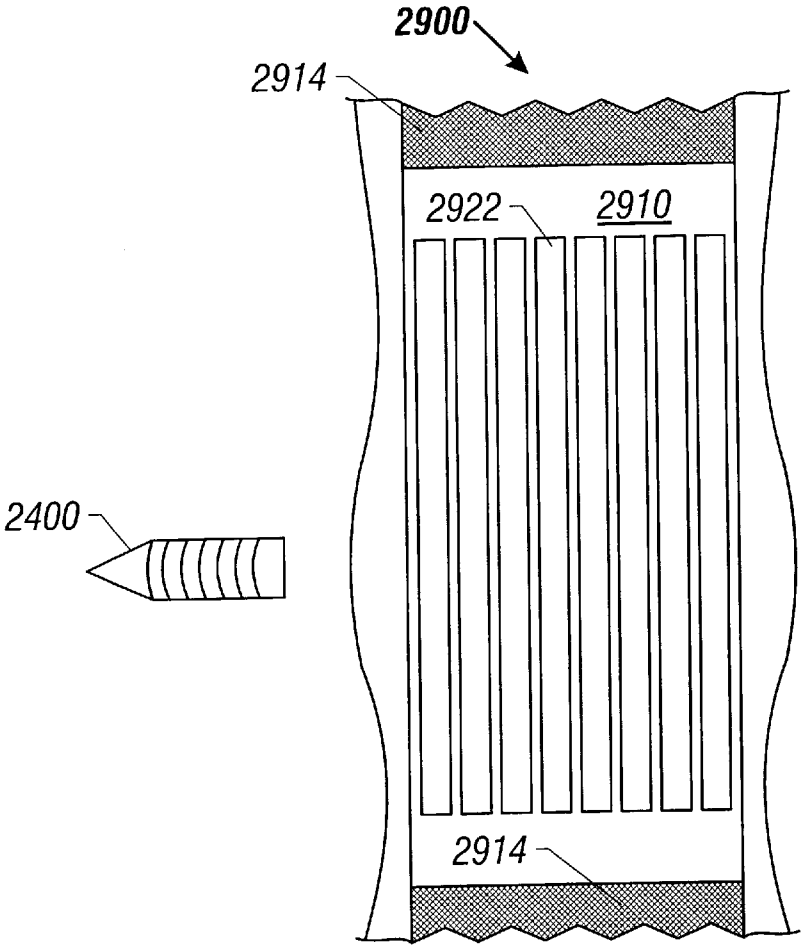
FIG. 29 is a functional diagram of a slotted casing section formed between two standard casing portions for allowing transmissions between a wireline tool and a remote sensing unit according to a preferred embodiment of the invention.

FIG. 29 is a schematic of a slotted casing section formed between two standard casing portions for allowing transmissions between a wireline tool and a remote sensing unit according to another embodiment of the invention. Referring now to FIG. 29, a casing within a cemented well-bore is shown generally at 2900. Casing 2900 includes a short slotted casing section 2910 that is integrally formed between two standard casing sections 2914. A remote sensing unit 2400 is shown proximate to the slotted casing section 2910.

Ordinarily, remote sensing units 2400 will be deployed during open hole drilling operations. After drilling operations, however, the well-bore is ordinarily cased and cemented. Because casing is typically formed of a metal, high frequency electromagnetic radiation cannot be transmitted through the casing. Accordingly, the casing according to the present invention employs at least one casing section or joint to allow a wireline tool within the casing to communicate with a remote sensing unit through a wireless electromagnetic medium.

Casing section 2910 includes at least one electromagnetic window 2922 formed of an insulative material that can pass electromagnetic signals. The at least one electromagnetic window 2922 is formed within a "short" casing joint (12 feet in the described embodiment). The non-conductive or insulative material from which the at least one window, is formed, in the described embodiment, out of an epoxy compound combined with carbon fibers (for added strength) or of a fiberglass. Experiments show that electromagnetic signals may be successfully transmitted from within a metal casing to an external receiver if the casing includes at least one non-conductive window.

In the embodiment of FIG. 29, the at least one electromagnetic window 2922 is rectangular in shape. Many different shapes and configurations for electromagnetic windows may be used, however. Moreover, the embodiment of FIG. 29 includes a plurality of rectangular windows 2922 formed all around casing section 2910 to substantially circumscribe it. By having electromagnetic windows 2922 all around the casing section 2910, the problem of having to properly align the casing section 2910 with a remote sensing unit 2400 is avoided. Stated differently, the embodiment of FIG. 29 results in a casing section that is rotationally invariant relative to the remote sensing unit. In an alternate embodiment, however, at least one electromagnetic window is placed on only one side of the casing thereby requiring careful placement of the casing in relation to the remote sensing unit.

Figure 30:
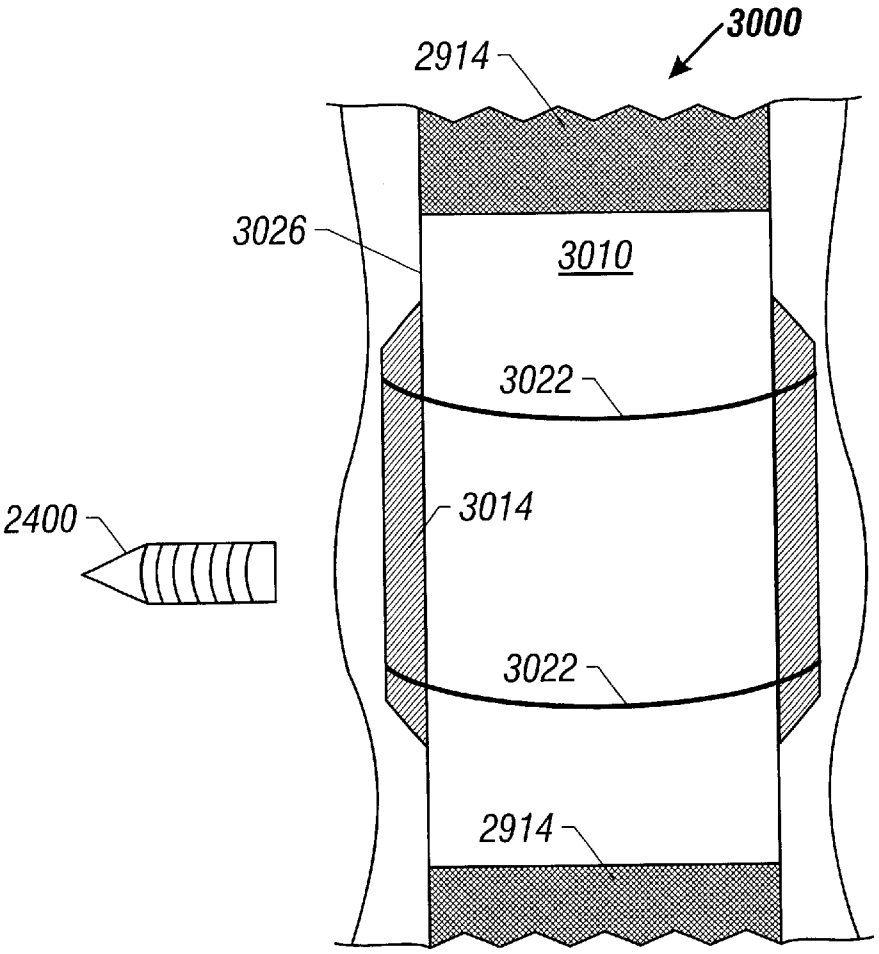
FIG. 30 is a functional diagram of a casing section having a communication module formed between two standard casing portions for communicating with a remote sensing unit according to an alternate embodiment of the invention.

FIG. 30 is a schematic view of a casing section having a communication module formed between two standard casing portions for communicating with a remote sensing unit according to another alternate embodiment of the invention. A casing section 3010 is formed between two casing sections 2914. Casing section 3010 includes a communication module 3014 for communication with a remote sensing unit 2400. Communication module 3014 includes a pair of horizontal antenna sections 3022 for transmitting and receiving communication signals to and from remote sensing unit 2400. Antenna sections 3022 also are for transmitting power to remote sensing unit 2400.

The embodiment of FIG. 30 also includes a wiring bundle 3026 attached to the exterior of the casing sections 2914 and 3010 for transmitting power from a ground surface power source to the communication module. Additionally, wiring bundle 3026 is for transmitting communication signals between a ground surface communication device and the communication module 3014. Wiring bundle 3026 may be formed in many different configurations. In one configuration, wiring bundle 3026 includes two power lines and two communication lines. In another configuration, wiring bundle 3026 includes only two lines wherein the power and communication signals are superimposed.

As may be seen, similar to other embodiments, casing section 3010 is positioned proximate to remote sensing unit 2400. Additionally, each of the antenna sections 3022 are approximately equidistant from the antenna (not shown) of remote sensing unit 2400. As with other antenna configurations, current is conducted in the antenna sections in opposite directions relative to each other.

Figure 31:
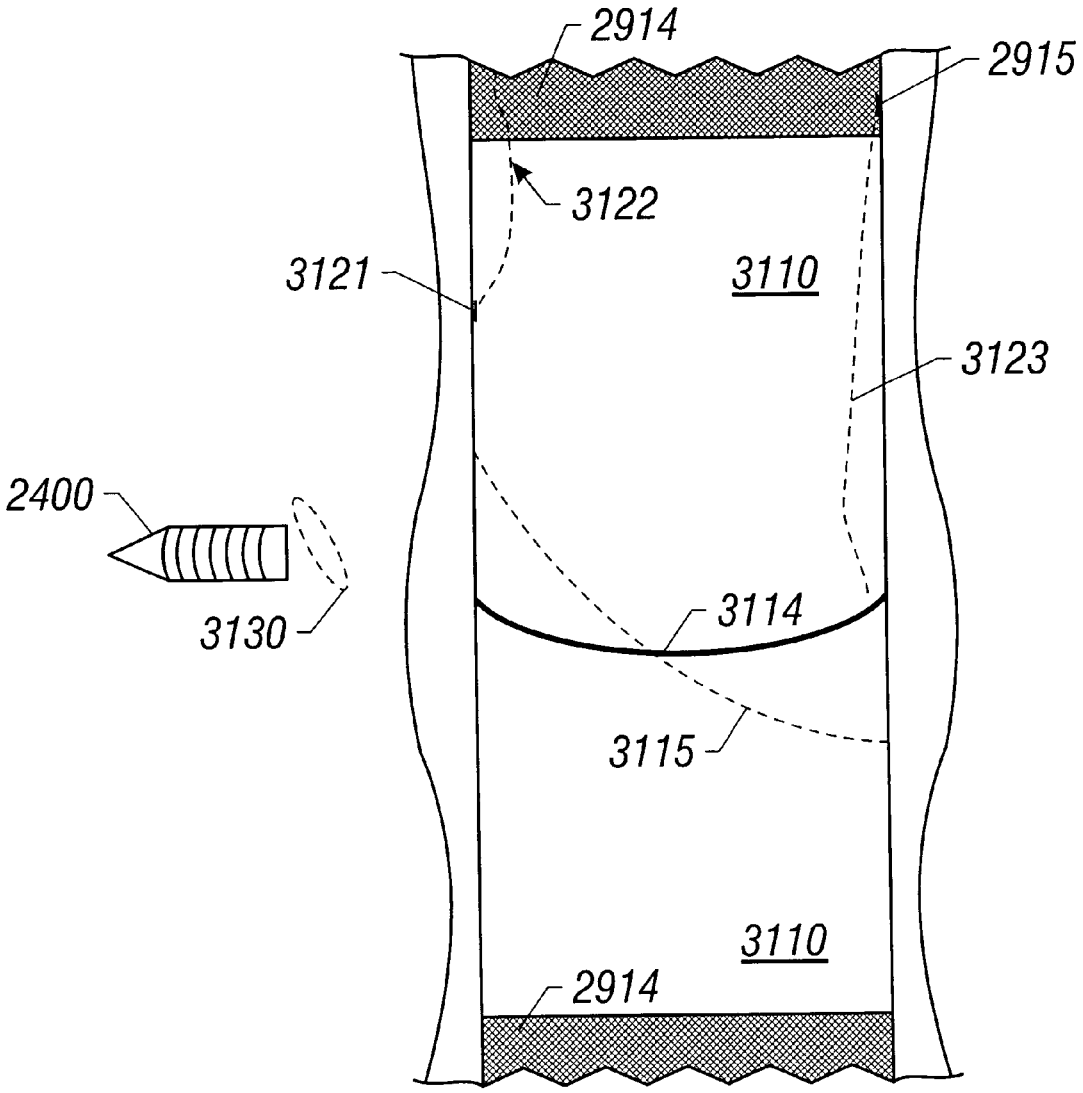
FIG. 31 is a frontal perspective view of a casing section having a communication module formed between two standard casing portions for communicating with a remote sensing unit according to an alternate embodiment of the invention.

FIG. 31 is a schematic view of a casing section having a communication module formed between two standard casing portions for communicating with a remote sensing unit according to an alternate embodiment of the invention. Referring now to FIG. 31, a casing section 3110 is formed between two casing sections 2914. Casing section 3110 includes an external coil 3114 for communicating with a remote sensing unit 2400. As may be seen, in this alternate embodiment, external coil 3114 is formed within a channel formed within casing section 3110 thereby allowing coil 3114 to be flush with the outer section of casing section 3110. The external casing coil may be inclined at angles between 0° and 90°, as indicated by the dotted line at 3115 which is inclined approximately 45°. Similarly, the coil 3130 of remote sensing unit 2400 may be inclined at angles between 0° and 90°.

Continuing to refer to FIG. 31, a wire 3122 is installed on the interior of casing 3114 and 2914 to conduct power and communication signals from the surface to the coil 3114. Wire 3122 is connected to casing section 3110 at 3121. Additionally, casing section 3110 is electrically insulated from casing sections 2914. Accordingly, power and communication signals are conducted from the surface down wiring 3122, and then down casing section 3110 to coil 3114. Coil 3114 then transmits power and communication signals to remote sensing unit 2400. Coil 3114 also is operable to receive communication signals from remote sensing unit 2400 and to transmit the communication signal up casing section 3110 and up wiring 3122 to the surface.

As may be seen, because there is only one wire 3122 for transmitting power and superimposed communication signals to the communication module 3014, the return path is established by a short lead 3123 connecting coil 3114 to casing section 2914 at 2915 above casing section 3110. This embodiment of the invention is not preferred, however, because of power transfer inefficiencies.

As may be seen, similar to other embodiments, casing section 3110 is formed proximate to remote sensing unit 2400. This embodiment of the invention, as may be seen from examining FIG. 31, is the only described embodiment that does not include at least a pair of planarly parallel antenna sections for generating electromagnetic signals for transmission to the remote sensing unit 2400. While most of the described embodiments include at least one pair of antenna sections, this embodiment illustrates that other antenna configurations may be used for delivering power to and for communicating with the remote sensing unit 2400.

Figure 32:
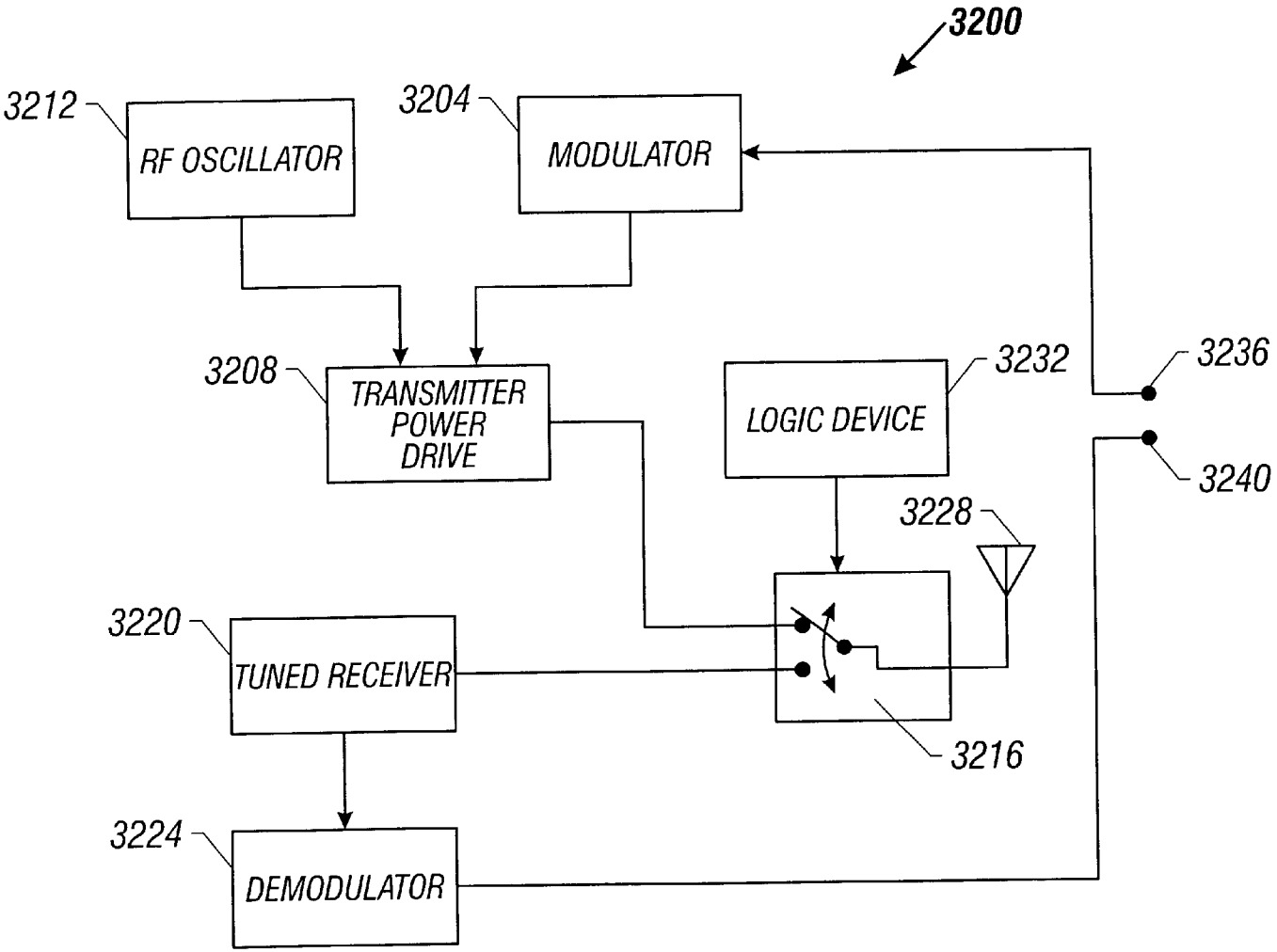
FIG. 32 is a functional block diagram illustrating a system for transmitting superimposed power and communication signals to a remote sensing unit and for receiving communication signals from the remote sensing unit according to a preferred embodiment of the invention.

FIG. 32 is a functional block diagram illustrating a system for transmitting superimposed power and communication signals to a remote sensing unit and for receiving communication signals from the remote sensing unit according to one embodiment of the invention. Referring now to FIG. 32, a power and communication signal transceiver system 3200 includes a modulator 3204 for receiving communication signals that are to be transmitted to a remote sensing unit, by way of example, to remote sensing unit 2400. Modulator 3204 is connected to transmit modulated signals to a transmitter power drive 3208. An RF oscillator 3212 is connected to produce carrier frequency signal components to transmitter power drive 3208. Transmitter power drive 3208 is operable, therefore, to produce a modulated signal having a specified frequency characteristic according to the signals received from modulator 3204 and RF oscillator 3212.

The output of transmitter power drive 3208 is connected to a first port of a switch 3216. A second port of switch 3216 is connected to an input of a tuned receiver 3220. Tuned receiver 3220 includes an output connected to a demodulator 3224. A third port of switch 3216 is connected to an antenna 3228 that is provided for communicating with and delivering power to remote sensing unit 2400. Switch 3216 also includes a control port for receiving a control signal from a logic device 3232. Logic device 3232 generates control signals to switch 3216 to prompt switch 3216 to switch into one of a plurality of switch positions. In the described embodiment, a control signal having a first state that causes switch 3216 to connect transmitter power drive 3208 to antenna 3228. A control signal having a second state causes switch 3216 to connect tuned receiver 3220 to antenna 3228. Accordingly, logic device 3232 controls whether power and communication signal transceiver system 3200 is in a transmit or in a receive mode of operation. Finally, power and communication signal transceiver system 3200 includes an input port 3236 for receiving communication signals that are to be transmitted to the remote sensing unit 2400 and an output port 3240 for outputting demodulated signals received from remote sensing unit 2400.

Figure 33:
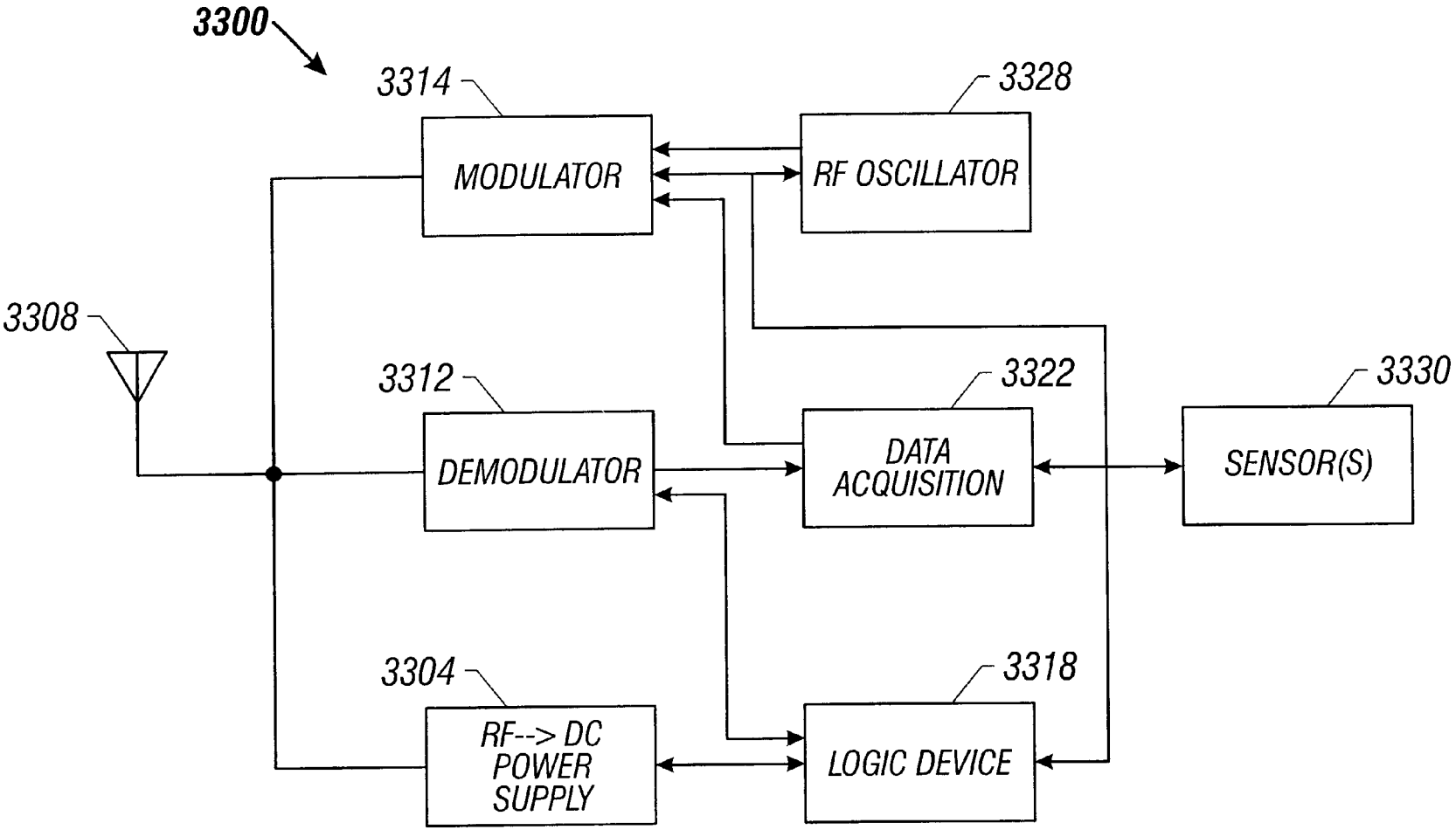
FIG. 33 is a functional block diagram illustrating a system within a remote sensing unit for receiving superimposed power and communication signals and for transmitting communication signals according to a preferred embodiment of the invention.

FIG. 33 is a functional block diagram illustrating a system within a remote sensing unit 2400 for receiving superimposed power and communication signals and for transmitting communication signals according to a preferred embodiment of the invention. Referring now to FIG. 33, a remote sensing unit communication system 3300 includes a power supply 3304 coupled to receive communication signals from antenna 3308. The power supply 3308 being adapted for converting the received RF signals to DC power to charge a capacitor to provide power to the circuitry of the remote sensing unit. Circuitry for converting an RF signal to a DC signal is well known in the art. The DC signal is then used to charge an internal power storage device. In the preferred embodiment, the internal power storage device is a capacitor. Accordingly, once a specified amount of charge is stored in the capacitor, it provides power for the remaining circuitry of the remote sensing unit. Once charge levels are reduced to a specified amount, the remote sensing unit mode of operation reverts to a power and communication signal receiving mode until specified charge levels are obtained again. Operation of the circuitry of the remote sensing unit in relation to stored power will be explained in greater detail below.

The circuitry of the remote sensing unit shown in FIG. 33 further includes a logic device 3318 that controls the operation of the remote sensing unit according to the power supply charge levels. While not specifically shown in FIG. 33, logic device 3318 is connected to each of the described circuits to control their operation. As may readily be understood by those skilled in the art, however, the control logic programmed into logic device 3318 may alternatively be distributed among the described circuits thereby avoiding the need for one central logic device.

Continuing to refer to FIG. 33, demodulator 3312 is coupled to transmit demodulated signals to data acquisition circuitry 3322 that is provided for interpreting communication signals received from an external transmitter at antenna 3308. Data acquisition circuitry 3322 also is connected to provide communication signals to modulator 3314 that are to be transmitted from antenna 3308 to an external communication device. Finally, RF oscillator 3328 is coupled to modulator 3314 to provide a specified carrier frequency for modulated signals that are transmitted from the remote sensing unit via antenna 3308.

In operation, signal received at antenna 3308 is converted from RF to DC to charge a capacitor within power supply 3304 in a manner that is known by those skilled in the art of power supplies. Once the capacitor is charged to a specified level, power supply 3304 provides power to demodulator 3312 and data acquisition circuitry 3322 to allow them to demodulate and interpret the communication signal received over antenna 3308. If, by way of example, the communication signal requests pressure information, data acquisition circuitry interprets the request for pressure information, acquires pressure data from one of a plurality of coupled sensors 3330, stores the acquired pressure data, and provides it to modulator 3314 so that the data can be transmitted over antenna 3308 to the remote system requesting the information.

While the foregoing description is for an overall process, the actual process may vary some. By way of example, if the charge levels of the power supply drop below a specified threshold before the modulator is through transmitting the requested pressure information, the logic device 3318 will cause transmission to cease and will cause the remote sensing unit to go back from a data acquisition and transmission mode of operation into a power acquisition mode of operation. Then, when specified charge levels are obtained again, the data acquisition and transmission resumes.

As previously discussed, the signals transmitted by a power and communication signal transceiver system 3200 include communication signals superimposed with a high power carrier signal. The high power carrier signal being for delivering power to the remote sensing unit to allow the remote sensing unit to charge an internal capacitor to provide power for its internal circuitry.

Power supply 3304 also is connected to provide power to a demodulator 3312, to a modulator 3314, to logic device 3318, to data acquisition circuitry 3322 and to RF Oscillator 3328. The connections for conducting power to these devices are not shown herein for simplicity. As may be seen, power supply 3304 is coupled to antenna 3308 through a switch 3318.

Figure 34:
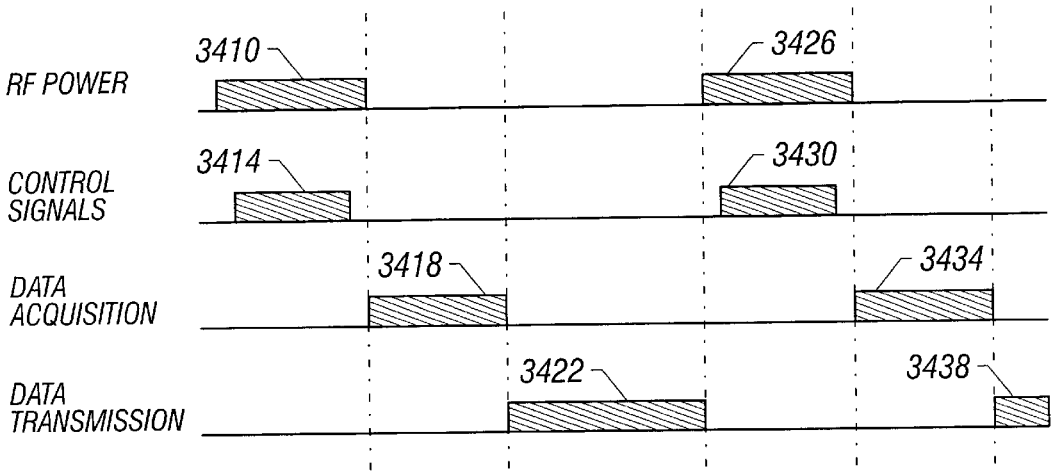
FIG. 34 is a timing diagram that illustrates operation of the remote sensing unit according to a preferred embodiment of the invention.

FIG. 34 is a timing diagram that illustrates operation of the remote sensing unit of FIG. 33. Referring now to FIG. 34, RF power is transmitted from an external source to the remote sensing unit for a time period 3410. During at least a portion of time period 3410, superimposed communication signals are transmitted from the external source to the remote sensing unit during a time period 3414. Once the RF power and the communication signals are no longer being transmitted, in other words, periods 3410 and 3414 are expired, the remote sensing unit responds by going into a data acquisition mode of operation for a time period 3418 to acquire a specified type of data or information.

Once the remote sensing unit has acquired the specified data or information, the remote sensing unit transmits communication signal back to the external source during time period 3422. As may be seen, once time period 3422 is expired, the external source resumes transmitting RF power for time period 3426. The termination of time period 3422 can be from one of several different situations. First, if the capacitor charge levels are reduced to specified charge levels, internal logic circuitry will cause the remote sensing unit to stop transmitting data and to go into a communication signal and RF power acquisition mode of operation so that the capacitor may be recharge. Once a remote sensing unit ceases transmitting communication signals, the external source resumes transmitting RF power and perhaps communication signals to the remote sensing unit so that it may recharge its capacitor.

A second reason that a remote sensing unit may cease transmitting thereby ending time period 3422 is that the external source may merely resume transmitting RF power. In this scenario, the remote sensing unit transitions into a communication signal and RF power acquisition mode of operation upon determining that the external source is transmitting RF power. Accordingly, there may actually be some overlap between time periods 3422 and the 3426.

A third reason a remote sensing unit may cease transmitting thereby ending timing period 3422 is that it has completed transmitting data it acquired during the data acquisition mode of operation. Finally, as may be seen, time periods 3430, 3434 and 3438 illustrate repeated transmission of control signals to the remote sensing unit, repeated data acquisition steps by the remote sensing unit, and repeated transmission of data by the remote sensing unit.

Figure 35:
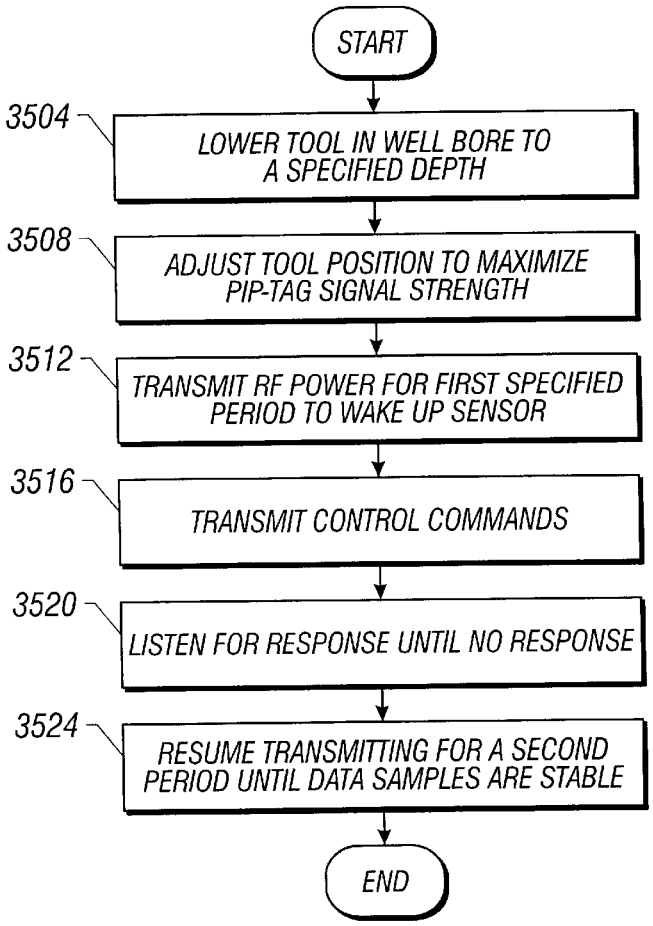
FIG. 35 is a flow chart illustrating a method for communicating with a remote sensing unit according to a preferred embodiment of the inventive method.

FIG. 35 is a flow chart illustrating a method for communicating with a remote sensing unit according to a preferred embodiment of the inventive method. Referring now to FIG. 35, the method shown therein assumes that a remote sensing unit has already been placed in a subsurface formation in the vicinity of a well bore. The first step is to lower a tool having a transceiver and an antenna into the well-bore to a specified depth (step 3504). Typically, subsurface formation radiation signatures are mapped during logging procedures. Additionally, once a remote sensing unit 2400 having a pip-tag emitting capability is deployed into the formation, the radioactive signatures of the formation as well as the remote sensing unit are logged. Accordingly, an identifiable signature that is detectable by downhole tools is mapped. A tool is lowered into the wellbore, therefore, until the identifiable signature is detected.

By way of example, the detected signature in the described embodiment is a gamma ray pip-tag signal emitted from a radioactive source within the remote sensing unit in addition to the radiation signals produced naturally in the subsurface formation. Thus, when the tool detects the signature, it transmits a signal to a ground based control unit indicating that the specified signature has been detected and that the tool is at the desired depth.

In the method illustrated herein, the well-bore can be either an open hole or a cased hole. The tool can be any known type of wireline tool modified to include transceiver circuitry and an antenna for communicating with a remote sensing unit. The tool can also be any known type of drilling tool including an MWD (measure while drilling tool). The primary requirement for the tool being that it preferably should be capable of transmitting and receiving wireless communication signals with a remote sensing unit and it preferably should be capable of transmitting an RF signal with sufficient strength to provide power to the remote sensing unit as will be described in greater detail below.

Once the tool has detected the specified signature, the tool position is adjusted to maximize the signature signal strength (step 3508). Presumably, maximum signal strength indicates that the position of the tool with relation to the remote sensing unit is optimal as described elsewhere herein.

Once the tool has been lowered to an optimal position, an RF power signal is transmitted from the tool to the remote sensing unit to cause to charge it capacitor and to "wake up" (step 3512). Typically, the transmitted signal must be of sufficient strength for 10 mW–50 mW of power to be delivered through inductive coupling to the remote sensing unit. By way of example, the RF signal might be transmitted for a period of one minute.

There are several different factors to consider that affect the amount of power that can be inductively delivered to the remote sensing unit. First, for formations having a resistivity ranging from 0.2 to 2000 ohms, a signal having a fixed frequency of 4.5 MHz typically is best for power transfer to the remote sensing unit. Accordingly, it is advantageous to transmit an RF signal that is substantially near the 4.5 MHz frequency range. In the preferred embodiment, the RF power is transmitted at a frequency of 2.0 MHz. The invention herein contemplates, however, transmitted RF power anywhere in the range of 1 MH to 50 MHz. This accounts for high-resistivity formations (>200 ohms), wherein the optimum RF transmission frequency would be greater than 4.5 MHz.

One reason that the described embodiment is operable to transmit the RF power at a 2.0 MHz frequency is that standard "off the shelf" equipment, for example, combined magnetic resonance systems and LWD resistivity tools, operate at the 2.0 MHz frequency. Additionally, a relatively simple antenna having only one or two coils is required to efficiently deliver power at the 2.0 MHz frequency. In contrast, a relatively complicated antenna structure must be used for RF transmissions in the 500 MHz frequency range. Also, at this frequency, power transfer is near optimum for low resistivity formations. As the transmission frequency is increased, efficiency in coupling is also increased. However, as the transmission frequency is increased, losses in the formation also increase, thereby limiting the distance at which data and power may be communicated to the remote sensor. At the transmission frequency of the embodiment, these factors are optimized to produce a maximum power transfer ratio.

In addition to transmitting RF power to the remote sensing unit, the tool also transmits control commands that are superimposed on the RF power signals (step 3516). One reason for superimposing the control commands and transmitting them while the RF power signal is being transmitted is simplicity and to reduce the required amount of time for communicating with and delivering power to the remote sensing unit. The control commands, in the described embodiment, merely indicate what formation parameters (e.g., temperature or pressure) are selected. As will be described below, the remote sensing unit then acquires sample measurements and transmits signals reflecting the measured samples responsive to the received control commands.

The control commands are superimposed on the RF power signal in a modulated format. While any known modulation scheme may be used, one that is used in the described embodiment is DPSK (differential phase shift keying). In DPSK modulation schemes, a phase shift is introduced into the carrier to represent a logic state. By way of example, the phase of a carrier frequency is shifted by 180° when transmitting a logic "1," and remains unchanged when transmitting a logic "0." Other modulation schemes that may be used include true amplitude modulation (AM), true frequency shift keying, pulse position and pulse width modulation.

Control signals are not always transmitted, however, while the RF power signals are being transmitted. Thus, only RF power is transmitted at times and, at other times, control signals superimposed upon the RF power signals are transmitted. Additionally, depending upon the charge levels of the remote sensing unit, only control signals may be transmitted during some periods.

Once RF power has been transmitted to the remote sensing unit for a specified amount of time, the tool ceases transmitting RF power and attempts to receive wireless communication signals from the remote sensing unit (step 3520). A typical specified amount of the time to wake up a remote sensing unit and to fully charge a charge storage device within the remote sensing unit is one minute. After RF power transmission are stopped, the tool continues to listen and receive communication signals until the remote sensing unit stops transmitting.

After the remote sensing unit stops transmitting, the tool transmits power signals for a second specified time period to recharge the capacitor within the remote sensing unit and then listens for additional transmissions from the remote sensing unit. A typical second period of time to charge the charge storage device within the remote sensing unit is significantly less than the first specified period of time that is required to "wake up" the remote sensing unit and to charge its capacitor. One reason is that a remote sensing unit stop transmitting to the tool whenever its charge is depleted by approximately 10 percent of being fully charged. Accordingly, to ensure that the charge on the capacitor is restored, a typical second specified period of time for transmitting RF power to the remote sensing unit is 15 seconds.

This process of charging and then listening is repeated until the communication signals transmitted by the remote sensing unit reflect data samples whose values are stable (step 3524). The reason the process is continued until stable data sample values are received is that it is likely that an awakened remote sensing unit may not initially transmit accurate data samples but that the samples will become accurate after some operation. It is understood that stable values means that the change of magnitude from one data sample to another is very small thereby indicating a constant reading within a specified error value.

Figure 36:
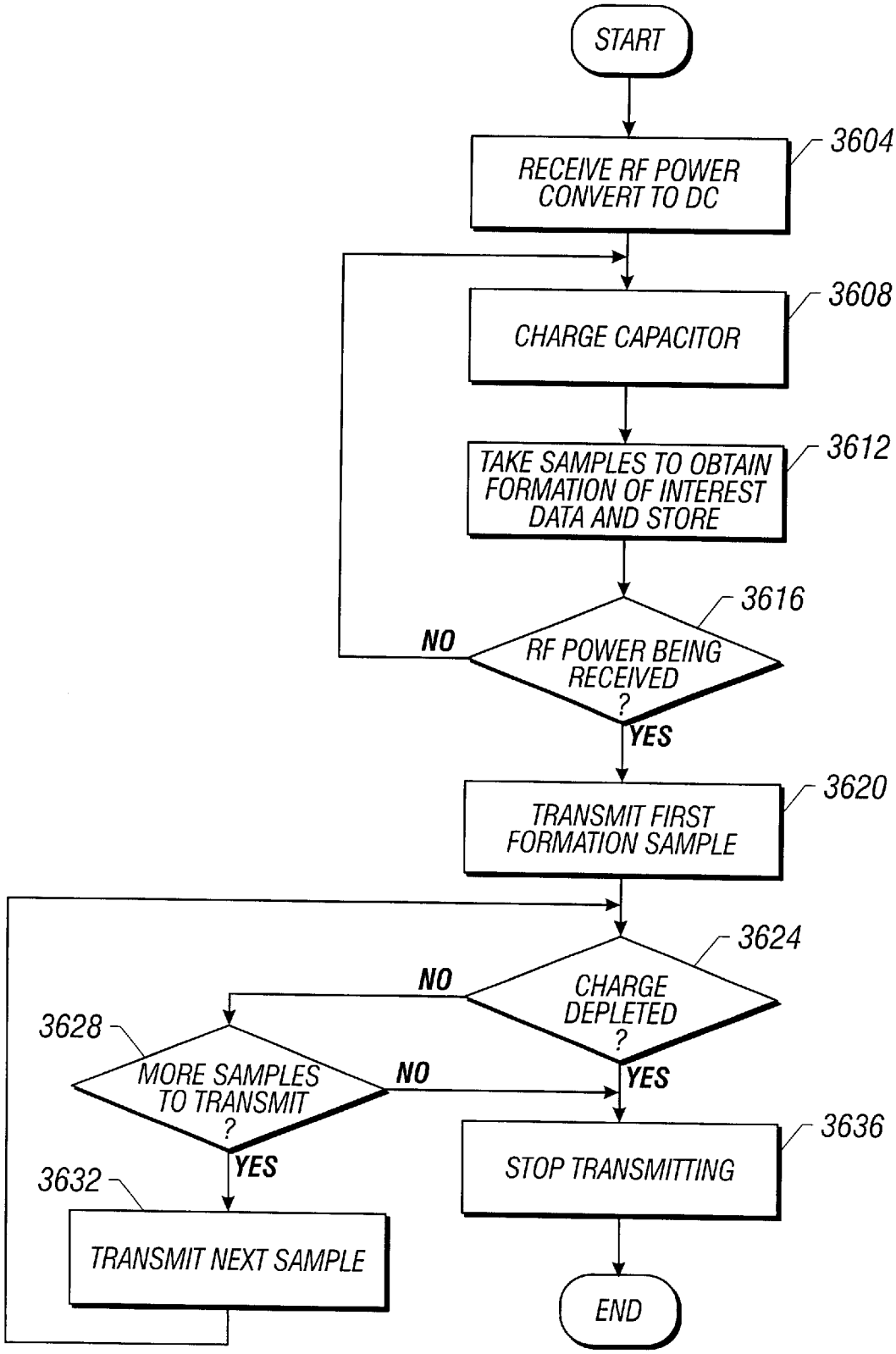
FIG. 36 is a flow chart illustrating a method within a remote sensing unit for communicating with a downhole communication unit according to a preferred embodiment of the inventive method.

FIG. 36 is a flow chart illustrating a method within a remote sensing unit for communicating with downhole communication unit according to a preferred embodiment of the inventive method. Referring now to FIG. 36, a "sleeping" remote sensing unit receives RF power from the tool and converts the received RF signal to DC (step 3604). The DC signal is then used to charge a charge storage device (step 3608). In the described embodiment, the charge storage device includes a capacitor. The charge storage device also includes, in an alternate embodiment, a battery. A battery is advantageous in that more power can be stored within the remote sensing unit thereby allowing it to transmit data for longer periods of time. A battery is disadvantageous, however, in that once discharged, the wake up time for a remote sensing unit may be significantly increased if the internal battery is a rechargeable type of battery. If it is not rechargeable, then internal circuitry must switch it out of electrical contact to prevent it from potentially becoming damaged and resultantly, damaging other circuit components.

Once the remote sensing unit has been "woken up" by the RF power being transmitted to it, the remote sensing unit begins sampling and storing data representative of measured subsurface formation characteristics (step 3612). In the described embodiment, the remote sensing unit takes samples responsive to received control signals from the well-bore tool. As described before, the received control signals are received in a modulated form superimposed on top of the RF power signals. Accordingly, the remote sensing unit must demodulate and interpret the control signals to know what types of samples it is being asked to take and to transmit back to the tool.

In an alternate embodiment, the remote sensing unit merely takes samples of all types of formation characteristics that it is designed to sample. For example, one remote sensing unit may be formed to only take pressure measurements while another is designed to take pressure and temperature. For this alternate embodiment, the remote sensing unit merely modulates and transmits whatever type of sample data it is designed to take. One advantage of this alternate embodiment is that remote sensing unit electronics may be simplified in that demodulation circuitry is no longer required. Tool circuitry is also simplified in that it no longer requires modulation circuitry and, more generally, the ability to transmit communication signals to the remote sensing unit.

Periodically, the remote sensing unit determines if the well-bore tool is still transmitting RF power (step 3616). If the remote sensing unit continues to receive RF power, it continues taking samples and storing data representative of the measured sample values while also charging the capacitor (or at least applying a DC voltage across the terminals of the capacitor) (step 3608). If the remote sensing unit determines that the well-bore tool is no longer transmitting RF power, the remote sensing unit modulates and transmits a data value representing a measured sample (step 3620). For example, the remote sensing unit may modulate and transmit a number reflective of a measured formation pressure or temperature.

The remote sensing unit continues to monitor the charge level of its capacitor (step 3624). In the described embodiment, internal logic circuitry periodically measures the charge. For example, the remaining charge is measured after each transmission of a measured subsurface formation sample data value. In an alternate embodiment, an internal switch changes state once the charge drops below a specified charge level.

If the charge level is above the specified charge level, the remote sensing unit determines if there are more stored sample data values to transmit (step 3628). If so, the remote sensing unit transmits the next stored sample data value (step 3632). Once it transmits the next stored sample data value, it again determines the capacitor charge value as described in step 3624. If there are no more stored sample data values, or if it determines in step 3624 that the charge has dropped below the specified value, the remote sensing unit stops transmitting (step 3636). Once the remote sensing unit stops transmitting, the well-bore tool determines whether more data samples are required and, if so, transmits RF power to fully recharge the capacitor of the remote sensing unit. This serves to start the process over again resulting in the remote sensing unit acquiring more subsurface formation samples.

Figure 37:
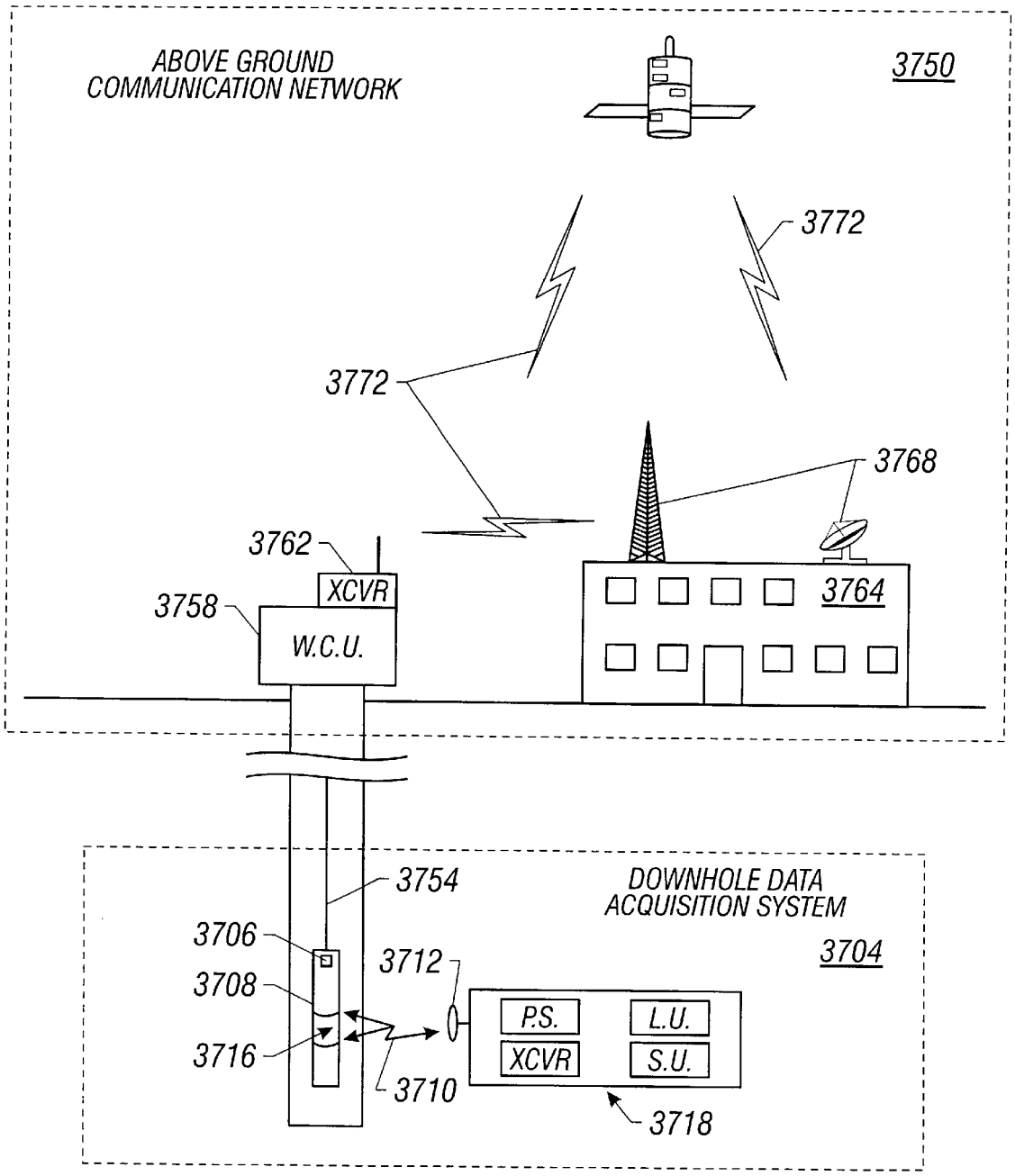
FIG. 37 is a functional block diagram illustrating a plurality of oilfield communication networks for controlling oilfield production.

FIG. 37 is a functional block diagram illustrating a plurality of oilfield communication networks for controlling oilfield production. Referring now to FIG. 37, a first oilfield communication network 3704 is a downhole network for taking subsurface formation measurement samples, the downhole network including a well-bore tool transceiver system 3706 formed on a well-bore tool 3708, a remote sensing unit transceiver system 3718, and a communication link 3710 there between. Communication link 3710 is formed between an antenna 3712 of the remote sensing unit transceiver system and an antenna 3716 of the well-bore tool transceiver system 3706 and is for, in part, transmitting data values from the antenna 3712 to the antenna 3716.

While the described embodiment herein FIG. 37 shows only one remote sensing unit in the subsurface formation, it is understood that a plurality of remote sensing units may be placed in a given subsurface formation. By way of example, a given subsurface formation may have two remote sensing units placed therein. In one example, the two remote sensing units include both temperature and pressure measuring circuitry and equipment. One reason for inserting two or more remote sensing units in one subsurface formation is redundancy in the even either remote sensing unit should experience a partial or complete failure.

In another example, one remote sensing unit includes only temperature measuring circuitry and equipment while the second remote sensing unit includes only pressure measuring circuitry and equipment. For simplicity sake, the network shown in FIG. 37 shows only one remote sensing unit although the network may include more than one remote sensing unit.

In the described embodiment, antenna 3716 includes a first and a second antenna section, each antenna section being characterized by a plane that is substantially perpendicular to a primary axis of the well-bore tool. Antenna 3712 is characterized by a plane that is substantially perpendicular to the planes of the first and second antenna sections of antenna 3716. Further, antenna 3716 is formed so that a current travels in circularly opposite directions in the first and second antenna sections relative to each other.

Antenna 3712 is coupled to remote sensing unit circuitry 3718, the circuitry 3718 including a power supply having a charge storage device for storing induced power, a transceiver unit for receiving induced power signals and for transmitting data values, a sampling unit for taking subsurface formation samples and a logic unit for controlling the circuitry of the remote sensing unit.

The well-bore tool transceiver system includes transceiver circuitry 3706 and antenna 3716. In the described embodiment, well-bore tool transceiver circuitry is formed within the well-bore tool 3708. In an alternate embodiment, however, transceiver circuitry 3706 can be formed external to well-bore tool 3708.

First oilfield communication network 3704 is electrically coupled to a second oilfield communication network 3750 by way of cabling 3754 (wellbore communication link). Second oilfield communication network 3750 includes a well control unit 3758 that is connected to cabling 3754 and is therefore capable of sending and receiving communication signals to and from first oilfield communication network 3704. Well control unit 3758 includes transceiver circuitry 3762 that is connected to an antenna. The well control unit 3758 may also be capable of controlling production equipment for the well.

Second oilfield communication network 3750 further includes an oilfield control unit 3764 that includes transceiver circuitry that is connected to an antenna 3768. Accordingly, oilfield control unit 3764 is operable to communicate to receive data from well control unit 3758 and to transmit control commands to the well control unit 3758 over a communication link 3772.

Typical control commands transmitted from the oilfield control unit 3764 over communication link 3772, according to the present invention, include not only parameters that define production rates from the well, but also requests for subsurface formation data. By way of example, oilfield control unit 3764 may request pressure and temperature data for each of the formations of interest within the well controlled by well control unit 3758. In such a scenario, well control unit 3758 transmits signals reflecting the desired information to well-bore tool 3708 over cabling 3754. Upon receiving the request for information, the well-bore transceiver 3706 initiates the processes described herein to obtain the desired subsurface formation data.

The described embodiment of second oilfield communication network 3750 includes a base station transceiver system at the oilfield control unit 3764 and a fixed wireless local loop system at the well control unit 3758. Any type of wireless communication network, and any type of wired communication network is included herein as part of the invention. Accordingly, satellite, all types of cellular communication systems including, AMPS, TDMA, CDMA, etc., and older form of radio and radio phone technologies are included. Among wireline technologies, internet networks, copper and fiberoptic communication networks, coaxial cable networks and other known network types may be used to form communication link 3772 between well control unit 3758 and oilfield control unit 3764.

Figure 38:
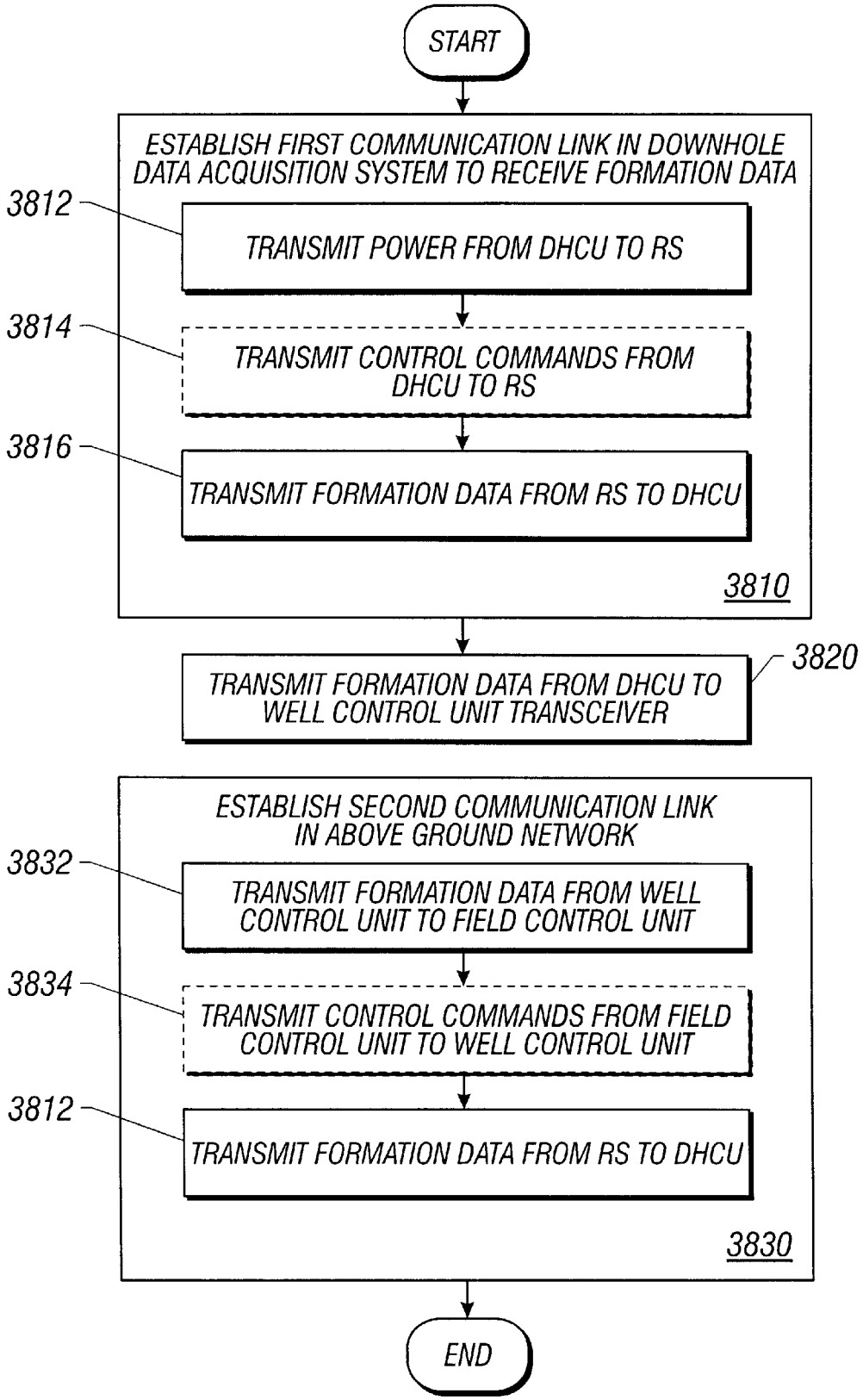
FIG. 38 is a flow chart demonstrating a method of synchronizing two communication networks to control oilfield production according to a preferred embodiment of the invention.

FIG. 38 is a flow chart demonstrating a method of synchronizing two communication networks to control oilfield production according to a preferred embodiment of the invention. Referring now to FIG. 38, a first communication link is established in a first oilfield communication network to receive formation data (step 3810). Step 3810 includes the step of transmitting power from a first transceiver of the first network to a second transceiver of the first network to "wake up" and charge the internal power supply of the second transceiver system (step 3812). According to specific implementation, an optional step is to also transmit control commands requesting specified types of formation data (step 3814). Finally, step 3810 includes the step of transmitting formation data signals from the second transceiver of the first network to the first transceiver of the first network (step 3816).

Once the first transceiver of the first network receives formation data, it transmits the formation data to a well control unit of a second oilfield network, the well control unit including a first transceiver of the second network (step 3820). Approximately at the time the well control unit receives or anticipates receiving formation data from the first network, a second communication link is established within the second oilfield network (step 3830). More specifically, the well control unit transceiver establishes a communication link with a central oilfield control unit transceiver. Establishing the second communication link allows formation data to be transmitted from the well control unit transceiver to the oilfield control unit (step 3832) and, optionally, control commands from the oilfield control unit (step 3834).

The method of FIG. 38 specifically allows a central location to obtain real time formation data to monitor and control oilfield depletion in an efficient manner. Accordingly, if a central oilfield control unit is in communication with a plurality of well control units scattered over an oilfield that is under development, the central oilfield control unit may transmit control commands to obtain subsurface formation data parameters including pressure and temperature, may process the formation data using known algorithms, and may transmit control commands to the well control units to reduce or increase (by way of example) the production from a particular well. Additionally, the method of FIG. 38 allows a central control unit to control the number of data samples taken from each of the wells to establish consistency and comparable information from well to well.

As will be readily apparent to those skilled in the art, the present invention may easily be produced in other specific forms without departing from its spirit or essential characteristics. The present embodiment is, therefore, to be considered as merely illustrative and not restrictive. The scope of the invention is indicated by the claims that follow rather than the foregoing description, and all changes which come within the meaning and range of equivalence of the claims are therefore intended to be embraced therein.

What is claimed is:

1. A communication system comprising:

a casing joint with a metal portion and an insulative portion;

at least one antenna portion carried about the insulative portion wherein the insulative portion separates the at least one antenna portion from the metal portion; and transceiver circuitry for transmitting and receiving wireless communication signals to a remote sensing unit via the at least one antenna portion.

2. The communication system of claim 1 further including a power amplifier for transmitting RF power to the remote sensing unit.

3. The communication system of claim 2 wherein the transceiver circuitry superimposes the RF power and the communication signals.

4. The communication system of claim 1 further including modulation circuitry for modulating communication signals that are to be transmitted to the remote sensing unit.

5. The communication system of claim 1 further including demodulation circuitry for demodulating communication signals that are received from the remote sensing unit.

6. The communication system of claim 5 wherein the at least one antenna portion comprises a first and a second antenna portion.

7. The communication system of claim 6 wherein the first and second antenna portions are substantially circularly shaped.

8. The communication system of claim 7 wherein the first and second antenna portions conduct current in circularly opposite directions.

9. A casing joint, comprising:

a casing joint with a metal portion, and an insulative portion;

at least one antenna portion formed about the insulative portion wherein the insulative portion separates the at least one antenna portion from the metal portion;

transceiver circuitry for transmitting and receiving wireless communication signals to a remote sensing unit via the at least one antenna portion;

a power amplifier for transmitting RF power to the remote sensing unit via the at least one antenna portion;

modulation circuitry for modulating communication signals that are to be transmitted to the remote sensing unit; and demodulation circuitry for demodulating communication signals that are received from the remote sensing unit.

10. The communication system of claim 9 wherein the transceiver superimposes communication signals with the RF power wherein the RF power acts as a carrier for the communication signals.

11. The communication system of claim 9 wherein the at least one antenna portion comprises a first and a second antenna portion.

12. The communication system of claim 11 wherein the first and second antenna portions are substantially circularly shaped.

13. The communication system of claim 12 wherein the first and second antenna portions conduct current in circularly opposite directions.

14. A method of communicating with a remote sensing unit deployed in a subsurface formation through a casing joint disposed in a wellbore penetrating the formation, comprising:

receiving control commands from a well unit;

wirelessly transmitting control commands to the remote sensing unit through the casing joint;

receiving subsurface formation data from the remote sensing unit through the casing joint; and transmitting the subsurface formation data to the well unit.

15. The method of claim 14 further including the step of transmitting RF power to the remote sensing unit, the RF power being superimposed with the control commands.

16. The method of claim 15 further including the step of transmitting RF power to the remote sensing unit for a first period to fully charge an internal charge storage device of the remote sensing unit.

17. The method of claim 16 further including the step of transmitting RF power to the remote sensing unit for a second period to recharge the remote sensing unit's internal charge storage device whenever the remote sensing unit stops transmitting subsurface formation data.

18. A communication system formed between two casing joints, comprising:

an antenna for transmitting power to a remote sensing unit deployed in a subsurface formation outside the two casing joints;

an insulative material to insulate the antenna from the two casing joints; and a signal and power conduit for transmitting power and communication signals from an external device, the signal and power conduit coupling the antenna to the external device.

19. The communication system of claim 18 further including circuitry for generating control signals for transmission via the antenna.

20. The communication system of claim 19 further including a modulator and a demodulator for modulating and demodulating communication signals transmitted to and received from the remote sensing device.

21. The communication system of claim 18 wherein the antenna is formed about the casing joint.

22. The communication system of claim 18 wherein the antenna is formed about the casing joint and includes at least two coils separated by a distance.

23. The communication system of claim 18 further including a sealed aperture, the aperture including an antenna base, the antenna base being part of an antenna placed to extend from the casing joint into the formation.

* * * * *